US010334967B2

(12) United States Patent
Mercier et al.

(10) Patent No.: US 10,334,967 B2
(45) Date of Patent: Jul. 2, 2019

(54) MERCHANDISER AND METHODS RELATING TO SAME

(71) Applicant: Retail Space Solutions LLC, Milwaukee, WI (US)

(72) Inventors: Michael William Mercier, Chicago, IL (US); Daniel Davenport, Chicago, IL (US)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 15/659,331

(22) Filed: Jul. 25, 2017

(65) Prior Publication Data

US 2018/0020848 A1 Jan. 25, 2018

Related U.S. Application Data

(60) Provisional application No. 62/366,319, filed on Jul. 25, 2016, provisional application No. 62/447,547, filed on Jan. 18, 2017.

(51) Int. Cl.

| | |
|---|---|
| ***A47F 5/00*** | (2006.01) |
| ***A47F 1/12*** | (2006.01) |
| *A47B 57/58* | (2006.01) |
| *A47F 5/08* | (2006.01) |
| *A47B 96/02* | (2006.01) |

(52) U.S. Cl.

CPC ..... *A47F 5/005* (2013.01); *A47F 1/126* (2013.01); *A47F 5/0068* (2013.01); *A47F 5/0087* (2013.01); *A47F 5/0093* (2013.01); *A47B 57/585* (2013.01); *A47B 96/025* (2013.01); *A47B 96/027* (2013.01); *A47F 5/083* (2013.01)

(58) Field of Classification Search

CPC ..... A47F 5/0087; A47F 5/008; A47F 5/0093; A47F 5/0068; A47F 5/083; A47F 1/126; A47B 96/025; A47B 96/027; A47B 57/585

USPC ..... 108/108, 61; 211/51, 53, 95, 126.15

See application file for complete search history.

(56) References Cited

U.S. PATENT DOCUMENTS 2,103,885 A * 12/1937 Whalen ..... F25D 25/021 211/134

2,647,812 A 8/1953 Saunders (Continued)

FOREIGN PATENT DOCUMENTS

AT 100197 T 1/1994

BR I0718645 A2 11/2013

(Continued)

OTHER PUBLICATIONS

Patent Cooperation Treaty, International Searching Authority, Notification of Transmittal of the International Search Report and the Written Opinion of the International Searching Authority, or the Declaration, Issued in International Application No. PCT/US 2017/043755, dated Nov. 30, 2017, 9 pp.

*Primary Examiner* — Jose V Chen

(74) *Attorney, Agent, or Firm* — Andrus Intellectual Property Law, LLP

(57) ABSTRACT

A product display merchandiser comprising a support member, an intermediate member movably attached to the support member, and a product support attached to the intermediate member. The intermediate member being movable between at least a retracted position and an extended position.

8 Claims, 47 Drawing Sheets

(56) References Cited

U.S. PATENT DOCUMENTS 2,934,212 A 4/1960 Jacobson
4,169,416 A 10/1979 Haynes
4,314,648 A 2/1982 Spamer
4,416,380 A 11/1983 Flum
4,565,725 A 1/1986 Spamer
4,582,372 A 4/1986 Cooper
4,602,570 A 7/1986 Lee
4,646,658 A 3/1987 Lee
4,735,470 A * 4/1988 Falk ..... F25D 25/021 312/246
4,890,746 A 1/1990 Trulaske, Sr.
4,955,486 A 9/1990 Trulaske, Sr.
5,022,535 A 6/1991 Spamer
5,123,546 A 6/1992 Crum
5,313,264 A 5/1994 Ivarsson
5,437,379 A 8/1995 Wolf
5,531,159 A 7/1996 Stubblefield
5,567,026 A 10/1996 Lacewell
5,577,823 A 11/1996 Maglinger
5,584,396 A 12/1996 Schmitt
5,614,288 A 3/1997 Bustos
5,673,801 A 10/1997 Markson
5,715,957 A 2/1998 Merl
5,720,230 A 2/1998 Mansfield
5,738,019 A 4/1998 Parker
5,855,283 A * 1/1999 Johnson ..... A47F 1/126 211/103
5,862,923 A 1/1999 Nordquist
5,865,323 A 2/1999 Lecroy
5,970,887 A 10/1999 Hardy
5,992,651 A 11/1999 Shaw
6,497,185 B1 * 12/2002 Barrett ..... A47B 96/025 108/108
6,585,119 B2 7/2003 Palder
6,651,828 B2 11/2003 Dimattio
6,659,293 B1 12/2003 Smith
6,715,621 B2 4/2004 Boron
6,719,151 B2 4/2004 Close
6,799,523 B1 10/2004 Cunha
6,923,330 B1 8/2005 Nagel
6,976,598 B2 12/2005 Engel
7,258,317 B1 8/2007 Nagel
7,311,211 B2 12/2007 Chung
7,346,913 B2 3/2008 Ishimine
7,480,154 B2 1/2009 Lawrence
7,665,618 B2 2/2010 Jay
7,690,519 B2 4/2010 Kahl
7,854,333 B2 12/2010 Kottke
8,021,626 B2 9/2011 Malmqvist
8,464,878 B2 6/2013 Andersen
8,511,487 B2 8/2013 Andersen
8,640,892 B2 2/2014 Polizzi
8,926,034 B2 * 1/2015 Park ..... A47B 96/025 108/102
9,004,297 B2 4/2015 Sjolander
9,038,833 B2 5/2015 Ciesick
9,101,215 B2 8/2015 Kreyenkamp
9,119,470 B2 9/2015 Kreyenkamp
9,289,078 B2 3/2016 Hardy
9,486,089 B1 * 11/2016 Ng ..... A47F 1/126
2003/0160012 A1 * 8/2003 Kanouchi ..... A47F 3/063 211/59.2
2004/0090158 A1 5/2004 Horowitz
2005/0006331 A1 1/2005 Engel
2005/0076817 A1 4/2005 Boks
2005/0189310 A1 9/2005 Richter
2006/0163984 A1 7/2006 Andersen
2006/0169653 A1 8/2006 Palder
2007/0035219 A1 2/2007 Andersen
2007/0048112 A1 3/2007 Andersen
2007/0145869 A1 6/2007 Sjolander
2008/0011696 A1 1/2008 Richter
2008/0156751 A1 7/2008 Richter
2008/0164229 A1 7/2008 Richter
2008/0314852 A1 12/2008 Richter
2009/0039040 A1 * 2/2009 Johnson ..... A47F 1/126 211/120
2009/0223916 A1 9/2009 Kahl
2010/0260642 A1 10/2010 Malmqvist
2011/0068071 A1 3/2011 Suman
2011/0079567 A1 4/2011 Anderson
2012/0091079 A1 4/2012 Schwester
2012/0118843 A1 5/2012 MacLean
2012/0193312 A1 8/2012 Sjölander
2012/0298604 A1 11/2012 Fuhrer
2013/0327733 A1 * 12/2013 Csak ..... A47F 5/0087 211/59.3
2014/0091696 A1 4/2014 Welker
2015/0096950 A1 4/2015 Engel
2015/0208830 A1 * 7/2015 Hardy ..... A47F 1/126 211/59.3
2015/0230628 A1 * 8/2015 Juric ..... A47F 5/005 211/59.2
2015/0289680 A1 10/2015 Sosso
2016/0007744 A1 1/2016 Fasino
2016/0174732 A1 6/2016 Hardy
2017/0164762 A1 * 6/2017 Bryson ..... A47F 5/0025
2017/0295958 A1 * 10/2017 Hassell ..... A47F 5/12
2018/0213946 A1 * 8/2018 Vanos ..... A47F 1/125

FOREIGN PATENT DOCUMENTS

CA 2815257 A1 4/2012
CA 2848792 10/2014
DK 67282 C 7/1948
DK 2091391 7/2011
EP 1597986 A1 11/2005
EP 1605423 A1 12/2005
EP 1614985 A1 1/2006
EP 1733655 A1 12/2006
EP 1780485 A1 5/2007
EP 1803378 A1 7/2007
EP 2441354 B1 11/2012
EP 2591703 A1 5/2013
EP 2944228 A1 11/2015
EP 2944229 A1 11/2015
ES 2434073 T3 12/2013
NL 9301698 A 5/1995
PT 2077739 E 11/2013
SI 2077739 T1 12/2013
WO 9848675 11/1998
WO 0101823 1/2001
WO 0160216 A1 8/2001
WO 2009094122 7/2009
WO 2010143973 A1 12/2010

* cited by examiner

1600

MERCHANDISER AND METHODS RELATING TO SAME

CROSS-REFERENCE TO RELATED APPLICATIONS

This application claims the benefit of U.S. Provisional Application No. 62/366,319, filed Jul. 25, 2016, which claims the benefit of U.S. Provisional Application No. 62/447,547, filed Jan. 18, 2017, both of which are hereby incorporated herein by reference in their entirety.

FIELD

This invention relates generally to product displays and, more particularly, to merchandisers offering additional movement options (e.g., rotation, partial rotation, full extension, dual action extension, etc.) to assist in their operation (e.g., stocking, merchandising or displaying/dispensing product to consumers, re-stocking, etc.) and methods relating to same.

BACKGROUND

Product displays, such as merchandisers, are frequently used in retail environments to display products for sale. It is advantageous for these product displays to be configured to provide consumers easy access to the displayed product, to display the product cleanly and in an unobstructed manner so that product brands are readily visible and the store shelves look full or stocked at most times (also known as fronting), and to facilitate easy installation and restocking or reloading by store employees. To accomplish this, many different forms of displays have been developed that are front-facing or self-facing. For example, there are shelf management systems that mount directly on the shelf, bar mounted systems that replace shelves and suspend from a bar, grid-mounted systems that replace shelves and suspend from a grid system. In addition, there are often two versions of these systems: one gravity fed and the other utilizing a biased pusher or paddle to push the stocked product forward as items are removed from a shelf.

Another benefit of these types of displays is that they are typically setup to keep the inventory as new and fresh as possible and to sell off all existing inventory before allowing newer or replacement product to be purchased (e.g., a concept often referred to as "first in first out"). Without these systems, retailers and/or product suppliers are forced to spend much more time and resources (and therefore money) on monitoring, organizing and fronting displayed product and typically end up doing so in a less efficient manner with less desirable results, such as having newer product stocked by hand in front of older product increasing the likelihood of spoilage or product failing to be sold by the "sell by" date and incurring much more labor expense.

One problem with conventional merchandisers is that they typically require being loaded from the front because there is no rear access to the display once installed (e.g., gondolas are placed back-to-back preventing rear access to same). For perishable products, this requires pulling out the already stocked product, loading new product, and then placing the old product back in the front of the merchandiser to ensure "first in first out" is followed to reduce spoilage. This can be a time-consuming process and results in increased spoliation if not done correctly each and every time, thereby costing stores money (both for damaged/lost product and lost sales).

In addition, conventional tray or drawer type merchandisers require the displayed product to be pressed against pushers during stocking/restocking which can make the merchandiser harder to stock/restock and can cause damage to the product being stocked/restocked (e.g., damaged product packaging) depending on how much force is exerted against the product between the person stocking/restocking the displayed product and the pushers of the merchandiser. Damaged product packaging can also result in lost sales. Even conventional pull-out trays that attempt to provide store associates with greater access to the rear of the product channel only extend out part way from their mounting structure (e.g., approximately 25%-33% extension from the mounting structure) which may not be enough room to allow for efficient stocking/restocking of the merchandiser.

Some conventional merchandisers also allow for stacked product to be merchandised in one product channel, but they do so in a way that requires the product to be pulled from the merchandiser in a particular manner or stocked in a particular manner. This hinders the merchandiser from being used with different types of product in the product stacks and/or makes it more inefficient for the consumer to get to a desired product and/or the store associate to stock/restock the merchandiser.

Conventional product and merchandisers also fail to provide efficient ways for packaging, transporting and/or loading product. Typically, product is packaged in a conventional package, such as a box, and store associates are required to remove from the box enough product to load the merchandiser and then return the partially empty box back to the backroom to use at a later date when the merchandiser has emptied enough to stock the remaining product from the box or package. This results in an inefficient usage of the store associate's time and can result in partially emptied boxes being overlooked and other cases being open, thereby, not following the desired first in first out inventory process meant to reduce or eliminate spoilage.

Conventional merchandisers are configured and setup in a display area to display product alongside one another in well-defined rows and columns, which is not always the most efficient use of space for products on display. Often times this can yield less densely packed display areas that fail to maximize product pack-out in that area (e.g., horizontal pack-out, vertical pack-out, or both). Given how valuable space is in most retailers' stores, any improvement to product pack-out within a display area typically frees-up space to add additional product offerings and is thus greatly desired by the retailers and consumers alike. This problem is also often exacerbated by conventional merchandisers that take a one-size fits all approach. Some tray merchandisers do offer adjustable width features to try and customize the size of the merchandiser to the size of the particular product being displayed to help pack-out, but even these merchandisers are limited in what they can do because they lack the ability to be truly customized to the products being displayed.

Accordingly, it has been determined that a need exists for improved product display merchandisers that address and/or solve the aforesaid problems with conventional merchandisers both via new apparatus and new methods relating to same.

BRIEF DESCRIPTION OF THE FIGURES

Embodiments of the invention are illustrated in the figures of the accompanying drawings in which:

FIG. 7A is a perspective view of the side loading product display merchandiser in a first, display position;

FIG. 7B is a perspective view of the side loading product display merchandiser of FIG. 7A in a second, loading position;

FIG. 7C is a side view of the side loading product display merchandiser of FIGS. 7A-7B with the bottom row being loaded;

FIG. 7D is a side perspective view of the side loading product display merchandiser of FIGS. 7A-7C with the second row being loaded;

FIG. 7E is a front perspective view of the side loading product display merchandiser of FIGS. 7A-7D with a product being removed from the bottom row;

FIG. 7F is a front perspective view of the side loading product display merchandiser of FIGS. 7A-7E with a product removed from the bottom row;

FIG. 7G is a front perspective view of the side loading product display merchandiser of FIGS. 7A-7F with an optional pusher rake coupled to a pull tab;

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE EMBODIMENTS

Many variations of product displays are discussed herein and even further are contemplated in view of this disclosure. The product displays discussed herein are configured, and designed, to hold and display product that is for sale and to front face this product so that the next item in the display is moved to the front of the display as the product in front of it is removed from the merchandiser. In a preferred form, the merchandisers disclosed herein provide a method for ensuring product travels in a "first in, first out" process so as to reduce spoilage and costs associated with same, and to improve sales by ensuring product is taken in this order to reduce the likelihood of product spoilage. While many variations of product display are described and contemplated herein, it should be understood that many more are intended to be covered by the concepts disclosed herein.

In general, many of the product displays disclosed herein include a support member configured to couple to a shelving unit, and a tray movably coupled to the support member. The tray has two parts, the product support and the intermediate member. The intermediate member is movable relative to the support member, and the product support in turn is movable relative to the intermediate member. The intermediate member is generally slidable relative to the support member from a retracted position for displaying products, to an extended position for restocking. The product support is slidable and/or rotatable relative to the intermediate member from a display position to a stocking position.

Figure 1A:
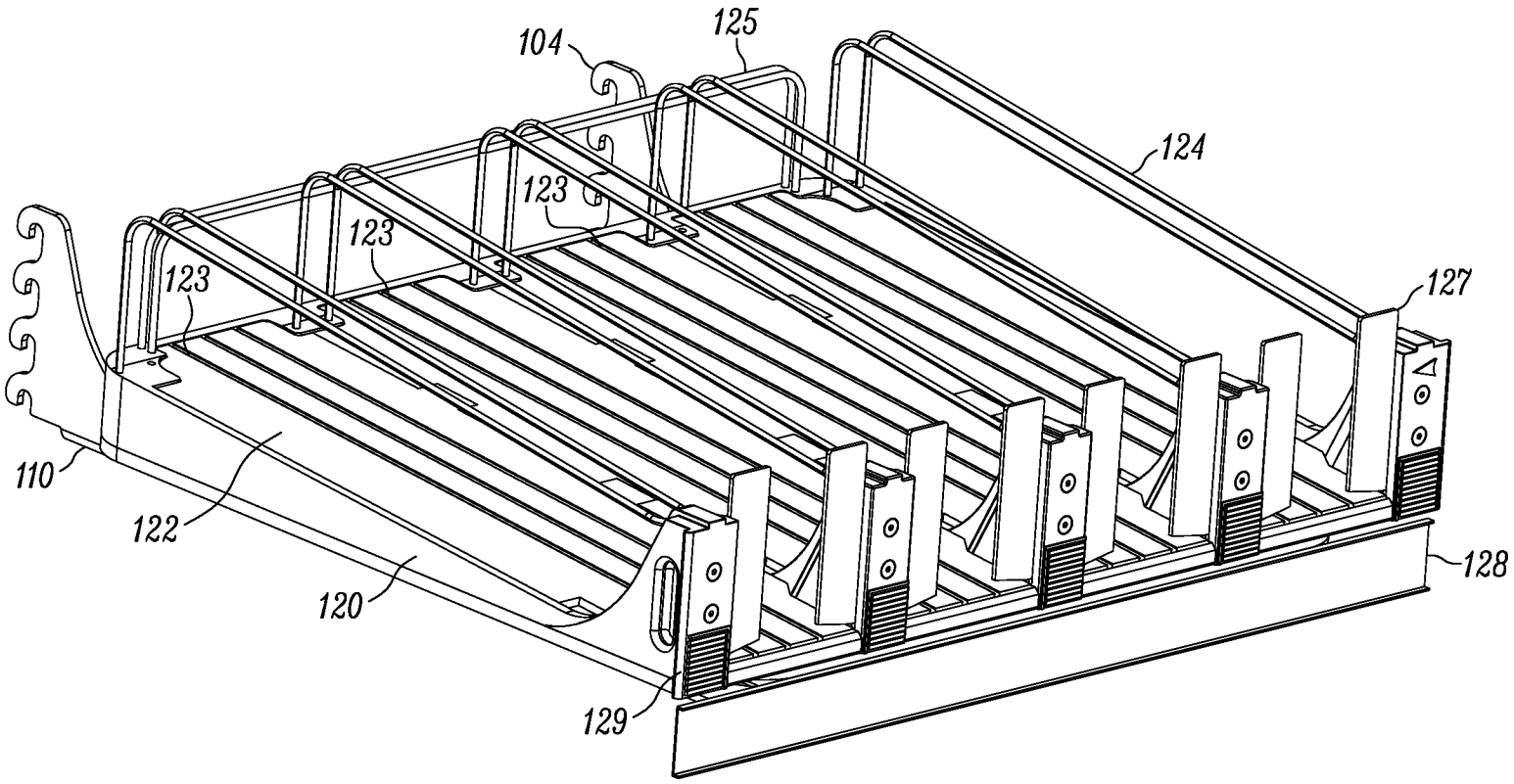
FIG. 1A is a perspective view of a rotatable product display merchandiser in accordance with some embodiments of the present invention, illustrating the product tray in a first, retracted position.
Figure 1B:
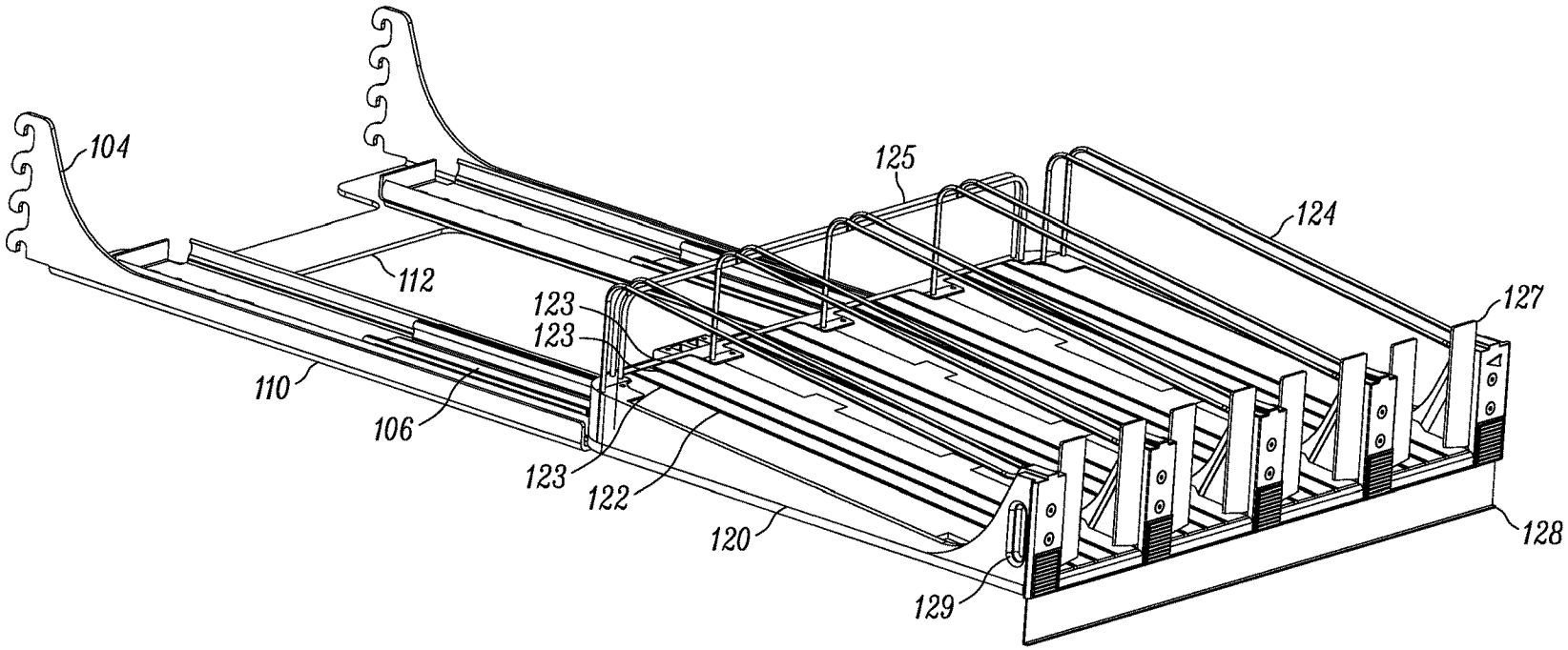
FIG. 1B is a perspective view of the rotatable product display merchandiser of FIG. 1A illustrating the product tray in a second, extended position.
Figure 1C:
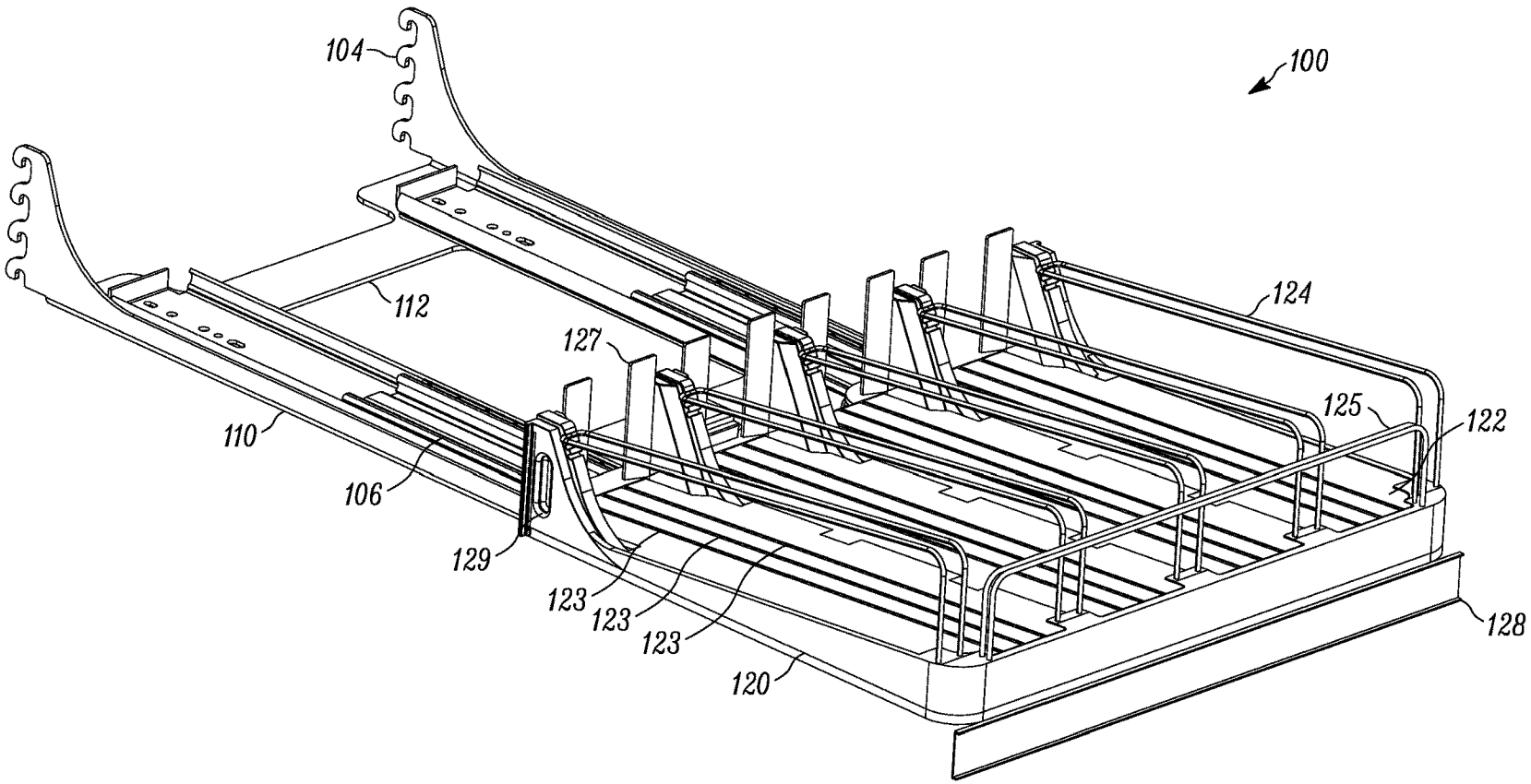
FIG. 1C is a perspective view of the product display merchandiser of FIGS. 1A-B with the tray in the second or extended position and rotated 180 degrees.
Figure 1D:
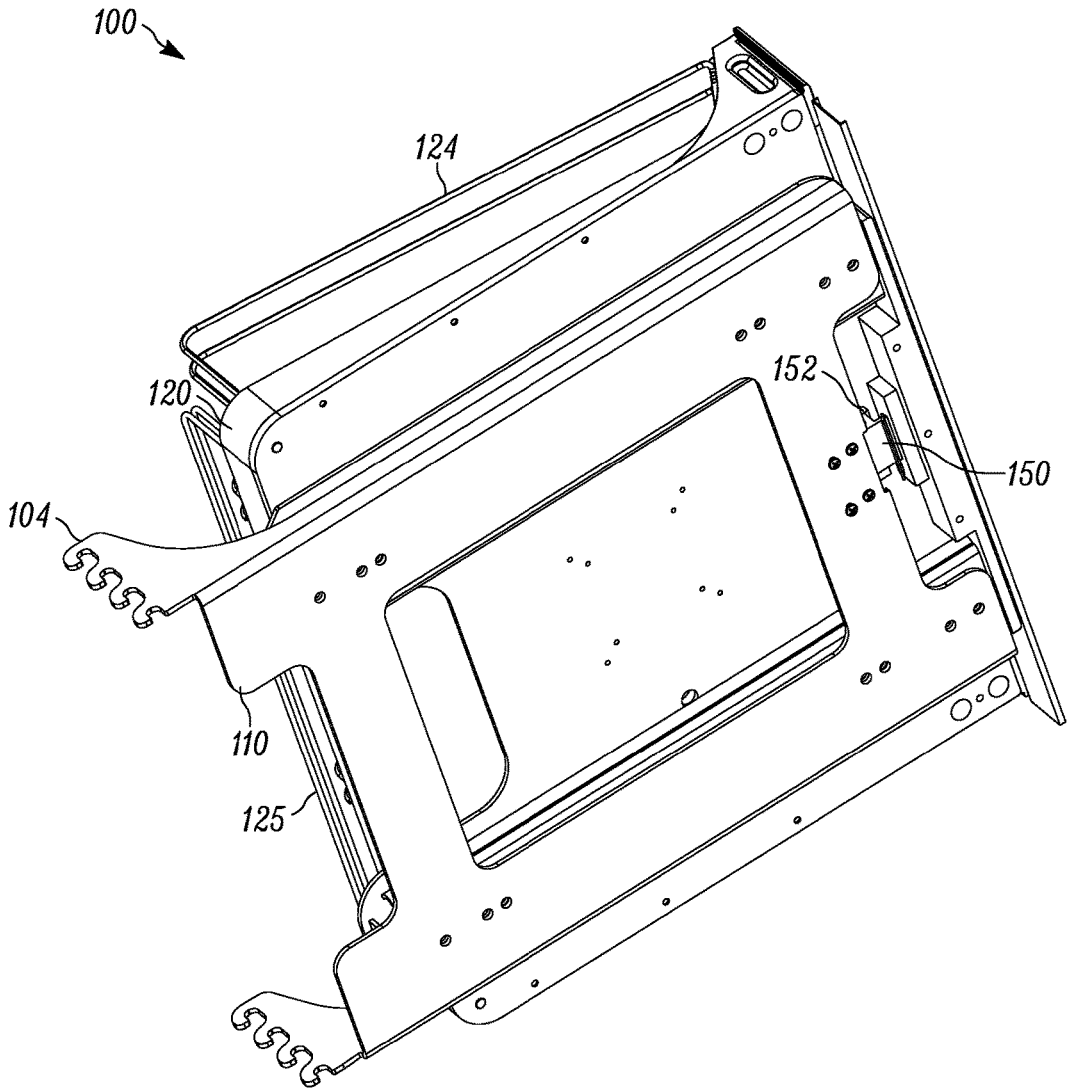
FIG. 1D is a perspective view of the product display merchandiser of FIGS. 1A-C taken from below and illustrating the tray in the first, retracted, position.
Figure 1E:
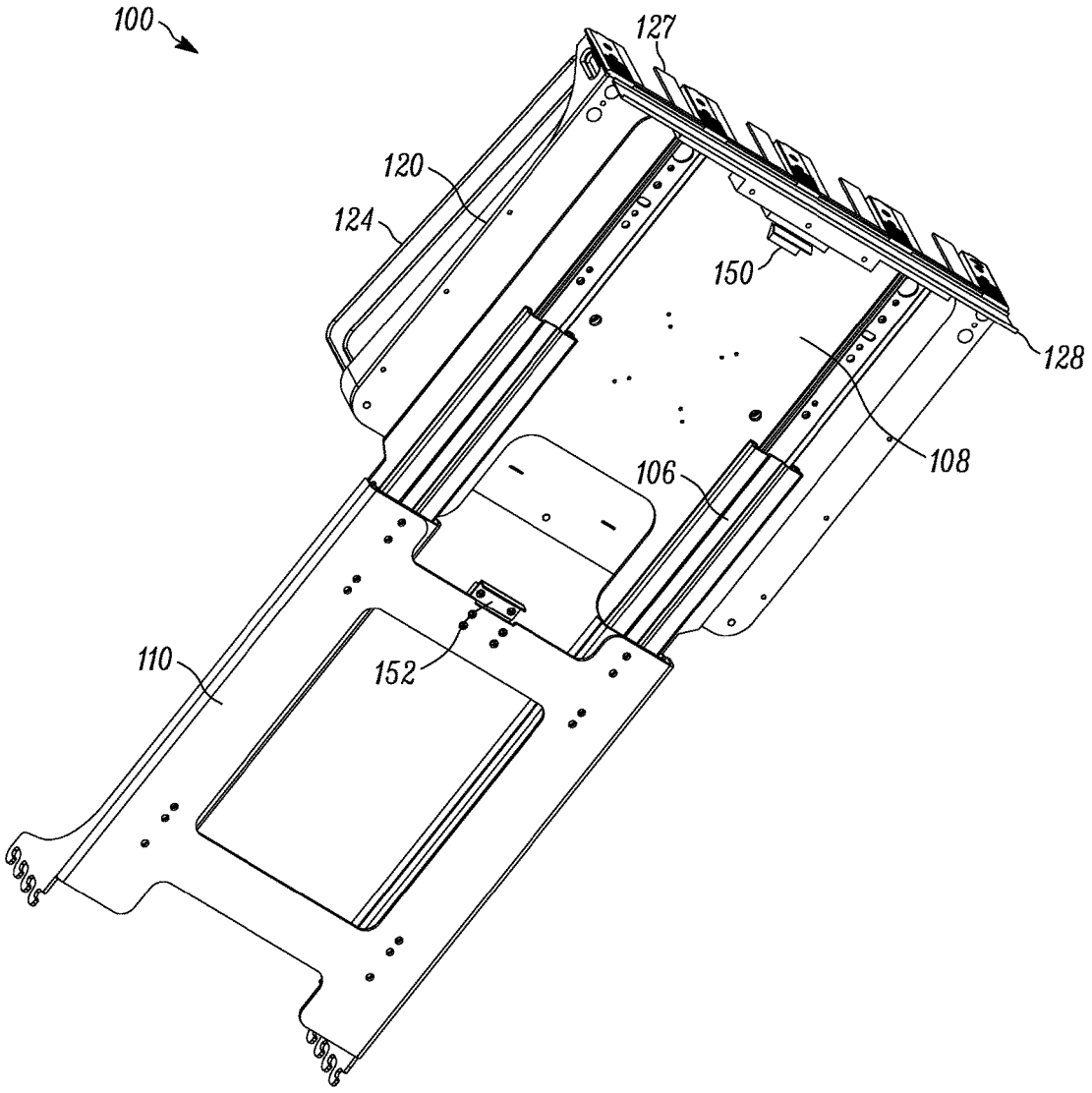
FIG. 1E is a perspective view of the product display merchandiser of FIGS. 1A-D taken from below and illustrating the tray in the second, extended, position.
Figure 1F:
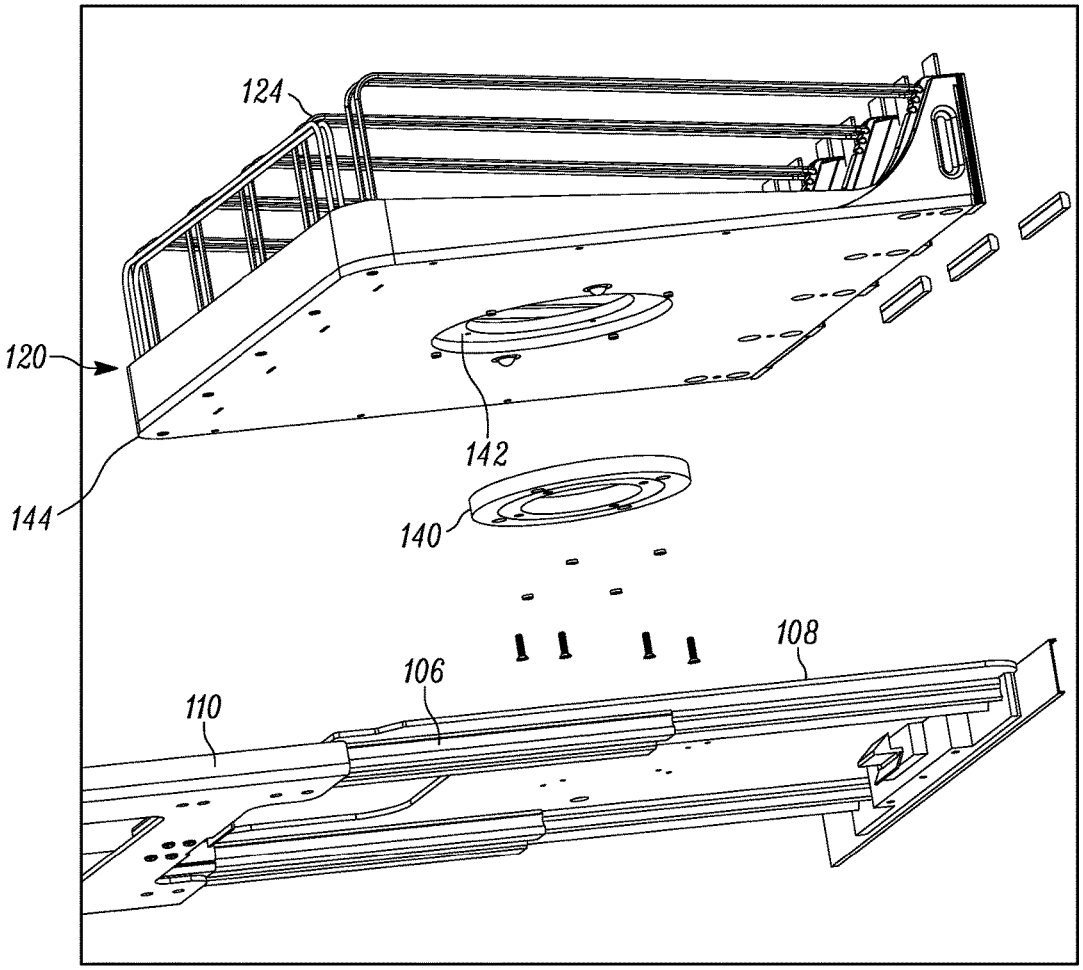
FIG. 1F is an exploded view of the product display merchandiser of FIGS. 1A-E illustrating the hub that allows the tray to rotate about a central axis.

FIGS. 1A-1F illustrate an exemplary embodiment of a product display merchandiser 100. As best shown in FIG. 1F, the product display merchandiser 100 includes a product support or tray 120 for holding a product to be displayed. The tray 120 is supported by a bearing 140 such as a lazy Susan bearing or swivel bearing, which in turn is supported by the intermediate member or support plate 108. The size of the support plate 108 only needs to be large enough to support the bearing 140 and in a preferred form will be integrated into a front stabilizer for the tracks so that the merchandiser can be built as a baseless tray platform, if desired. In FIGS. 1A-1F, the bearing 140 is centered on the tray 120. Centering the bearing 140 on the tray 120 minimizes the amount of clearance needed on either side for rotation of the tray 120 and allows the merchandiser 100 to rotate within its own foot print rather than pivoting and blocking other product displays which can prevent consumers from accessing those other product displays while an associate is restocking a different merchandiser 100. The swivel bearing 140 as shown rotates around a substantially vertical axis. In alternative embodiments, the axis of rotation of the swivel bearing 140 can be angled toward the front of the tray 120 in order to lower the back of the tray 120 when the tray 120 rotated to aid in stocking.

The tray 120 includes a bottom plate 144 having a recess 142 into which the bearing 140 fits. Placing the bearing 140 in the recess 142 reduces the amount of space between the tray 120 and the support plate 108. In preferred form, a low profile bearing or hub 140 will be used to reduce the height of the display so that vertical product on the store shelving can be maximized.

The support plate 108 may be slidably mounted on a support or base by slides or tracks 106, being slidable between many positions including a first or retracted position and a second or extended position. In the embodiment shown, the support or base comprises support members or support arms 110. In alternative embodiments, the support arms 110 are replaced with a solid base. In alternative embodiments, the support plate 108 may be slidably mounted directly onto the support arms 110. As mentioned above, in another form the merchandiser 100 may be constructed in a baseless tray platform where the tray 120 extends directly from the support arms 110 or attachment means 104. In such a configuration, the merchandiser 100 may further include a rear stabilizer connecting the rear of the support arms 110 to stabilize same as disclosed in U.S. Provisional Application Nos. 62/195,487 filed Jul. 23, 2015 and 62/247,744 filed Oct. 28, 2015 which are hereby incorporated herein by reference in their entirety.

Figure 2:
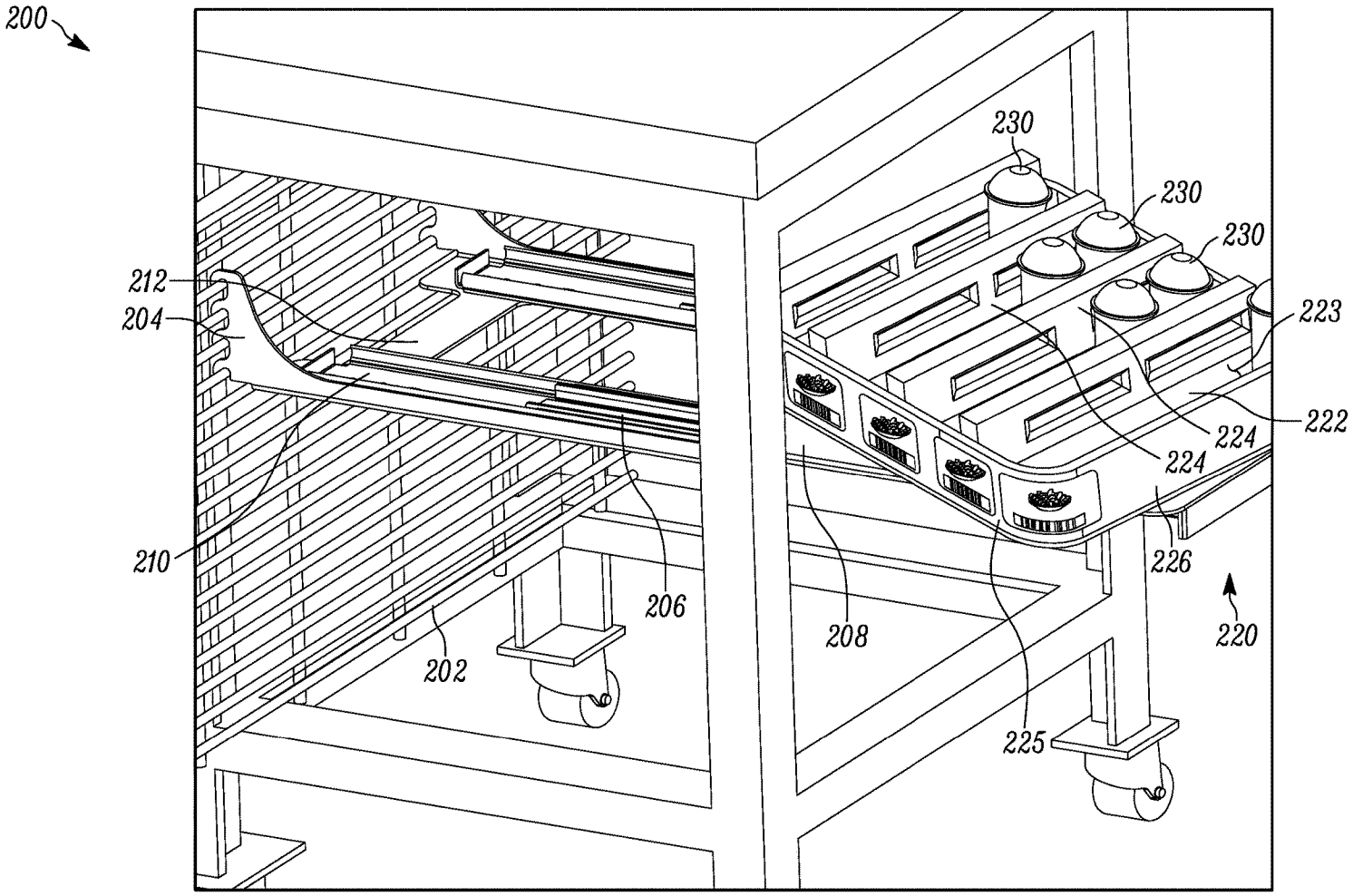
FIG. 2 is a perspective view taken from above and off to the side of a product display merchandiser according to some embodiments of the present application and illustrating the tray partially stocked and partially rotated.
Figure 3:
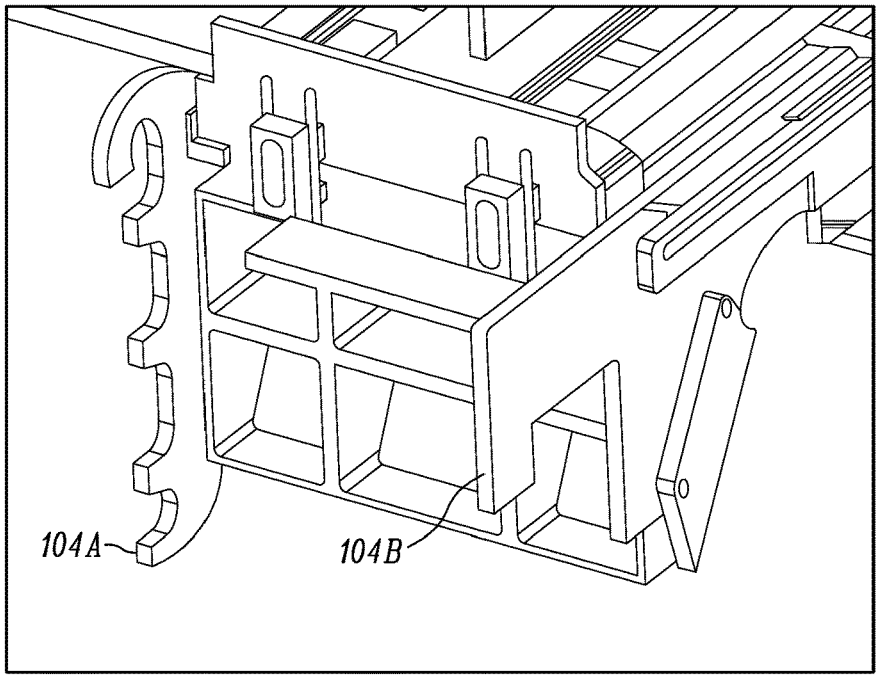
FIG. 3 is a comparative view of two types of attachment means for use in connecting a rotatable product display such as that disclosed herein to a support.

FIG. 1A illustrates the merchandiser 100 in a retracted state, with the tray 120 slid in along the tracks 106. FIG. 1B illustrates the merchandiser 100 in an extended state, with the tray 120 slid out along the tracks 106. The tracks 106 can be drawer slides or bearing slides. In some embodiments, the tracks 106 are dampened at one or both end, or along their entire length, to prevent the merchandiser 100 and/or the products from being damaged from being extended or retracted too quickly. In some embodiments, the support arms 110 includes cross braces 112 for added stability. The support arms 110 are supported by an attachment to a support structure by an attachment means 104. In the embodiment show, the attachment means 104 is one or more hooks configured to slide over the cross members of a wire grid, such as the wire grid 202 shown in FIG. 2. In alternative embodiments, the attachment means 104 is configured to attach to a bar. In FIG. 3, the grid mount attachment means 104A is contrasted with a bar mount attachment means 104B. In other alternative embodiments, the support arms 110 are configured to be supported by a shelf by attaching the tracks 106 directly to the top surface of a shelf. Example systems to slidably mount a merchandiser tray to a base can be seen in U.S. Provisional Application 62/247,744, "Merchandiser and Methods Relating to Same" assigned to DCI Marketing, Inc. which is fully incorporated by reference herein.

The tray 120 has a plurality of product channels 122. The product channels 122 are separated by dividers 124. The dividers 124 can be made of a wide variety of materials, including metal wire as shown in FIGS. 1A-1F or solid plastic as shown in FIG. 2. In alternative embodiments, the dividers 124 are removable or adjustable such that the width of the product channels 122 can be adjusted to correspond to the product. Each product channel 122 is configured to hold a row of products. In some embodiments with wire dividers 124, the left outside divider 124 is offset from the right outside divider 124. This offset prevents the dividers 124 on adjacent merchandisers 100 from becoming entangled. Examples of adjustable dividers 124 and offset dividers 124 can be seen in U.S. Pat. No. 7,681,744 "Merchandising System" which is assigned to DCI Marketing, Inc. and is fully incorporated by reference herein.

In alternative embodiments, at least one of the outside dividers 124 is missing. When the tray 120 is pulled out along the tracks 106, the product channel without the divider can be loaded from the side. In some versions of this embodiment, the tray 120 has a stop to stop rotation of the tray 120 at 90 degrees, so that the dividerless side is in the front. This embodiment is best suited for trays 120 that only have 1 or 2 product channels 122 (such that every channel 122 is accessible from one side or the other by pivoting the tray 120 90 degrees), but it can be used in multi-channel 122 trays 120.

In some embodiments, the floor of the product channels 122 are configured to minimize friction between the product channel 122 and the product. As shown in FIG. 1A, the floor of the product channels 122 comprise 3 raised beads 123 to minimize the area of contact. The raised beads 123 are made of a material with a low coefficient of friction, such as nylon. The number of beads can vary depending on the product, the slope of the product channel 122, and the material used to make the bead 123 in order to fine tune the friction. One bead 123 or several bead 123 systems are both viable. Additionally, the shape of the beads 123 can be changed to affect the friction between the beads 123 and the products. Instead of the straight beads 123 shown, some embodiments have wavy or zig-zag shaped beads 123 (e.g., beads following a tortious path to dampen product movement). In alternative embodiments, the characteristics of the beads 123 can vary along the length of the product channel 122. A higher friction bead 123 may be preferable near the front end of the product channel 122 in order to dampen products. In alternative embodiments, the product channels 122 have rollers to aid in allowing the products to slide forward. For smaller products, the rollers are offset relative to each other to prevent the products from dipping. In still other embodiments, the product channels 122 have a floor comprising a smooth, flat surface. In this embodiment, the front of the product channel 122 can comprise a rougher surface to dampen the movement of the products. In some embodiments, the beads 123, rollers, and/or smooth and rough surface are integrated in inserts that can be easily added or removed from the product channels 122. The inserts can be made of any of a variety of materials, including silicon impregnated polymer. The use of inserts has the added benefit of aiding in the cleaning of the merchandiser 100. This also allows the product channels 122 to quickly be modified correlating to the product.

The tray 120 further includes a back wall 125. The back wall 125 can be wire, as shown in FIG. 1A, or solid as shown in FIG. 2. The back wall 125 prevents products from being pushed off of the back of the tray 120. Turning to FIG. 1B, the front end of the tray 120 includes a price channel 128 and a stopper 127. The stopper 127 prevents products from falling out of the front of the product channels 122. In the embodiment shown, the stopper 127 comprises a pair of deformable plastic living hinges. When the products are pulled forward with sufficient force, such as when a customer pulls one, the stoppers 127 deform to allow the product to pass through. Once the product is pulled through, the stoppers 127 spring back into the resting state, blocking the next product in line. In alternative embodiments, when the products are deformable, the stoppers 127 can be rigid and still allow pull through from the deformation of the products. In other embodiments, the stoppers 127 comprise a lip along the bottom edge, similar to the back wall 125, that the products can be lifted over. This lip can be solid or wire, or can be integrated into the price channel 128. In other alternative embodiments, the stoppers 127 can be hingedly attached to the tray 120 and spring biased. When a product is pulled into the stoppers 127 the stoppers 127 swing out of the way about the hinge, and then the spring forces them back into position after the product passes through. In still other forms, the tray 120 may define a flat front section meant to position the front most product in a manner to make it more visible and easy to read.

The price channel 128 is configured to hold price tags for the products. In some embodiments, the price channel 128 includes a protective lens overtop of the price tags. In some embodiments the price channel 128 is a dual channel such that it can have a tag with words and or pictures to illustrate the product or product information (e.g., price) to the customer in a first channel, and a product number or scannable code in the second channel for use by store associates. In alternative embodiments, the price channel 128 can be reduced in size to reduce the overall height of the tray 120 such that a larger percentage of the space can be used for products and/or so that the display maintains a low profile so that maximum vertical products can be achieved on the store's shelving unit.

The tray 120 further comprises a structure or mechanism for facing the products. As shown in FIGS. 1A-1C, the tray is slanted, with the front end being lower than the back end. This slight slant combined with the low friction channels 122 described above result in the products moving to the front of the product channels 122 by gravity (e.g., gravity fed).

Figure 4:
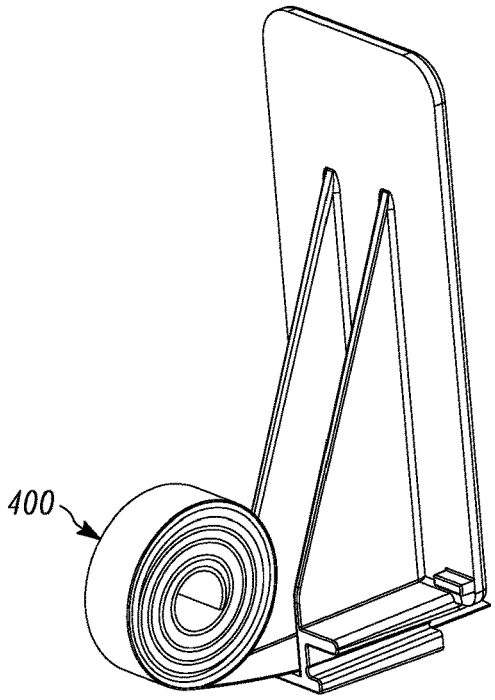
FIG. 4 is a perspective view of a spring biased pusher which may be utilized on the tray of a rotatable merchandiser such as those disclosed herein.

In an alternative embodiment, the product channels 122 can include a pusher. The pushers comprise a structure rising from the product channel 122 floor, having a front surface for engaging the products 122. The pushers can be biased, such as by a spring, towards the front end of the tray 120 so that they continuously exert a forwards force on the products. An example spring biased pusher 400 is shown in FIG. 4. Alternatively, the pushers are operably coupled to a pull tab located at the front of the tray 120, an associate can pull on the tab resulting in the pusher being forced towards the front of the tray 120. In a gravity fed system, such as the one shown, the pusher can simply be weighted so that it pushes the products forward as a result of gravity. This can be necessary with light products that cannot overcome the static friction with the product channels 122 under just their own weight.

In some embodiments of each of the above described pusher assemblies, the pusher includes a damper to prevent it from applying enough force to damage the products. The damper also prevents the pusher from becoming damaged if it is accelerated over a long distance. In some embodiments, the pusher is integrated into a track in the floor of the pusher channel 122 (e.g., vertically mounted pusher). In alternative embodiments, the pusher is integrated into a track in a divider 124 (e.g., horizontally mounted pusher). The divider 124 mounted pusher combined with the alternative above with removable dividers 124, allows for pushers to be easily added or removed from the merchandiser 100 by simply swapping out the divider 124. This same level of modularity can be achieved with floor integrated pushers by integrating the pusher into a removable insert, like the inserts described above.

FIG. 1C illustrates the product display merchandiser 100 of FIG. 1B with the tray 120 rotated 180 degrees. In operation, the tray 120 is pulled out along the tracks 106, and then rotated on the swivel bearing 140 so that the stocker has access to the back of the product channels 122. In some embodiments, there is a stop that restricts the rotation of the tray 120 at 0 degrees so that it is properly aligned before being pushed back in. In other embodiments, the stop or a second stop restricts rotation of the tray 120 at 180 degrees to conveniently stop it in the correct position for loading. In alternative embodiments, additional stops can be added at different angles or intervals, such as for example at every 90 degrees, every 45 degrees, or every 30 degrees or as desired. The stops can be passive, meaning they are designed to be overcome with sufficient force exerted by the stocker or store associate. In the preferred embodiment, the stop consists of a spring biased ball in one of the tray 120 or the support plate 108 and corresponding detents in the other of the tray 120 and the support plate 108. When the ball is aligned with a detent, the spring pushes the ball into the detent which stops the rotation of the tray. Because of the curved surface of the ball, exerting torque to rotate the tray 120 will force the ball back up and allow the tray 120 to continue rotating. Alternatively, the tray 120 can have an active latch that needs to be released. For example, this could comprise a spring biased cylinder or rectangular prism shaped bolt and corresponding recesses or openings. When the bolt is aligned with the recess or opening the spring forces the bolt in the recess or opening which prevents further rotation. The stocker would have to pull the bolt out of the recess or opening in order to rotate the tray 120 again. Other forms of active locks could be used (e.g., latches, pull knobs, push buttons, actuators, etc.).

As shown in FIG. 1C, the back wall 125 remains in position relative to the tray 120 when the tray 120 is rotated for loading. The tray 120 includes a grip point 129 which an associate can pull on to exert torque onto the tray 120, causing it to rotate on the swivel bearing. The grip point 129 can be placed on one side or the other in order to encourage rotation in a certain direction. Some other indication can also be added to specify direction of travel if desired and/or the merchandiser 100 can be configured to only allow rotation in a desired direction if desired. The grip point 129 can be configured to be prominent, such that a new associate notices it and thus knows to rotate the tray 120. Alternatively, the grip point 129 can be hidden in order to prevent customers from rotating the tray 120. In some embodiments, the rotation of the tray 120 exerts centripetal force on the products which pushes them towards the front of the tray 120. Thus, a centrifugal force front facing merchandiser is disclosed herein.

In alternative embodiments, the back wall 125 is movable so that the stocker can push rows of products directly into the product channels 122 without having to go over the back wall 125. In order to achieve this, the back wall 125 can be operably coupled to the support plate 108, such that rotating the tray 120 relative to the plate 108 causes the back wall 125 to lower. Alternatively, the back wall 125 can be affixed to the support arms 110 or the support structure so that it does not move with the tray 120 when the tray 120 is pulled out. Alternatively, the back wall 125 can be hingedly attached to the tray 120 such that it can be folded down and/or up for loading. One benefit of the back wall 125 is that it prevents customers from pushing product off the back of the merchandiser 100 when re-inserting products into the front of the merchandiser 100.

In some embodiments, the swivel bearing 140 is at an angle relative to the support arms 110 such that rotation of the tray 120 lowers the back side of the tray 120. This results in the product channels 122 being substantially level when the tray 120 is at the 180 degree loading position. Lowering of the back in this way both provides easier access to the tray 120, especially if there is a structure above the tray 120 such as a second tray 120. Leveling the tray 120 also prevents products from accelerating from gravity down the entire length of a product channel 122, which may result in the product having enough momentum to pass through the stoppers 127, and/or may cause damage to the product or the merchandiser 100.

In alternative embodiments, the rotation of the tray 120 relative to the support plate 108 is dampened to prevent the tray 120 from being rotated too quickly. In some embodiments, the rotation of the tray 120 is dampened for the entire rotation. In other embodiments, the rotation of the tray 120 is only dampened for a short arc around each of the stops to slow the tray 120 down enough for the stop to engage.

In some embodiments, the rotation of the tray 120 is biased to assist in use. A spring can be used to bias rotation in one direction or the other. Alternatively, counteracting springs can be used to assist both in rotating from 0 degrees to 180 degrees and then from 180 degrees back to 0 degrees.

FIGS. 1D and 1E illustrate the bottom side of the merchandiser 100 described above. FIG. 1D shows the merchandiser 100 in a retracted state, as in FIG. 1A. FIG. 1E shows the merchandiser 100 in an extended state, as in FIG. 1B. The support plate 108 has a latch 150. The support arms 110 have a lip 152. As seen in FIG. 1D, when the tray 120 is retracted, the latch 150 engages the lip 152 to prevent the tray 120 from being extended along the tracks 106. In order to pull out the tray 120, the stocker disengages the latch 150 from the lip 152. Many different types of latches 150 can be used with the merchandiser 100 in order to achieve this function. This includes both active latches, as shown, and passive latches like the ball and detent setup described above. In still other forms, no latch is included but rather the tray 120 or a portion thereof is lifted to release it from the support plate 108 or support arms 110 allowing the tray 120 to be pulled out and/or rotated.

In alternative embodiments, the tracks 106 are designed such that movement is dampened such that a larger amount of initial force is needed to start pulling out the tray 120, this would prevent accidently extension of the tray 120 without a latch 152. In some embodiments, the tracks 106 are spring biased to assist in the extension of the tray 120. This same effect could be achieved by angling the tracks 106 such that gravity pulls the tray 120 out when the latch 152 is disengaged. In other alternative embodiments, the swivel bearing 140 is operably coupled to the support arms 110 or the tracks 106 such that moving the tray 120 relative to the support arms 110 causes the tray 120 to begin rotating. In application where there are objects adjacent to the merchandiser 100 on either side, the swivel bearing 140 can be operably coupled to the support arms 110 or tracks 106 such that rotation is initiated only when the tracks 106 are fully or nearly fully extended.

FIG. 2 illustrates an alternative embodiment of a merchandiser 200. Elements of the merchandiser 200 that correspond to elements of the merchandiser 100 above contain the same last 2 digits of reference number. The elements are assumed to function the same except for the differences explicitly stated herein or shown in the figures. The merchandiser 200 is a solid walled design and is grid 202 mounted. The dividers 224 and back wall 225 are composed of a rigid plastic. In some embodiments, the back wall 225 includes product indicia or product labels 226. The product labels 226 notify the stocker what product 230 belongs in each product channel 222. The product labels 226 can further include a code capable of being scanned, such as a bar code, that the stocker or associate can scan with a portable computing device to keep track of the amount of inventory being stocked. In other forms, the labels 226 may include pictures or illustrations, such as of the product 230 to be inserted into that product channel 222 or other information such as how it should be inserted. In alternative embodiments, the back labels 226 could be incorporated into the wire walled design shown in FIGS. 1A-1F.

In alternative embodiments, the tray 120 further comprises a product sensor or low product indicator. The low product indicator outputs a signal when one or more product channels 122 are low on products. The low product indicator can be mechanical, electrical, or electro-mechanical. An example mechanical low product indicator comprises a flag operably coupled to the pusher, such that when the pusher passes a certain position in the product channel the flag is raised or another visual indicator becomes visible. An associate can then easily look down an entire aisle of product displays and scan for any of the small low product indicators.

Figure 5:
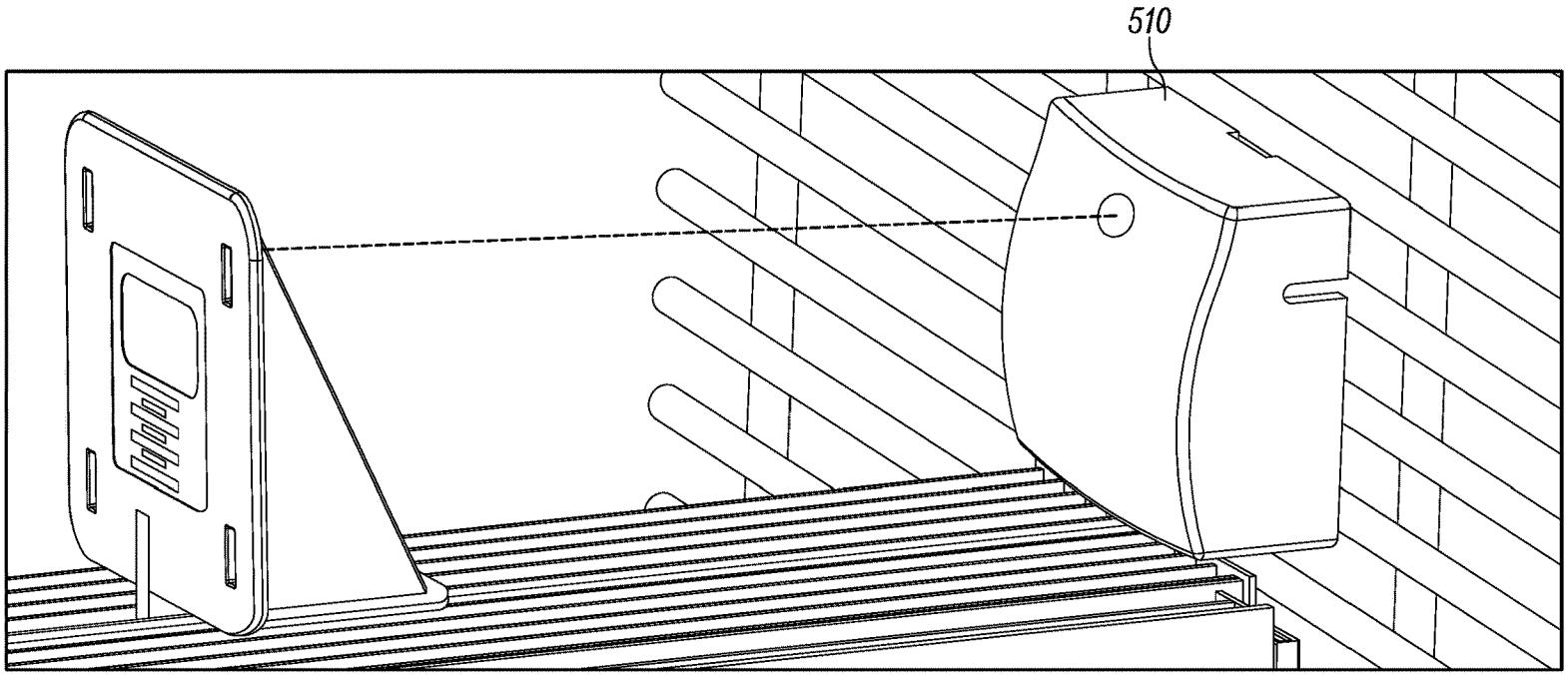
FIG. 5 is a product display sensor that may be utilized with a rotatable merchandiser such as that disclosed herein.

FIG. 5 illustrates and example of an electrical product sensor. The product sensor 510 shown in FIG. 5 is a string potentiometer, however many other types of sensors are considered herein. The product sensor 510 a signal to a computer system which indicates the location of the pusher, and thus the number of products remaining. Alternative electrical product sensors utilize ultrasonic sensors, optical pair sensors, capacitance sensors, or resistance sensors. A description of electrical product sensors can be found in U.S. application Ser. No. 15/409,396, "Sensors, Devices, Adapters and Mating Structures for Merchandisers and Related Methods" filed Jan. 18, 2017 which is fully incorporated by reference herein. An example of a mechanical low product indicator can be found in U.S. Provisional application Ser. No. 15/409,139, filed Jan. 18, 2017, and entitled "Low Product Indicator for Self Facing Merchandiser and Related Methods," which is incorporated herein in its entirety.

In addition to indicating when a merchandiser 100 or product channel 122 needs restocked, the electrical product sensors can be used to track the amount of product being sold for use in retail science. Example uses of this data include tracking store inventory, comparing the efficacy of different merchandiser types and locations, and tracking the expiration dates of products. The sensor can also be used for diagnostics, for example if one merchandiser remains full while adjacent ones holding the same product become low it could indicate that the merchandiser reading as full is damaged or jammed in some way.

In the baseless tray embodiments discussed above, the support plate 108 is removed. The merchandiser then comprises a moveable mount connected to a retail store display or shelving unit (e.g., the grid 202). The mount is moveable between a first mount position wherein the mount is retracted toward the retail store display and a second mount position wherein the mount is extended from the retail store display by sliding along the tracks 106. The tray is rotatably attached to the mount by the swivel bearing. As in the above embodiments, the tray has a first side for displaying product, and a second side for restocking the displayed product. The tray can be rotated between at least a first tray position wherein the first side of the tray is facing out from the retail store display displaying product for selection by a consumer, and a second tray position wherein the second side of the tray is facing out from the retail store display exposing the second side of the tray for restocking the displayed product.

In some embodiments, the merchandiser 100 includes an anti-toppling mechanism to prevent the products in the tray 120 from falling over within the product channels 122. The anti-toppling device can take many forms including one or more structures that extend downward from a first merchandiser 100 into the area between the product channels 122 of a second merchandiser 100 located below the first. Other forms include a structure attached to any other part of the merchandiser 100, or the support structure the merchandiser 100 is attached to, which extends into the space between or surrounding the merchandiser channels 122 to prevent products therein from tipping.

In some embodiments, the height of the merchandiser 100 can be set based on the application. For example, a merchandiser 100 intended to display organic products can be set at substantially the same height as a standard organic waste receptacle in order to aid in cleaning (e.g., set to prep table height just as the receptacle is). Another example would be to set the height of a merchandiser 100 intended to display heavy products at substantially the same height as a cart or dolly so that the products can be slid from the cart or dolly onto the tray 120 without requiring lifting.

In some embodiments, the swivel bearing 140 and the tracks 106 are operably coupled such that the tracks 106 are locked from being retracted unless the tray 120 is in the display orientation. This lock prevents the tray 120 from being inserted into the shelving system while backwards, which would cause the self-facing mechanism to move products away from prospective customers. The lock could also serve to prevent the tray 120 from being inserted when slightly out of alignment. When rotated by even a small amount (e.g., askew), a square tray has a wider footprint than it does when aligned. Thus, inserting a tray 120 that is not perfectly aligned could result in the tray 120 colliding with adjacent structure, (e.g., such as a second tray 120, the shelving unit, etc.), and damaging either the tray 120 or the structure. The lock can take many forms, including but not limited to a pin operably coupled to the tray 120 that is moved so as to block the path of the tracks when the tray 120 is rotated. For example, in one form, the pin may be forced down into a mating recess in one or more of the rail slides to prevent the slides from being moveable with respect to one another or from at least fully retracting when the tray is rotated, and then may retract from the mating recess when the train is placed back in its display position or orientation. Thus, the rotational movement of the tray 120 results in a corresponding movement of a lock or locking mechanism between a first position wherein the lock is in a first, released position that allows the rail slides to move between extended and retracted positions, and a second, locked or secured position that prohibits the rail slides from moving between the extended and retracted position. In a preferred form, the lock will prevent movement of the rail slides entirely when the lock is in the second position. Alternatively, the lock could be a structure having a substantially linear shape that is operably coupled to rotate when the tray 120 rotates. When the lock is aligned with a slot, the tracks 106 are free to retract, and when it is not then the tracks 106 are locked.

Figure 6A:
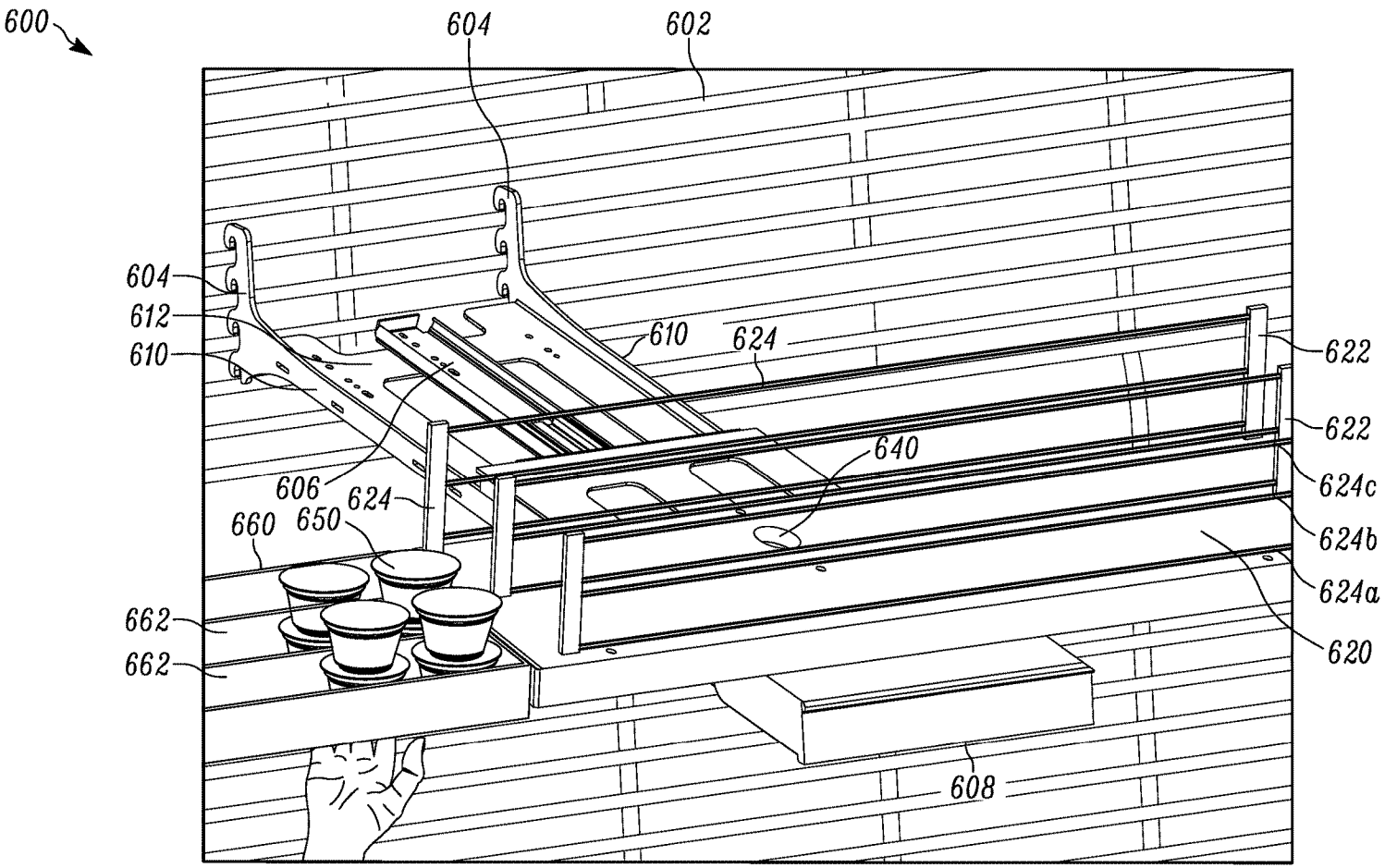
FIG. 6A is a perspective view taken from above of a ninety degree (90°) rotating product display merchandiser in accordance with some embodiments of the present invention with a loading tray for packaging, transporting and/or loading product more efficiently, illustrating the product before loading onto the merchandiser.
Figure 6B:
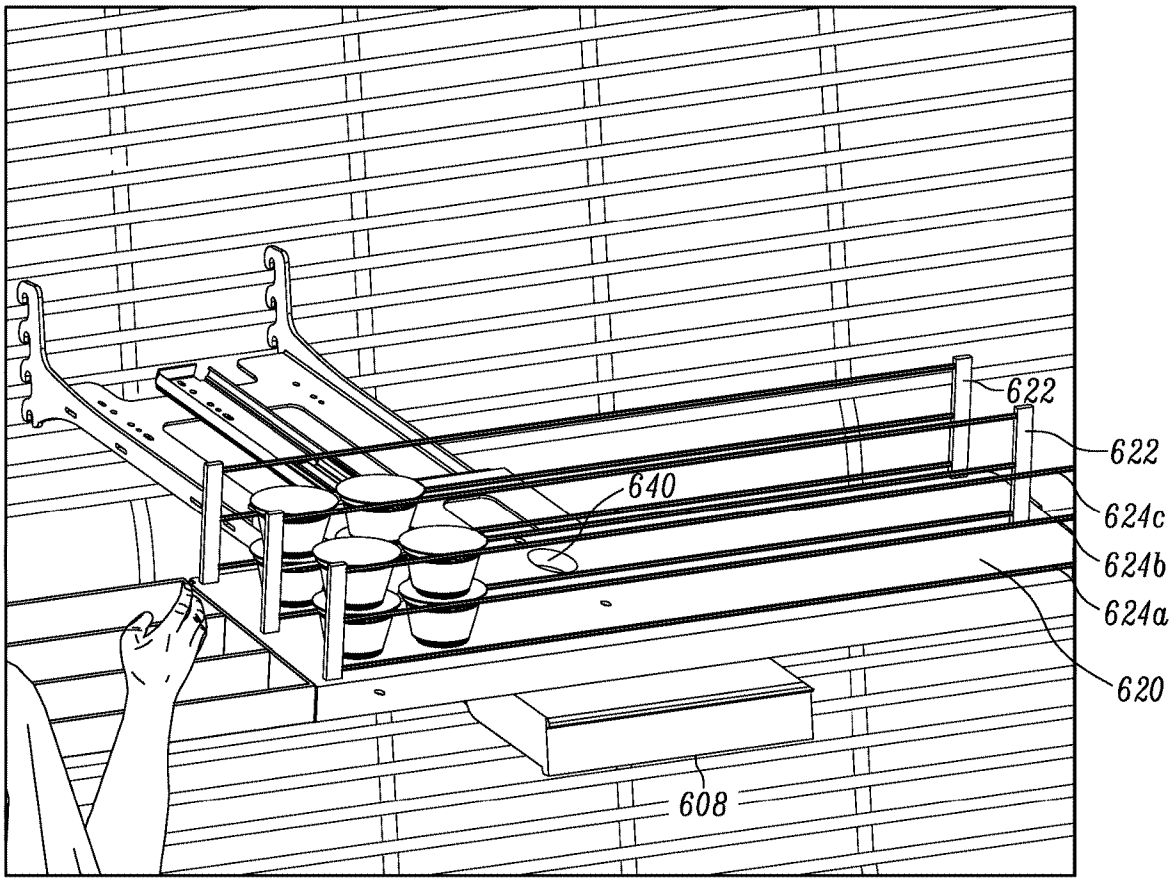
FIG. 6B is a perspective view taken from above of the rotating product display merchandiser of FIG. 6A illustrating the product after loading onto the merchandiser.
Figure 6C:
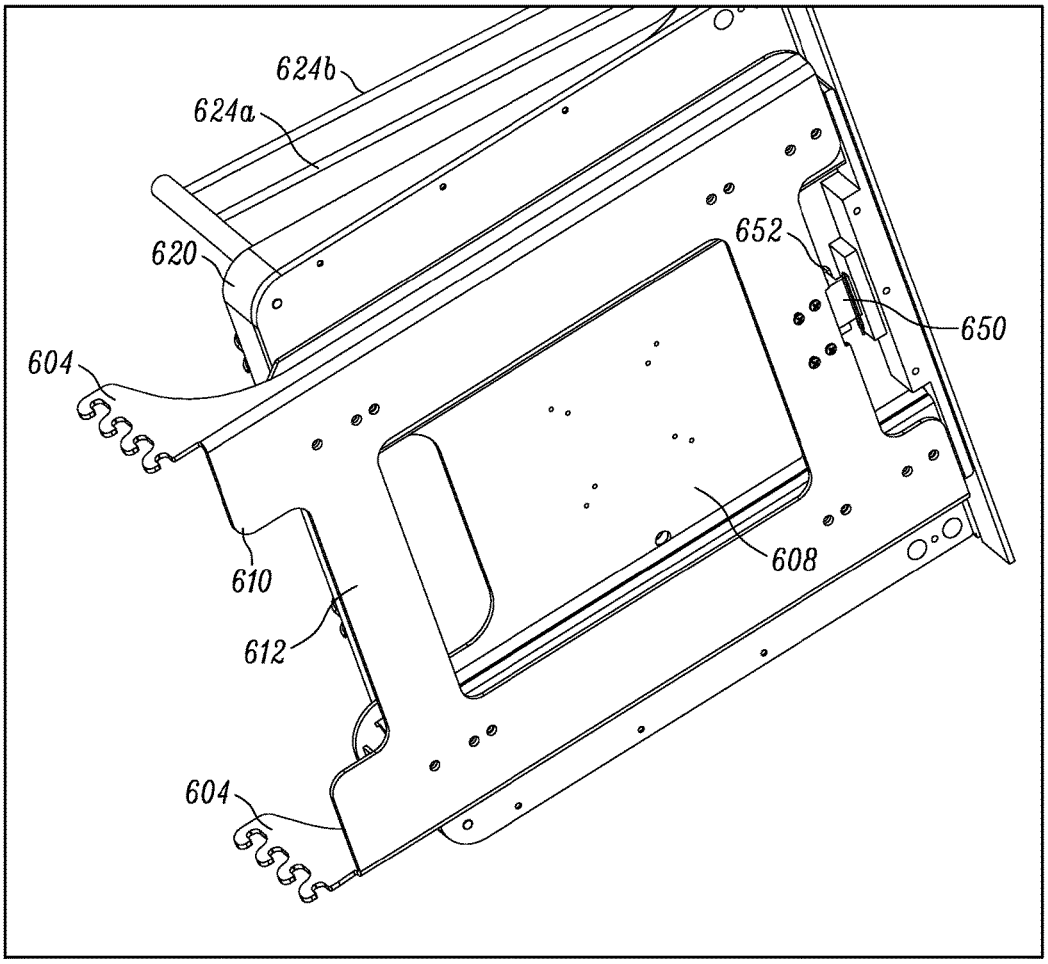
FIG. 6C is a perspective view taken from below of the rotating side loading product display merchandiser of FIGS. 6A-6B in a retracted state.

FIGS. 6A-6C illustrate an exemplary embodiment of a product display merchandiser 600. The product display merchandiser 600 includes a tray 620 for holding a product to be displayed. The tray 620 is supported by a rotatable hub or bearing 640 such as a lazy Susan bearing or swivel bearing, which in turn is supported by the support plate 608. The size of the support plate 608 only needs to be large enough to support the bearing 640 and in a preferred form will be integrated into a front stabilizer for the tracks or drawer/tray rail slide(s) 606 so that the merchandiser can be built as a baseless tray platform, if desired. The swivel bearing 640 as shown rotates around a substantially vertical axis. In alternative embodiments, the axis of rotation of the swivel bearing 640 can be angled toward the front of the tray 620 in order to lower the back of the tray 620 when the tray 620 rotated to aid in stocking.

In a preferred form, however, the bearing 640 will not be angled so that the angle of the tray does not move when rotated from the regular product merchandising position to a restocking position. In this way, if a gravity feed merchandiser configuration is used, the tray remains in a gravity feed orientation even during restocking. In the embodiment shown, the rail or track 606 allows the tray to be fully extended from the support 608, thus, allowing the tray to easily clear the surrounding display structures to allow for rotation of the tray to at least a ninety degree (90°) rotation, which simplifies restocking and allows the tray to remain in the gravity feed orientation due to the ample clearance that is provided for the tray and product remaining therein. In conventional merchandisers, this is not possible due to the rotation of the tray typically interfering with the surrounding display environment. Typically, any product remaining in the rear of the tray would get crushed against neighboring display merchandisers (e.g., crushed against the bottom of merchandisers located above, crushed against the side of merchandisers located to the side, etc.).

The support plate 608 is slidably mounted on a support or base by slides or tracks 606, being slidable between many positions including a first or retracted position and a second or extended position. In the embodiment shown, the support or base comprises support arms 610 with an opening extending between a majority of the arms 610 (often referred to as a baseless tray configuration). In alternative embodiments, the support arms 610 are replaced with a solid base and, in some cases, this solid base may also serve as a baffle to direct airflow from a rear of the merchandiser to a front of the merchandiser to help equally or generally evenly distribute cold air in open-air refrigeration units or coolers, such as air curtain units. In alternative embodiments, the support plate 608 may be slidably mounted directly onto the support arms 610. As mentioned above, in another form the merchandiser 600 may be constructed in a baseless tray platform where the tray 620 extends directly from the support arms 610 or attachment means/mounting member 604. In such a configuration, the merchandiser 600 may further include a rear stabilizer connecting the rear of the support arms 610 to stabilize same as disclosed in U.S. Provisional Application Nos. 62/195,487 filed Jul. 23, 2015 and 62/247,744 filed Oct. 28, 2015 which are hereby incorporated above herein by reference in their entirety.

FIG. 6A illustrates the merchandiser 600 in an extended state, with the tray 620 slid out along the rail(s) or track(s) 606. FIG. 6C illustrates the merchandiser 600 in a retracted state, with the tray 620 slid in along the rail(s) or track(s) 606. The track(s) 606 can be one or more drawer slides or bearing slides. In some embodiments, the track(s) 606 are also dampened at one or both ends, or along their entire length, to prevent the merchandiser 600 and/or the products from being damaged from being extended or retracted too quickly. In some embodiments, the support arms 610 includes cross braces 612 for added stability. The support arms 610 are supported by an attachment to a support structure by an attachment means, such as support or mounting member 604. In the embodiment shown, the attachment means or mounting member 604 is one or more hooks configured to slide over the cross members of a wire grid, such as the wire grid 602 shown (often referred to as a grid mount). In alternative embodiments, the attachment means 604 is configured to attach to a bar (referred to as a bar mount). In FIG. 3, the grid mount attachment means 104A is contrasted with a bar mount attachment means 104B. In other alternative embodiments, the support arms 610 are configured to be supported by a shelf by attaching the rail(s) or track(s) 606 directly to the top surface of a shelf. In some forms, this may mean that no support arms 610 are used, but rather just the rail(s) or track(s) 606 are used and serve as the support or structure along which the support 608 and tray 620 move. Example systems to slidably mount a merchandiser tray to a base can be seen in U.S. Provisional Application 62/247,744, "Merchandiser and Methods Relating to Same" assigned to DCI Marketing, Inc. which is fully incorporated by reference above herein.

The tray 620 has a plurality of product channels 622. The product channels 622 are defined by or separated by channel/product guides, wings or dividers 624 and may include an insert at the base that assists in movement of the product contained in the product channels 622 (e.g., silicon impregnated polymers). The dividers 624 can be made of a wide variety of materials and shapes, including metal wire as shown or solid plastic. Other shapes may include thin bars, flat bars, sloped plates, fins, wings, or the like and these may be made of rigid or flexible materials. In some forms, the dividers 624 may also be removable or adjustable such that the width of the product channels 622 can be adjusted to correspond to the product to be displayed. Each product channel 622 is configured to hold a row of products. In some embodiments with wire dividers 624, the left outside divider 624 is offset from the right outside divider 624. This offset prevents the dividers 624 on adjacent merchandisers 600 from becoming entangled. Examples of adjustable dividers 624 and offset dividers 624 can be seen in U.S. Pat. No. 7,681,744 "Merchandising System" which is assigned to DCI Marketing, Inc. and is fully incorporated by reference herein.

In some embodiments, the dividers 624 include a plurality of vertically spaced, parallel guides 624*a-c*. As mentioned, the guides can be thin bars, flat bars, sloped plates, fins, or other rigid or flexible structures. In applications in which the products 650 are stacked, as shown herein, at least one of the guides 624*a-c* is at the same height as a portion of the products 650 in each layer. For example, guide 624*a* is vertically positioned somewhere between the bottom and the top of the lowest layer of products 650 so as to prevent products 650 in the lowest layer from sliding of the tray 620 to the side. Similarly, guide 624*b* is vertically positioned somewhere between the bottom and the top of the second lowest layer of products 650 so as to prevent products 650 in the second lowest layer from falling out of the side of the tray or sliding off the tray 620 to the side.

In some embodiments, the product display merchandiser 600 includes a means of biasing the products 650 towards the front of the tray 620. The biasing means can take many forms. In some embodiments, the tray 620 is sloped such that the front is lower than the rear, this allows gravity to bias the products 650 towards the front. In other embodiments, a spring biased pusher is used to push the products 650 forward. An exemplary spring biased pusher 600 is shown in FIG. 4. A single spring biased pusher 400 can be mounted in the floor of each product channel 622 and extend upward vertically therefrom in order to push products in that channel 622 forward. Alternatively, one or more pushers may be suspended from the divider and extend sideways horizontally therefrom in order to push products in the channel 622 forward. In both cases, one end of the spring coil is connected at the front of the merchandiser (e.g., at the front of the product channel base or front of the divider), with the remaining coil being positioned behind or within the pusher to drive the pusher toward the front of the merchandiser or product channel. For example, in some embodiments, the divider 624 dividing two product channels 622 is replaced with a solid wall. Pushers 600 may be mounted on one or both sides of the wall divider. Multiple pushers 600 can be spaced vertically along the wall so as to each push a different layer of stacked products 650. Alternatively, and as illustrated in FIG. 9, one or more pushers or rakes 972 are operably coupled to a pull tab 970 located at the front of the tray 620, an associate can pull on the tab resulting in the pusher being forced towards the front of the tray 620. In a gravity fed system, a pusher can simply be weighted so that it pushes the products forward as a result of gravity. This can be necessary with light products that cannot overcome the static friction with the product channels 622 under just their own weight. In some embodiments of each of the above described pusher assemblies, the pusher includes a damper to prevent it from applying enough force to damage the products. The damper also prevents the pusher from becoming damaged if it is accelerated over a long distance. In some embodiments, the pusher is integrated into a track in the floor of the pusher channel 622.

In some embodiments, the pushers may be mounted to a structure that is not slidable relative to the support arms 610. When the tray 620 is slid out, the pushers remain in place such that the tray 620 slides past the pushers. The tray 620 can then be rotated and loaded with products 650 without interference from the pushers. In an alternative embodiment, the pushers fold flat with one of the dividers 624 or the bottom of the channels 622 for loading (e.g., a hinged pusher). This allows products 650 to be loaded behind the pushers and then freely slid past the pushers before the hinged pusher returns to its product pushing orientation. The pusher may also include a rotatable portion that allows the height and/or width of the pusher to be increased by rotating a rotatable member out from the remainder of the pusher to either increase its width (e.g., for pushing wider product or multiple products with one pusher) or height (e.g., for pushing taller product or stacked product).

As mentioned briefly above, in some embodiments, the floor of the product channels 622 are configured to minimize friction between the product channel 622 and the product 650. The floor of the product channels 622 may comprise one or more raised beads to minimize the area of contact. The raised beads can be made of a material with a low coefficient of friction, such as nylon or other polymers (e.g., silicone impregnated polymers). The number of beads can vary depending on the product, the slope of the product channel 622, and the material used to make the bead in order to fine tune the friction. One bead or several bead systems are both viable. Additionally, the shape of the beads can be changed to affect the friction between the beads and the products. Instead of straight beads, some embodiments have wavy or zig-zag shaped beads (e.g., beads at one end or over the entire surface following a tortious path to dampen product movement). In alternative embodiments, the characteristics of the beads can vary along the length of the product channel 622. A higher friction bead may be preferable near the front end of the product channel 622 in order to dampen products. In alternative embodiments, the product channels 622 have rollers to aid in allowing the products to slide forward. For smaller products, the rollers are offset relative to each other to prevent the products from dipping. In still other embodiments, the product channels 622 have a floor comprising a smooth, flat surface. In this embodiment, the front of the product channel 622 can comprise a rougher surface to dampen the movement of the products. In some embodiments, the beads 623 rollers, and/or smooth and rough surface are integrated in inserts that can be easily added or removed from the product channels 622. The inserts can be made of any of a variety of materials, including silicon impregnated polymer. The use of inserts has the added benefit of aiding in the cleaning of the merchandiser 600. This also allows the product channels 622 to quickly be modified correlating to the product.

In some embodiments, the product display merchandiser may include a price channel. The price channel is configured to hold price tags for the products. In some embodiments, the price channel includes a protective lens overtop of the price tags. In some embodiments, the price channel is a dual channel such that it can have a tag with words and or pictures to illustrate the product or product information (e.g., price) to the customer in a first channel, and a product number or scannable code in the second channel for use by store associates. In alternative embodiments, the price channel can be reduced in size to reduce the overall height of the tray 620 such that a larger percentage of the space can be used for products and/or so that the display maintains a low profile so that maximum vertical products can be achieved on the store's shelving unit.

FIG. 6A illustrates the product display merchandiser 600 with the tray 620 rotated 90 degrees. In operation, the tray 620 is pulled out along the tracks 606, and then rotated on the swivel bearing 640 so that the stocker has access to the back of the product channels 622. In some embodiments, there is a stop that restricts the rotation of the tray 620 at 0 degrees so that it is properly aligned before being pushed back in. In other embodiments, the stop or a second stop restricts rotation of the tray 620 at a loading orientation to conveniently stop it in the correct position for loading. In some embodiments, the loading orientation can be any angle sufficient to enable the stocker to access the back of the tray 620. In a preferred embodiment, the loading orientation is less than 180 degrees. In a more preferred embodiment, the loading orientation is 90 degrees. In some embodiments, there is a stop located at 90 degrees of rotation in either direction. In alternative embodiments, additional stops can be added at different angles or intervals, such as for example at every 90 degrees, every 45 degrees, or every 30 degrees or as desired. The stops can be passive, meaning they are designed to be overcome with sufficient force exerted by the stocker or store associate. In the preferred embodiment, the stop consists of a spring biased ball in one of the tray 620 or the support plate 608 and corresponding detents in the other of the tray 620 and the support plate 608. When the ball is aligned with a detent, the spring pushes the ball into the detent which stops the rotation of the tray. Because of the curved surface of the ball, exerting torque to rotate the tray 620 will force the ball back up and allow the tray 620 to continue rotating. Alternatively, the tray 620 can have an active latch that needs to be released. For example, this could comprise a spring biased cylinder or rectangular prism shaped bolt and corresponding recesses or openings. When the bolt is aligned with the recess or opening the spring forces the bolt in the recess or opening which prevents further rotation. The stocker would have to pull the bolt out of the recess or opening in order to rotate the tray 620 again. Other forms of active locks could be used (e.g., latches, pull knobs, push buttons, actuators, etc.)

The tray 620 may include a grip portion or grip point which an associate can pull on to exert torque onto the tray 620, causing it to rotate on the swivel bearing. The grip point can be placed on one side or the other in order to encourage rotation in a certain direction. Some other indication can also be added to specify direction of travel if desired and/or the merchandiser 600 can be configured to only allow rotation in a desired direction if desired. The grip point can be configured to be prominent, such that a new associate notices it and thus knows to rotate the tray 620. Alternatively, the grip point can be hidden in order to prevent customers from rotating the tray 620. In some embodiments, the rotation of the tray 620 exerts centripetal force on the products which pushes them towards the front of the tray 620. Thus, a centrifugal force front facing merchandiser is disclosed herein.

As mentioned above, in some gravity fed embodiments, the swivel bearing 640 is at an angle relative to the support arms 610 such that rotation of the tray 620 lowers the back side of the tray 620. This results in the product channels 622 being substantially level when the tray 620 is at the 90 degree loading position. Lowering of the back in this way both provides easier access to the tray 620, especially if there is a structure above the tray 620 such as a second tray 620. Leveling the tray 620 also prevents products from accelerating from gravity down the entire length of a product channel 622, which may result in the product having enough momentum to pass through the stoppers, and/or may cause damage to the product or the merchandiser 600.

In alternative embodiments, the rotation of the tray 620 relative to the support plate 608 is dampened to prevent the tray 620 from being rotated too quickly. In some embodiments, the rotation of the tray 620 is dampened for the entire rotation. In other embodiments, the rotation of the tray 620 is only dampened for a short arc around each of the stops to slow the tray 620 down enough for the stop to engage.

In some embodiments, the rotation of the tray 620 is biased to assist in use. A spring can be used to bias rotation in one direction or the other. Alternatively, counteracting springs can be used to assist both in rotating from 0 degrees to 90 degrees and then from 90 degrees back to 0 degrees.

FIGS. 6A-6B illustrate the tray 620 rotated 90 degrees (or in a loading orientation). In this orientation a product chute, loader or case 660 can be positioned at the back of the tray 620 for loading. In some embodiments, as shown, the case 660 includes product channels 662 that correspond to product channels 622 of the tray 620. In alternative embodiments, the case 660 merely has products 650 arranged in rows corresponding to the product channels 622 but all in the same channel. As shown in FIG. 6B, the products 650 can be pushed off of the case 660 and onto the tray 620. In some embodiments, the rear of the case 660 may be lifted so that the products 660 slide onto the tray 620 as a result of gravity.

In some embodiments, the case 660 is configured to detachably couple to or be supported by the tray 620. For example, one or more projections from the case 660 may be configured to rest in one or more product channels 622 of the tray 620. This helps align the case 660 with the tray 620 for stocking and helps support the case 660 so that the stocker can use one hand to push the products 650 onto the tray 620. In some forms, case 660 may also be configured with a biasing mechanism, such as a spring biased pusher like the types mentioned above, for assisting the stocker or associate in transferring product from the case 660 to the tray 620.

In a preferred form, case 660 may simply be used as a loading device to preload product from its original case packaging to take the product out to a sales floor and load the merchandiser there. In other forms, however, the case 660 may be the product packaging that the product gets shipped in from the product supplier. For example, a product manufacturer may use a product handling or packaging machine to directly load case 660 and ship the product in case 660 to eliminate the step of having an stocker or associate transfer product from its original packaging or case to case 660 and then taking case 660 out on the sales floor to stock or restock merchandiser 600. Such a setup would make for more efficient methods and apparatus for packaging, transporting and/or loading cases of product.

FIG. 6C illustrates the bottom side of the merchandiser 600 described above. FIG. 6C shows the merchandiser 600 in a retracted state with the tray 622 at 0 degrees (or in a display orientation). The support plate 608 has a latch 650. The support arms 610 have a lip 652. As seen in FIG. 6D, when the tray 620 is retracted, the latch 650 engages the lip 652 to prevent the tray 620 from being extended along the tracks 606. In order to pull out the tray 620, the stocker disengages the latch 650 from the lip 652. Many different types of latches 650 can be used with the merchandiser 600 in order to achieve this function. This includes both active latches, as shown, and passive latches like the ball and detent setup described above. In still other forms, no latch is included but rather the tray 620 or a portion thereof is lifted to release it from the support plate 608 or support arms 610 allowing the tray 620 to be pulled out and/or rotated.

In alternative embodiments, the tracks 606 are designed such that movement is dampened such that a larger amount of initial force is needed to start pulling out the tray 620, this would prevent accidently extension of the tray 620 without a latch 652. In some embodiments, the tracks 606 are spring biased to assist in the extension of the tray 620. This same effect could be achieved by angling the tracks 606 such that gravity pulls the tray 620 out when the latch 652 is disengaged. In other alternative embodiments, the swivel bearing 640 is operably coupled to the support arms 610 or the tracks 606 such that moving the tray 620 relative to the support arms 610 causes the tray 620 to begin rotating. In application where there are objects adjacent to the merchandiser 600 on either side, the swivel bearing 640 can be operably coupled to the support arms 610 or tracks 606 such that rotation is initiated only when the tracks 606 are fully or nearly fully extended.

In some embodiments, the merchandiser 600 includes an anti-toppling mechanism to prevent the products in the tray 620 from falling over within the product channels 622. The anti-toppling device can take many forms including one or more structures that extend downward from a first merchandiser 600 into the area between the product channels 622 of a second merchandiser 600 located below the first. Other forms include a structure attached to any other part of the merchandiser 600, or the support structure the merchandiser 600 is attached to, which extends into the space between or surrounding the merchandiser channels 622 to prevent products therein from tipping, such as an inverted L-shaped structure that extends over the top of the products stored within the product channels 622

In some embodiments, the height of the merchandiser 600 can be set based on the application. For example, a merchandiser 600 intended to display organic products can be set at substantially the same height as a standard organic waste receptacle in order to aid in cleaning (e.g., set to prep table height just as the receptacle is). Another example would be to set the height of a merchandiser 600 intended to display heavy products at substantially the same height as a cart or dolly so that the case 660 can be supported by a cart or dolly allowing products 650 to be slid from the case 660 onto the tray 620 without requiring lifting.

In some embodiments, the swivel bearing 640 and the tracks 606 are operably coupled such that the tracks 606 are locked from being retracted unless the tray 620 is in the display orientation. This lock prevents the tray 620 from being inserted into the shelving system while backwards, which would cause the self-facing mechanism to move products away from prospective customers. The lock could also serve to prevent the tray 620 from being inserted when slightly out of alignment. When rotated by even a small amount (e.g., askew), a square or rectangular tray has a wider footprint than it does when aligned. Thus, inserting a tray 620 that is not perfectly aligned could result in the tray 620 colliding with adjacent structure, (e.g., such as a second tray 620, the shelving unit, etc.), and damaging either the tray 620 or the structure. The lock can take many forms, including but not limited to a pin operably coupled to the tray 620 that is moved so as to block the path of the tracks when the tray 620 is rotated. For example, in one form, the pin may be forced down into a mating recess in one or more of the rail slides to prevent the slides from being moveable with respect to one another or from at least fully retracting when the tray is rotated, and then may retract from the mating recess when the train is placed back in its display position or orientation. Thus, the rotational movement of the tray 620 results in a corresponding movement of a lock or locking mechanism between a first position wherein the lock is in a first, released position that allows the rail slides to move between extended and retracted positions, and a second, locked or secured position that prohibits the rail slides from moving between the extended and retracted position. In a preferred form, the lock will prevent movement of the rail slides entirely when the lock is in the second position. Alternatively, the lock could be a structure having a substantially linear shape that is operably coupled to rotate when the tray 620 rotates. When the lock is aligned with a slot, the tracks 606 are free to retract, and when it is not then the tracks 606 are locked.

In alternative embodiments, the tray 620 further comprises a product sensor or low product indicator, as described in previous embodiments. The low product indicator outputs a signal when one or more product channels 622 are low on products. The low product indicator can be mechanical, electrical, or electro-mechanical. An example mechanical low product indicator comprises a flag operably coupled to the pusher, such that when the pusher passes a certain position in the product channel the flag is raised or another visual indicator becomes visible. An associate can then easily look down an entire aisle of product displays and scan for any of the small low product indicators.

In addition to indicating when a merchandiser 600 or product channel 622 needs restocked, the electrical product sensors can be used to track the amount of product being sold for use in retail science. Example uses of this data include tracking store inventory, comparing the efficacy of different merchandiser types and locations, and tracking the expiration dates of products. The sensor can also be used for diagnostics, for example if one merchandiser remains full while adjacent ones holding the same product become low it could indicate that the merchandiser reading as full is damaged or jammed in some way.

In the baseless tray embodiments discussed above, the support plate 608 is removed. The merchandiser then comprises a moveable mount connected to a retail store display or shelving unit (e.g., the grid 602). The mount is moveable between a first mount position wherein the mount is retracted toward the retail store display and a second mount position wherein the mount is extended from the retail store display by sliding along the tracks 606. The tray is rotatably attached to the mount by the swivel bearing. As in the above embodiments, the tray has a first side for displaying product, and a second side for restocking the displayed product. The tray can be rotated between at least a first tray position wherein the first side of the tray is facing out from the retail store display displaying product for selection by a consumer, and a second tray position wherein the second side of the tray is facing out from the retail store display exposing the second side of the tray for restocking the displayed product.

Figure 7A:
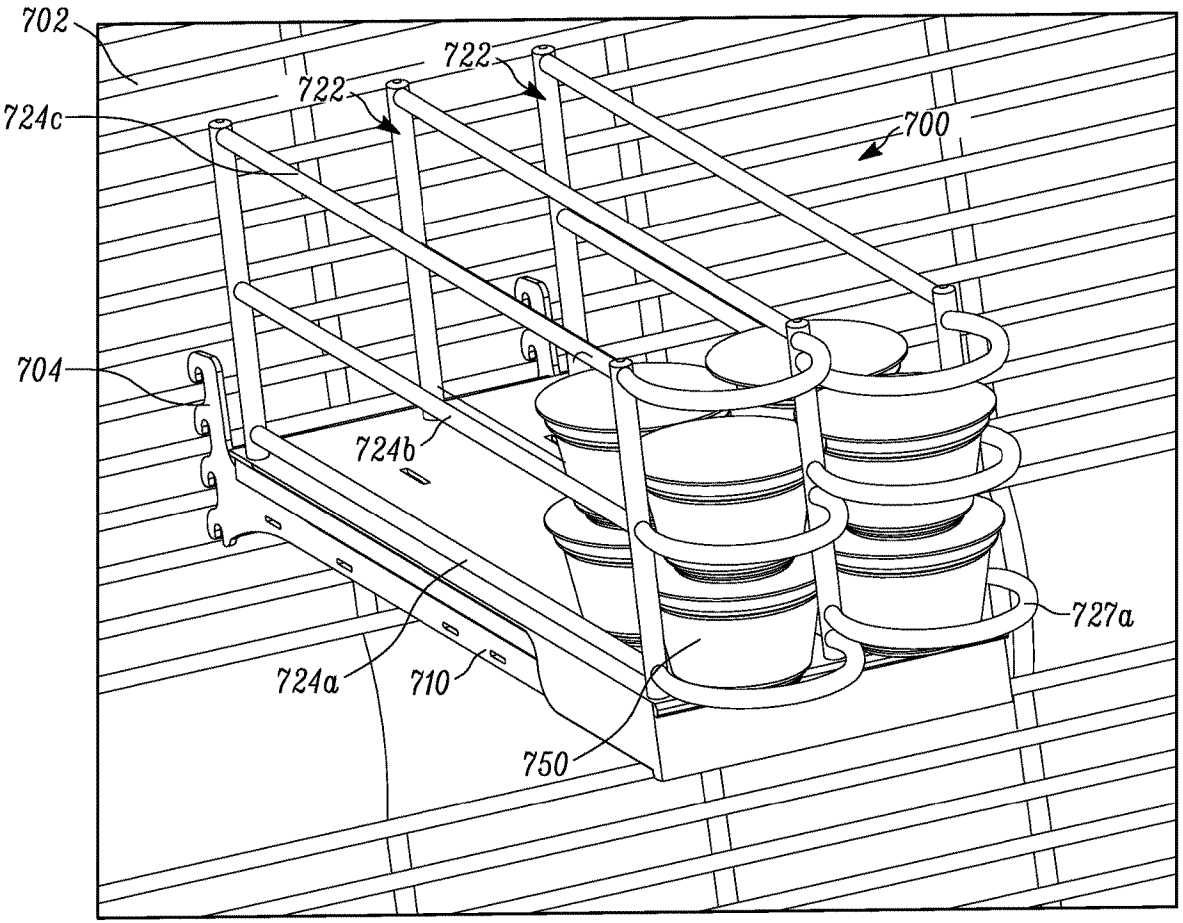
FIG. 7A-7G illustrate a side loading product display merchandiser in accordance with some embodiments of the present invention.
Figure 7B:
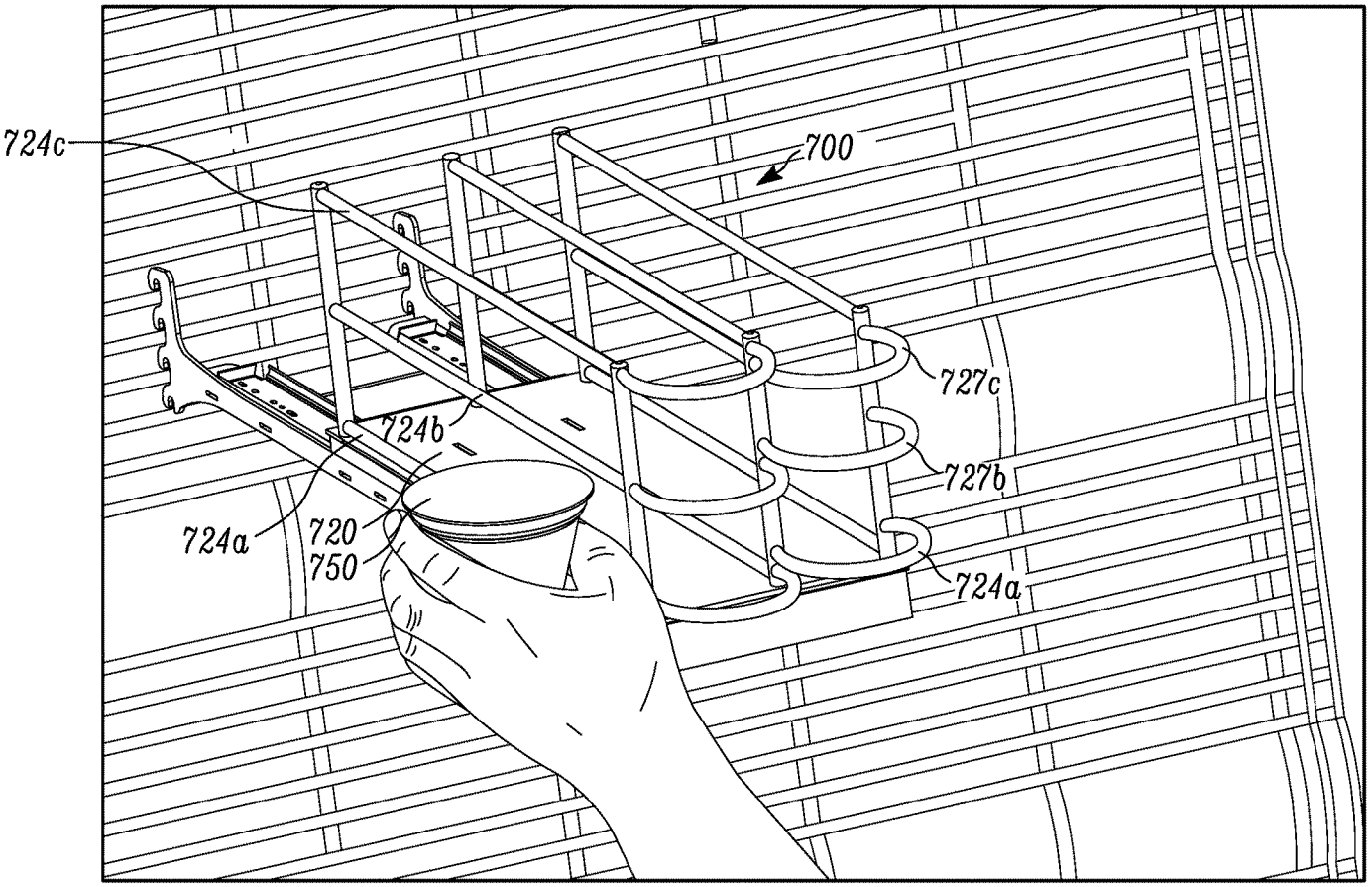
Figure 7C:
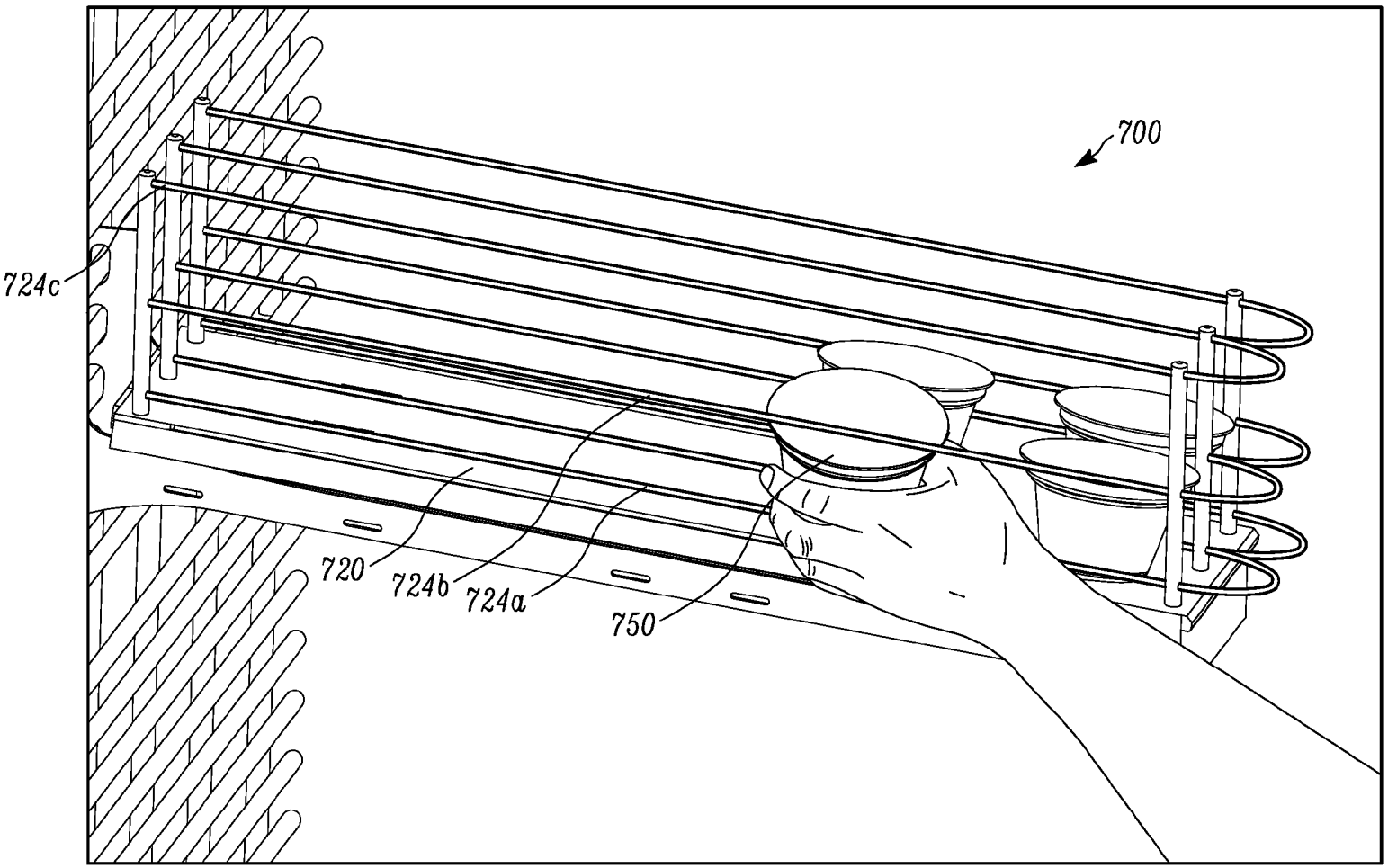
Figure 7D:
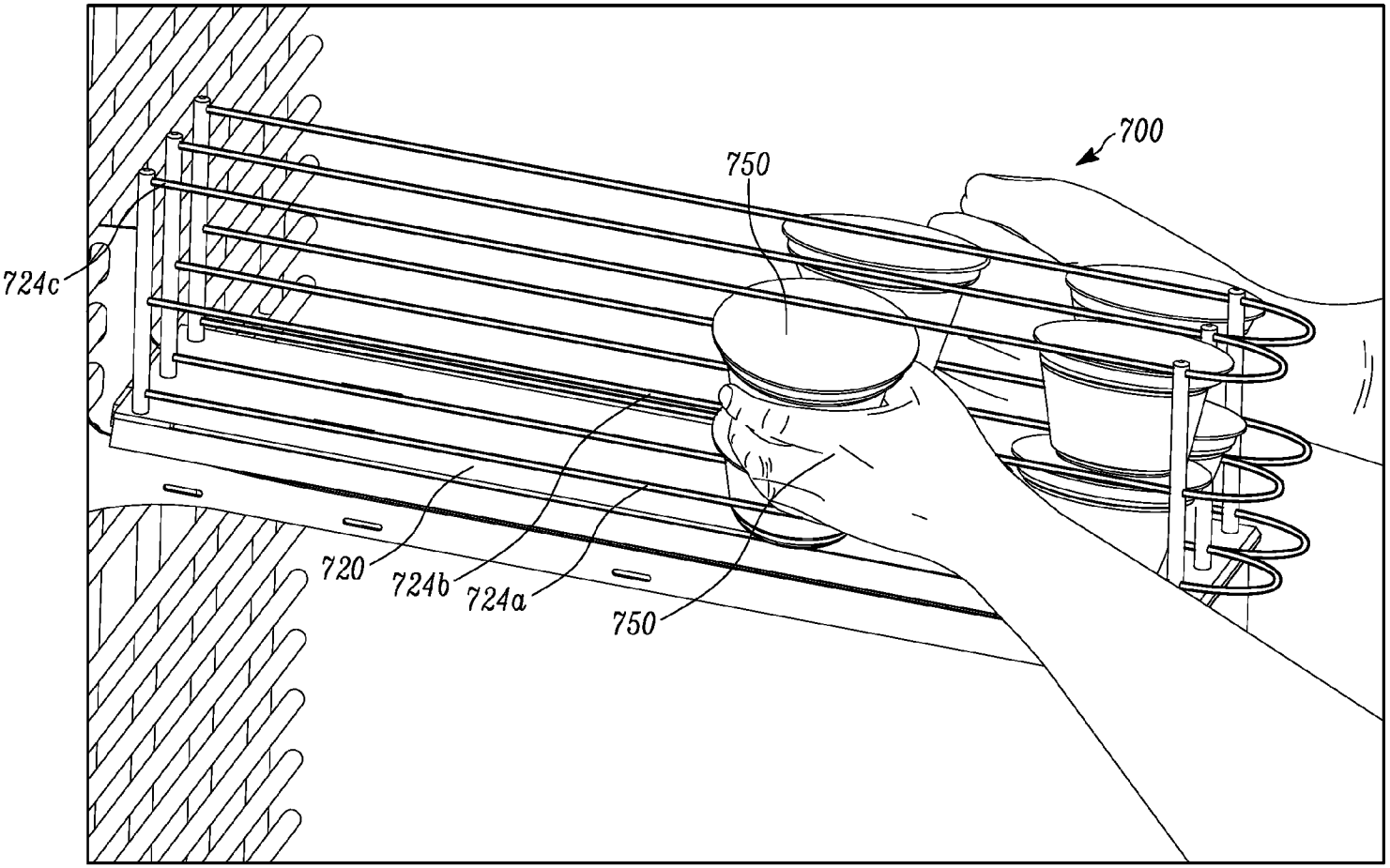

FIGS. 7A-7G illustrate an alternative embodiment of a merchandiser 700. Elements of the merchandiser 700 that correspond to elements of the merchandiser 600 above contain the same last 2 digits of the reference number. The elements are assumed to function the same except for the differences explicitly stated herein or shown in the figures (e.g., guides 724 are similar to guides 624). FIG. 7A illustrates the merchandiser 700 in a first retracted state. This state is intended for displaying the products. As with above embodiments, the merchandiser 700 extends, as shown in FIG. 7B, to allow for easier loading. The merchandiser 700 is a wire walled design and is grid 702 mounted. The dividers 724 comprise a plurality of vertically spaced guides 724*a-c* as above. Adjacent guides 724*a-c* of the merchandiser 700 are spaced apart by a distance at least equal to the height of the products 750 configured to be displayed therein. This spacing allows for the products 750 to be loaded in from the side by sliding the products 650 between two adjacent guides 724*a-c* as shown in FIG. 7C. The merchandiser 700 is configured to display a plurality of vertically stacked rows of product. As shown in FIG. 7D, once the bottom row is loaded in a second row can also be added though the sides in the gap between the vertically spaced guides 724*a-c*. The second row is positioned above the first row.

A stopper 727 is positioned at the front end of the merchandiser 700. The stopper 727 prevents products 750 from sliding off the front of the tray 720. In the embodiments shown, the stopper 727 comprises a plurality of vertically spaced wires 727*a*-727*c*. The wires 727*a-c* are in line with the guides 724*a-c*. In alternative embodiments, the stopper 727 comprises a gate. The gate can be attached to the tray 720 by a hinge or can simply be made of a deformable material. The gate prevents products 750 from exiting the front of the tray under the force of the biasing means, but allows products to be pulled out the front by sufficient force. In a preferred embodiment, the sufficient force is a force that can be imposed by an average adult with one hand without exerting themselves. In still further embodiments, the stopper 727 comprises a plurality of vertically spaced gates. Each gate corresponds to a layer of the stacked products. The stopper 727, or alternatives thereof, may be included in the merchandiser 600 above or 300 below.

In some embodiments, the merchandiser 700 does not include a swivel bearing. The tray 720 is not rotatable relative to the support arms 710. The tray 720 merely pulls out along the arms, as described above, and then may be loaded from the side through the dividers 724. The support plate 608 may also be removed, allowing the tray 720 to be supported directly by the tracks 706 or the support arms 710.

In some embodiments, the center divider 724 may be replaced with a solid wall. The merchandiser 700 may include any of the biasing means and/or the low product indicators described above. Similarly, the merchandiser 700 may include any of the alternative attachment means 704 described above. In still other forms, the merchandiser 700 may not even be a tray type merchandiser that has a tray or drawer slidable about a lower support surface, but rather is just a display positioned so that the product channels can be stocked/restocked from the side of the merchandiser (e.g., merchandisers with one or more sides exposed or accessible to an associate).

Figure 7E:
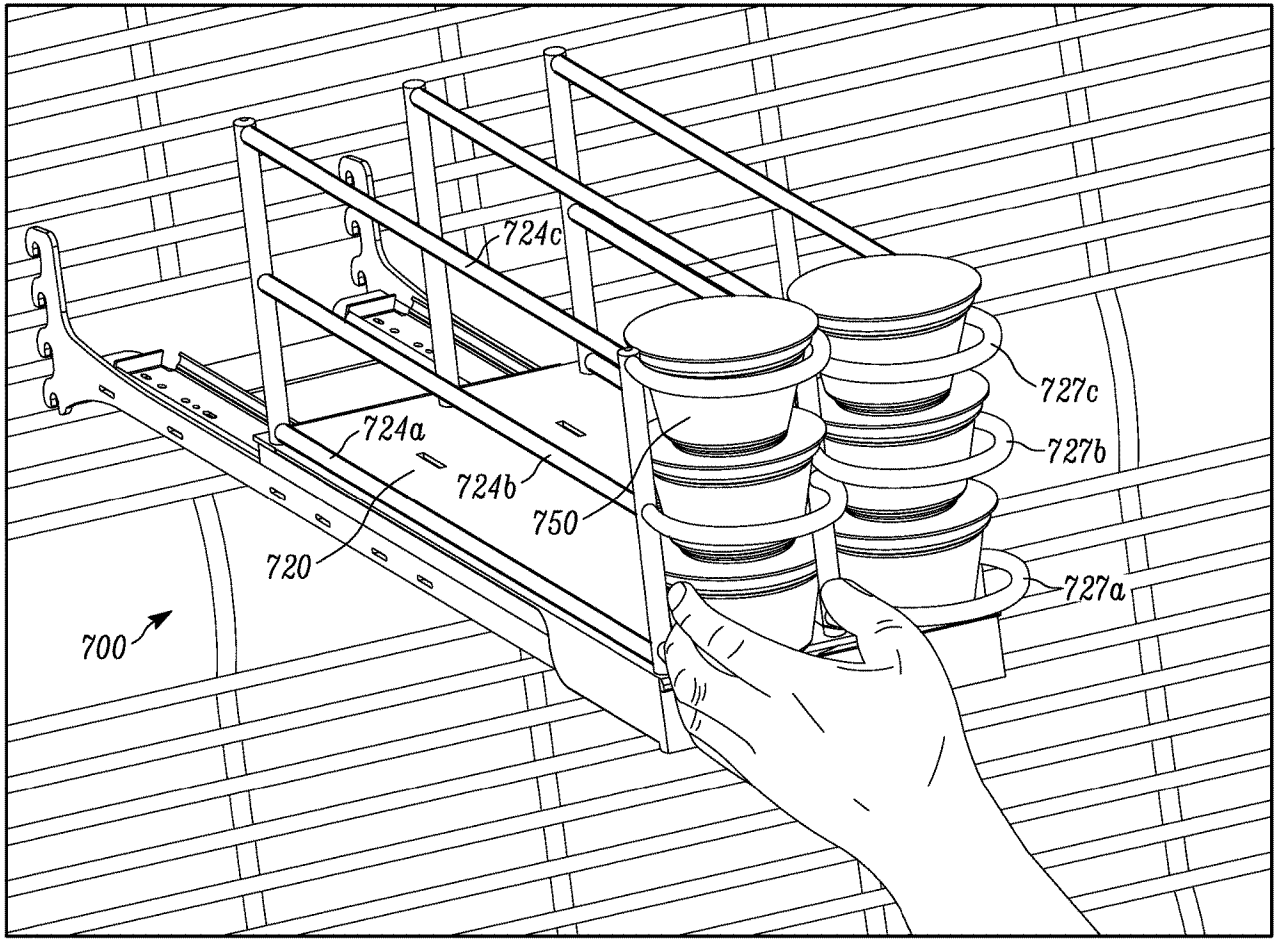
Figure 7F:
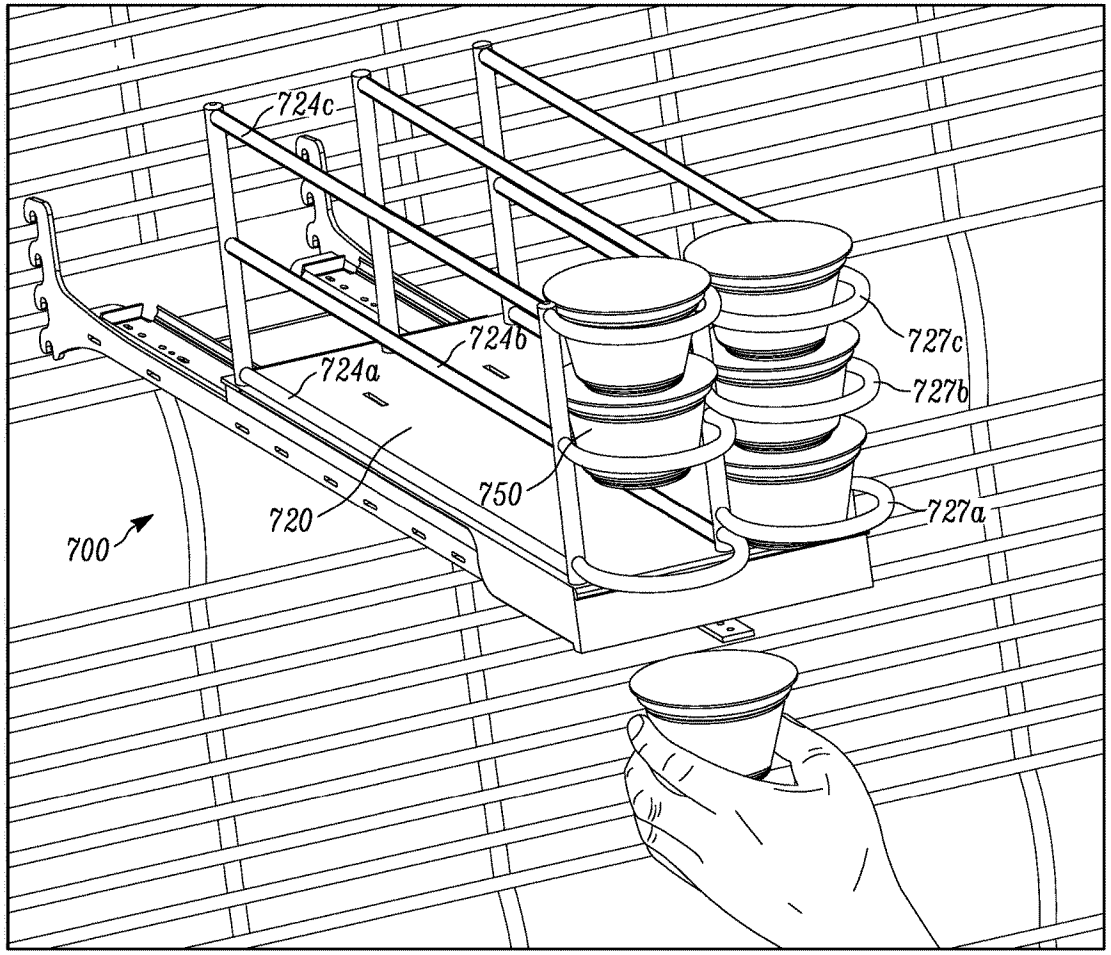

FIGS. 7E-7F illustrate another feature of the merchandiser 700. The product channels 722 are narrower than the widest portion of the products 750. As such, the products 650 engage the dividers 724 such that the guides 724*a-c* support the products 850. In some embodiments, such as shown, the products 750 include a top lip or flange that rests on the guides 724*a-c*. The products 750 are stacked or layered such that each set of guides 724*a-c* support a different layer of products 750. The guides 724*a-c* may be vertically spaced by an amount greater than the height of the products 750 such that the different layers of products 750 do not contact each other and interfere with the facing or adjacent layers.

FIG. 7F illustrates the merchandiser 700 with a product 750 removed from the bottom layer. As shown, the products 750 in the higher layers are supported by the guides 724*b-c* such that they do not fall to fill the void left by the removed product 750. In alternate forms, the product stops 727*a-c* prevent the product in upper rows from dropping down or moving toward the floor of the product channels when product from a row below or rows below are removed. In still other forms, both the guides 724*a-c* and stops 727*a-c* cooperate to maintain product in their respective row of the product channels when neighboring products in the same column are removed.

The guides 724*a-c* may support the product 750 in a variety of ways. The guides 724*a-c* may support a lip of the product 750 as shown. Alternatively, the guides 724*a-c* may have a tapered shape to support the body of the products 750. In still further alternatives, the guides 724*a-c* may be biased towards the products, by being a spring wall or a deformable wall (such as foam) and hold the products 750 by pressure, or may be sloped walls or structures such as guides 724 sloped or taper in toward a top surface of the product or each row of product and positioned below a lip of the product (e.g., a flanged upper end, lid, etc.) to support the product.

The merchandiser 700 may include a swivel bearing to enable the tray 720 to rotate such that it can be loaded from the rear as in the merchandiser 600 above.

All of the above mentioned alternative embodiments are considered in combination with the merchandiser 700. For example, the merchandiser 700 may include any of the biasing means, attachment means, or low product indicators described above.

Figure 7G:
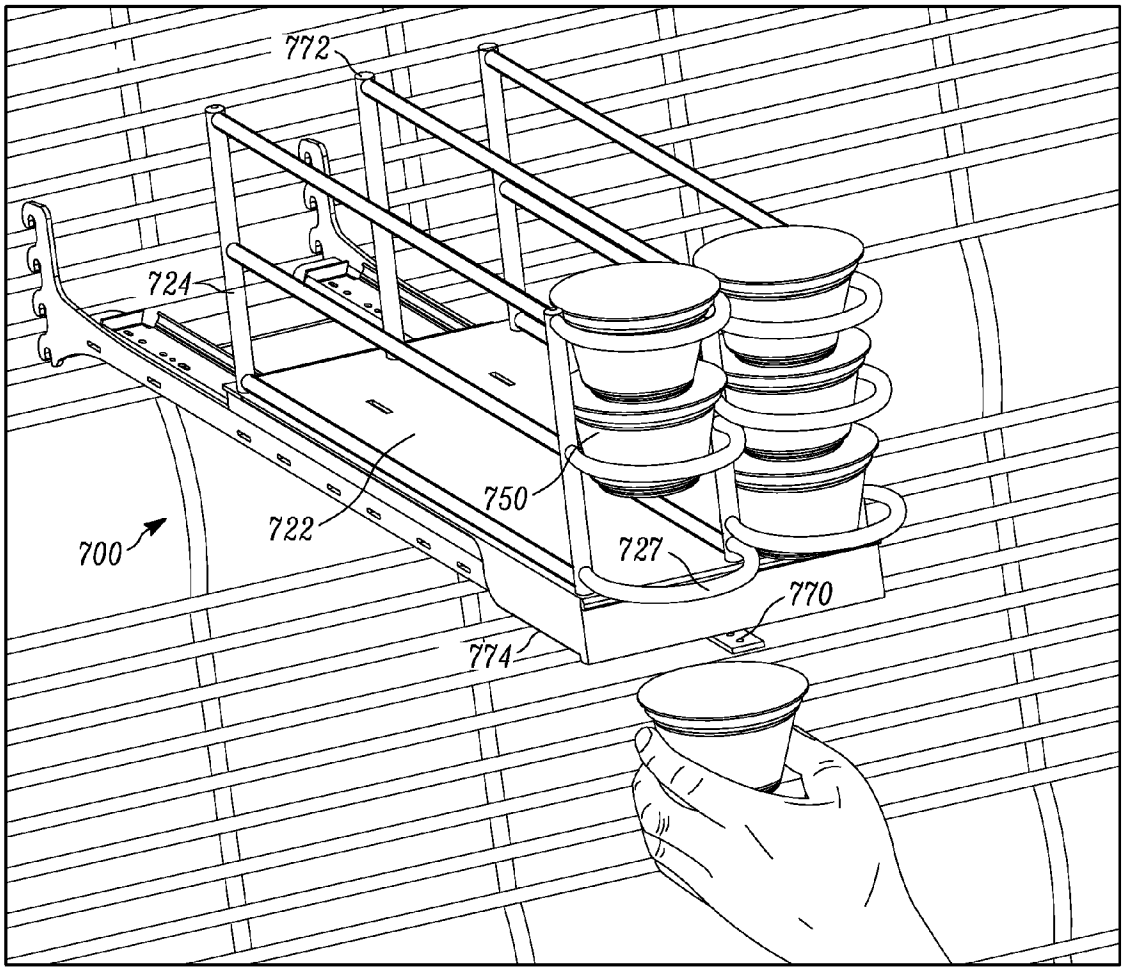

FIG. 7G illustrates an alternative embodiment of the merchandiser 700. Merchandiser 700 includes an optional pusher or rake 772 coupled to a pull tab 770. A channel 774 runs the length of the product channel 722 such that the pull tab 770 and the rake 772 can be mechanically attached within the channel 774 so as to avoid interfering with the products 750. In operation, the products 750 can be advanced forward toward the stopper 727, or "faced", by pulling the pull tab 770. Pulling the pull tab 770 in pulls the rake 772 forward. The rake 772 extends vertically into the product channel 722 such that it contacts the back of the products 750 when pulled forward. As shown, the rake 772 it tall enough to contact each layer of products 750. In an alternative embodiment, a plurality of rakes 772 with corresponding pull tabs 770 can be integrated into the divider 724, each corresponding to a layer of products 750. Each layer can therefore be faced individually.

As with the above embodiments, the features of merchandiser 700, in combination or in part, can be combined with any of the previous merchandisers 100/200/600. Any such combination is considered herein. For example, the pull tab 770 and rake 772 assembly could be implemented into the rotating merchandiser 100.

Figure 8A:
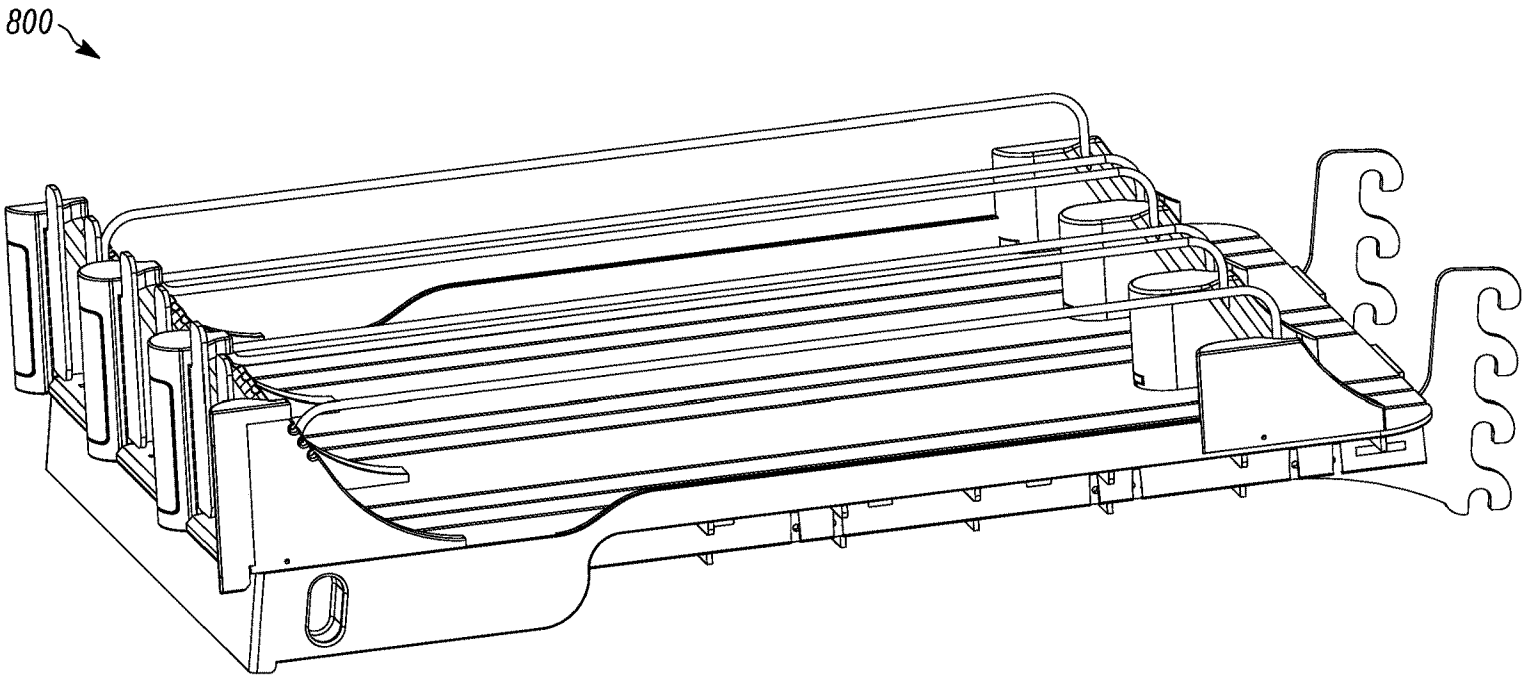
FIG. 8A is a side view of a modular product display merchandiser in accordance with some embodiments of the present invention.
Figure 8B:
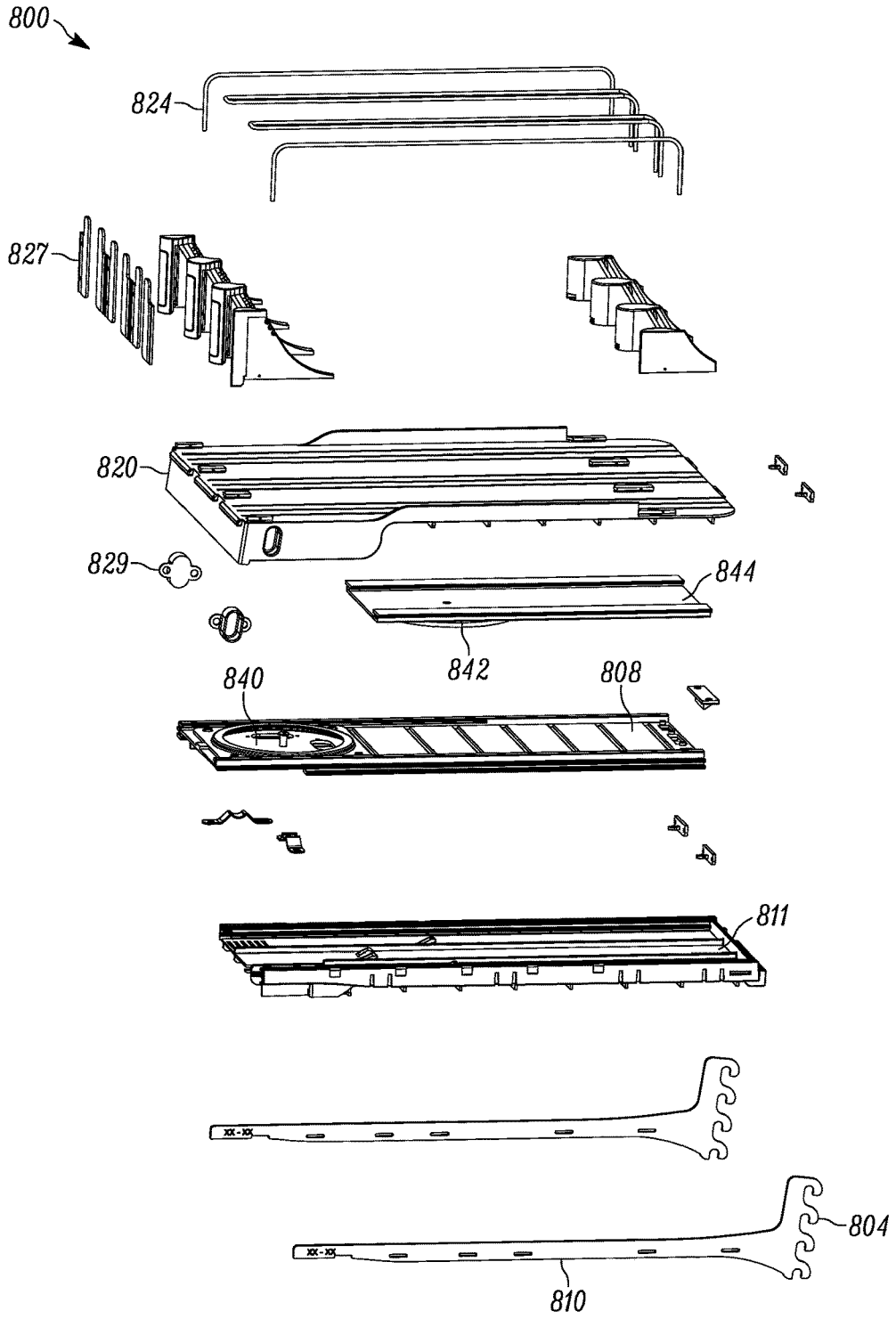
FIG. 8B is an exploded view of the modular product display merchandiser of FIG. 8A.
Figure 9A:
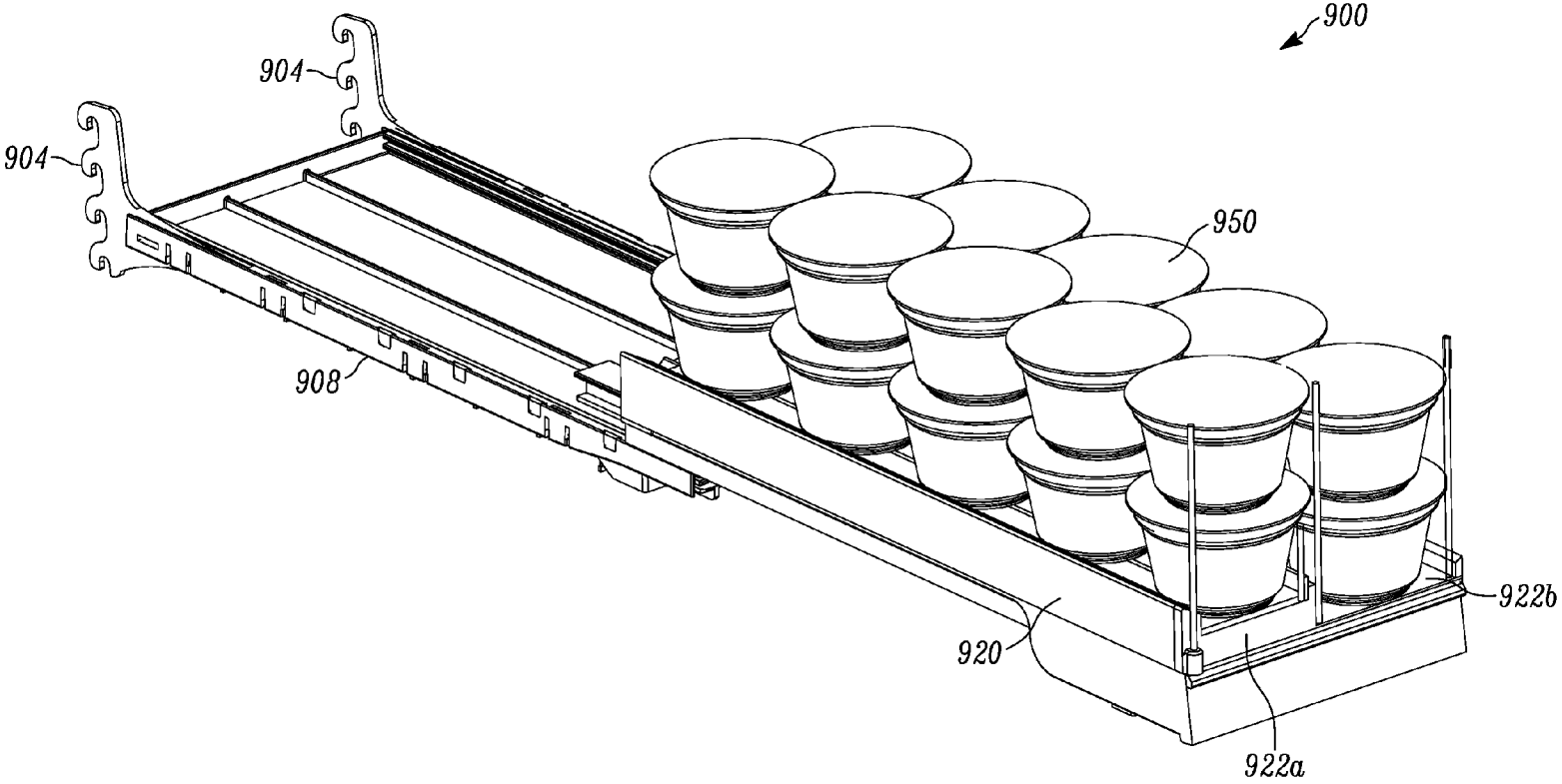
FIG. 9A-9F are a perspective, front elevation, left side elevation, right side elevation, top view, and bottom view respectively of a merchandiser having a tiered tray in accordance with some embodiments of the present invention.
Figure 9B:
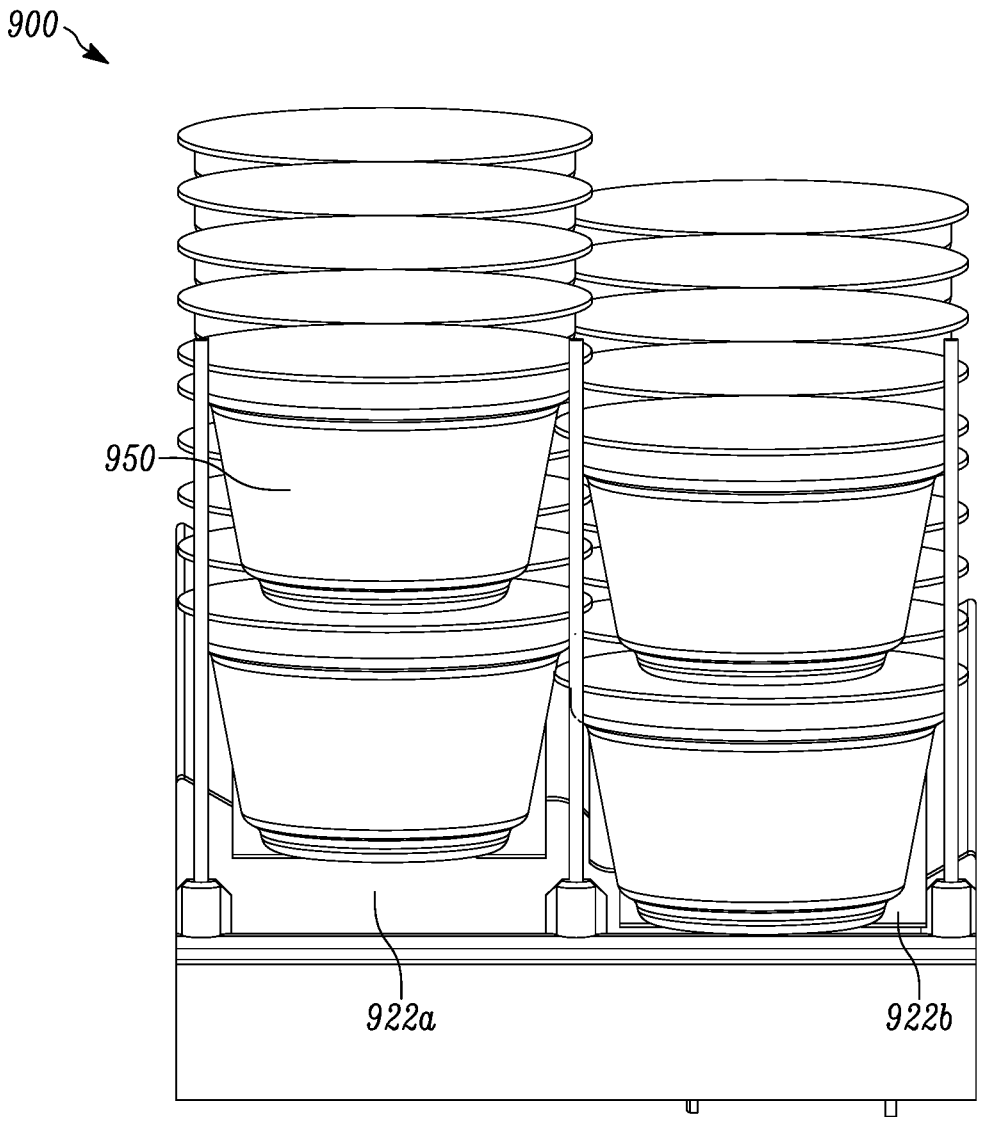
Figure 9C:
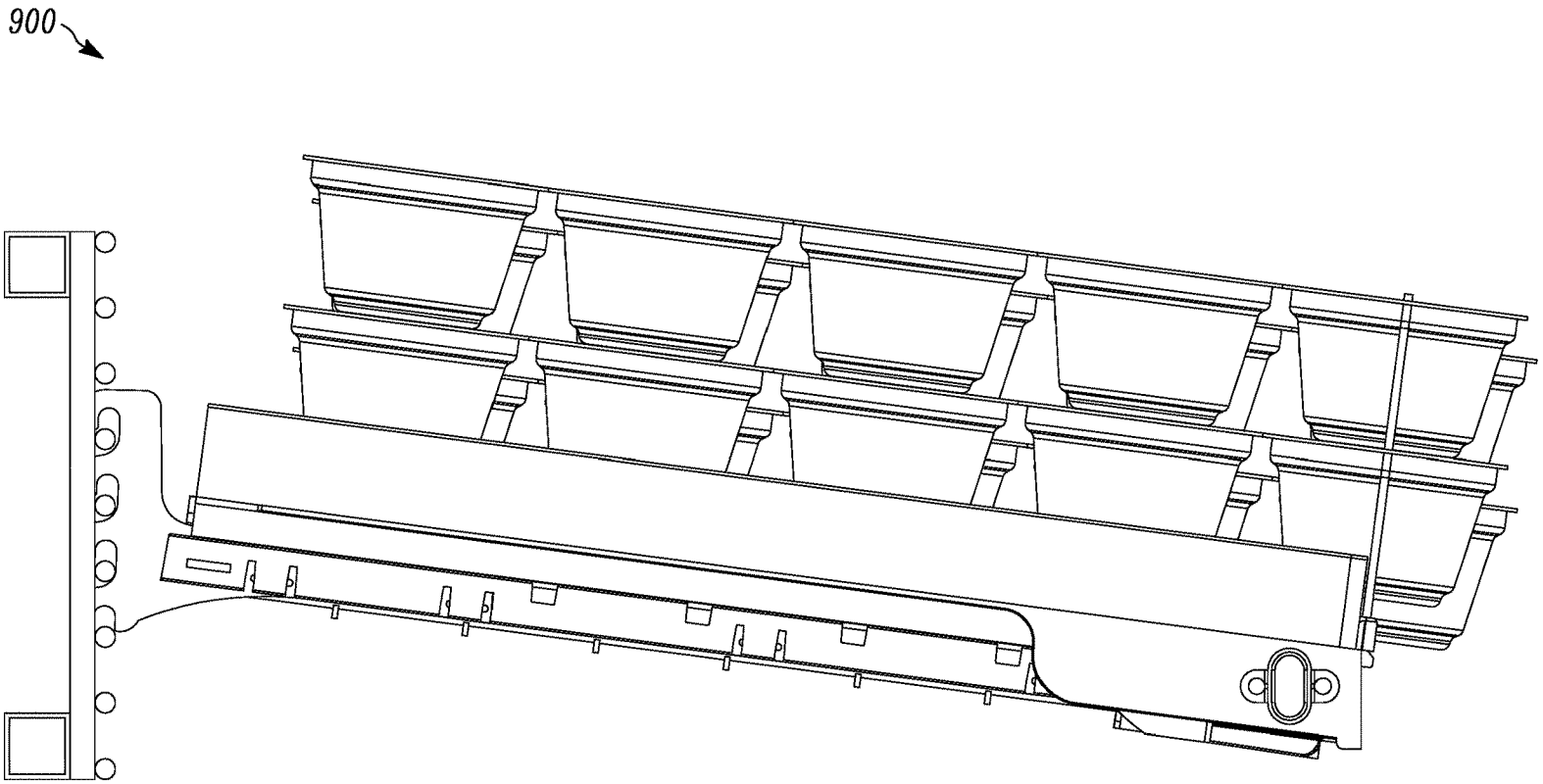
Figure 9D:
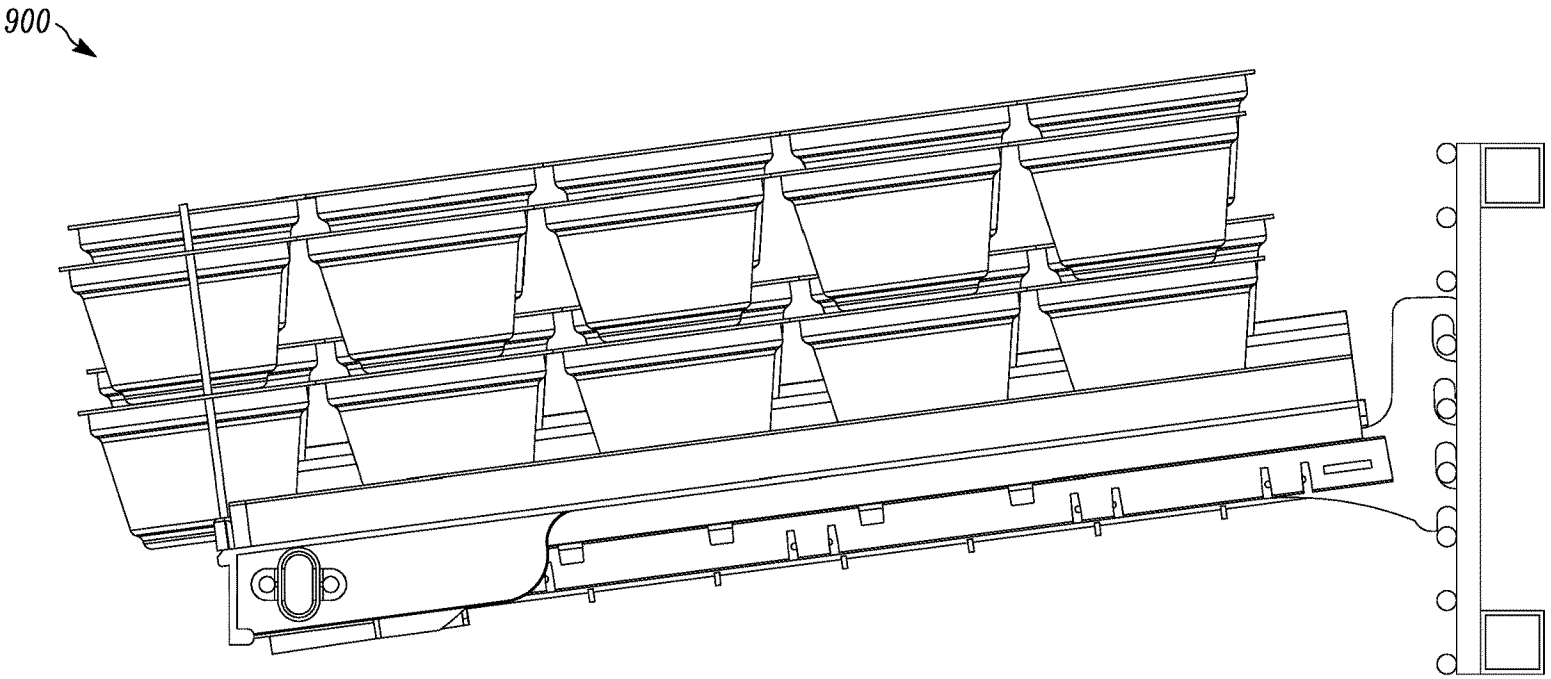
Figure 9E:
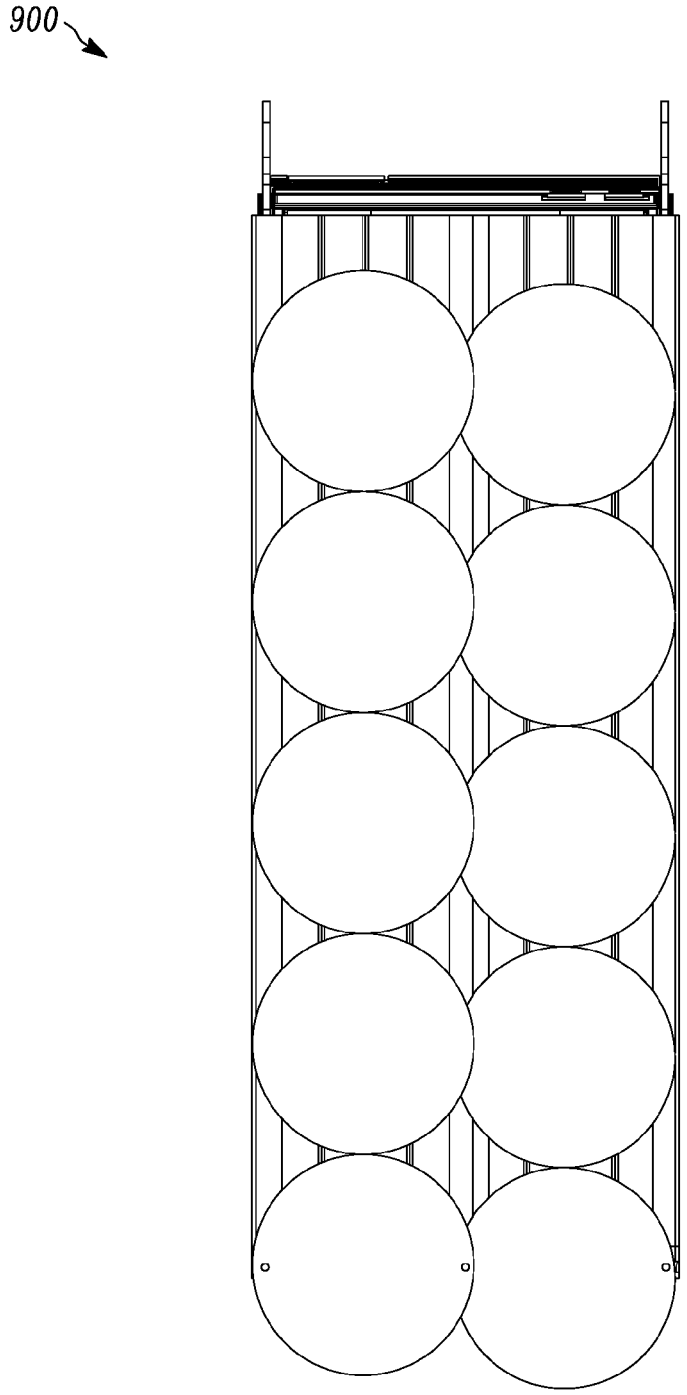
Figure 9F:
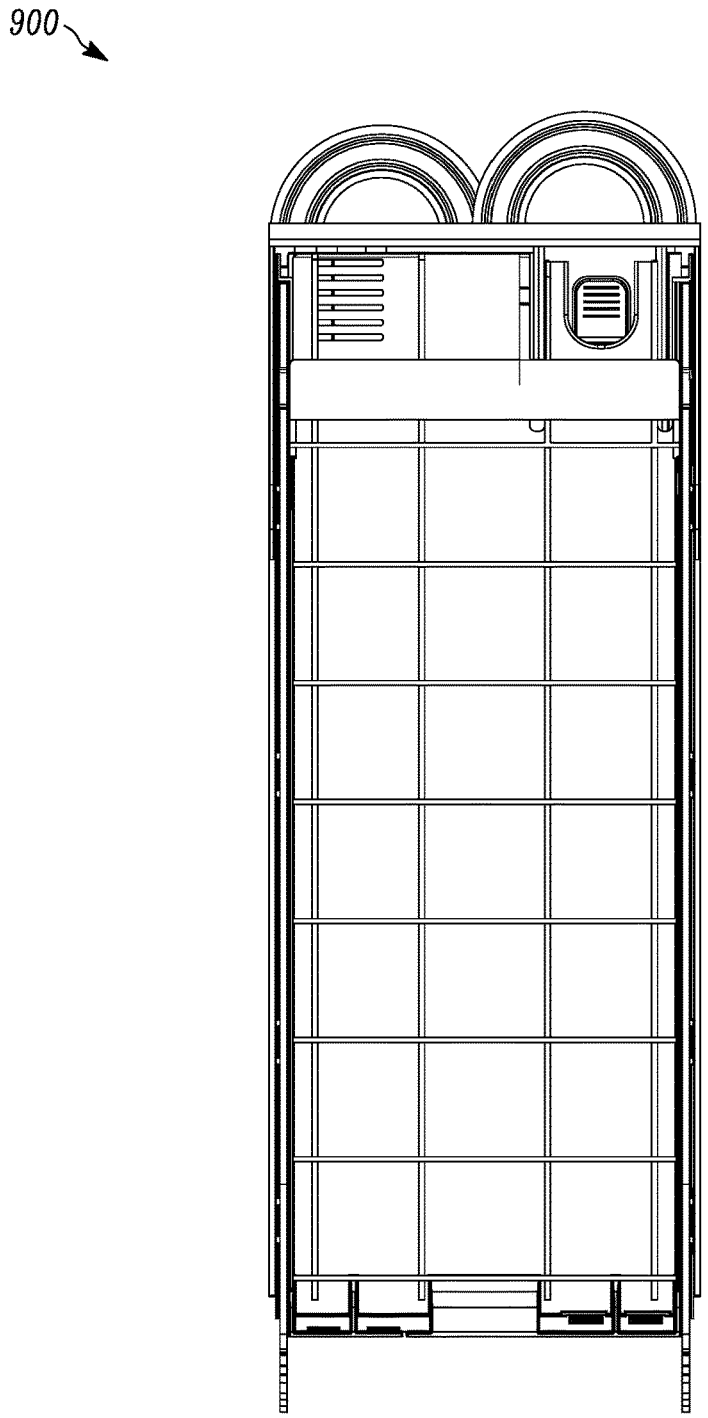

FIGS. 8A-8B illustrate a modular rotating product display merchandiser 800. FIG. 8A is a side elevation view of the fully assembled merchandiser 800. FIG. 8B is an exploded view of the modular merchandiser 800. Elements of the merchandiser 800 that correspond to elements of previous merchandisers contain the same last 2 digits of reference number. In keeping with the above practice, the elements are assumed to function the same as their similarly numbered counterparts except for the differences explicitly stated herein or shown in the figures. The merchandiser 800 includes one or more support arms 810. The support arms 810 are configured to be mounted to a shelving system by attachment means 804. As with above embodiments, different types of attachment means 804 can be used to attach to different types of shelving systems.

A base 811 is removably coupled to the support arms 810. In some embodiments, the base 811 is configured to slide relative to the support arms. In other embodiments, the base 811 is stationary relative to the support arms 810. A support plate 808 removably couples to the base 811. The support plate 808 supports a bearing 840 that is configured to rotate.

As with the base, the support plate 808 can either be slidably attached to the base 811 or rigidly attached. In a preferred embodiment, the center of the bearing 840 slides out relative to the attachment means 804 in order to provide room for the tray 820 to rotate as described in previous embodiments. This can be accomplished by having a sliding engagement between the bearing 840 and the support plate 808, the support plate 808 and the base 811, the base 811 and the support arms 810, or any combination thereof. In still further alternatives, the base 811 is removed and the support plate 808 couples directly to the support arms 810. The support arms 810 may include one or more cross-pieces, or stabilizers, for added stability.

A bottom plate 844 couples to the bearing 840 via a receiver 842. The bearing 840 enables the bottom plate 844 to rotate relative to the support plate 808. A tray 820 is removably coupled to the bottom plate 844. In the embodiment shown, the tray 820 is substantially similar to the tray 120 described above. However, the modular design enables different trays to be used, such as tray 620, or tray 920 described below. The tray 820 includes dividers 824 dividing the tray into a plurality of product channels and stoppers 827 located at the front of each channel.

In operation, the modular design of the merchandiser 800 enables features to be interchanged without replacing the entire merchandiser. For example, in order to change for a grid mounted merchandiser (as shown) to a bar mounted merchandiser, the support arms 810 can be swapped out and replaced with support arms 810 having the appropriate attachment means 804. In another example, the merchandiser 800 can be converted from a rotating merchandiser to a nonrotating merchandiser by removing the support plate 808 and bottom plate 844 and attaching the tray 820 directly to the base 811 or the support arms 810.

In addition to the elements shown, additional features can be added to the modular merchandiser 800. For example, the modular merchandiser 800 can include one or more product sensors 510 and/or spring biased pushers 400 as described above.

FIG. 9A-9F are a perspective, front elevation, left side elevation, right side elevation, top view, and bottom view respectively of a merchandiser 900 having a tiered tray 920. As with above embodiments, elements having the same last two digits on the merchandiser 900 as elements in previous embodiments is assumed to have substantially the same description and function unless differentiated. The tiered tray 920 has a first product channel 922*a* and a second product channel 922*b*. The first and second product channels 922*a*/922*b* are offset vertically. The tray 920 is configured to display products 950 having an inconsistent cross-section, e.g. are wider at some heights than at others. The products 950 shown are yogurt cups having wide rims at their tops. Vertically offsetting the product channels 922*a*/922*b* offsets the rims. This enables the products 950 to be packed tighter horizontally with the rims of adjacent products 950 overlapping. In some embodiments, the tiered tray 920 is implemented into the modular merchandiser 800. In other embodiments, the tiered tray 920 is combined with the merchandisers 100, 200, or 700 to reduce the horizontal space required to display the products contained therein.

Figure 10A:
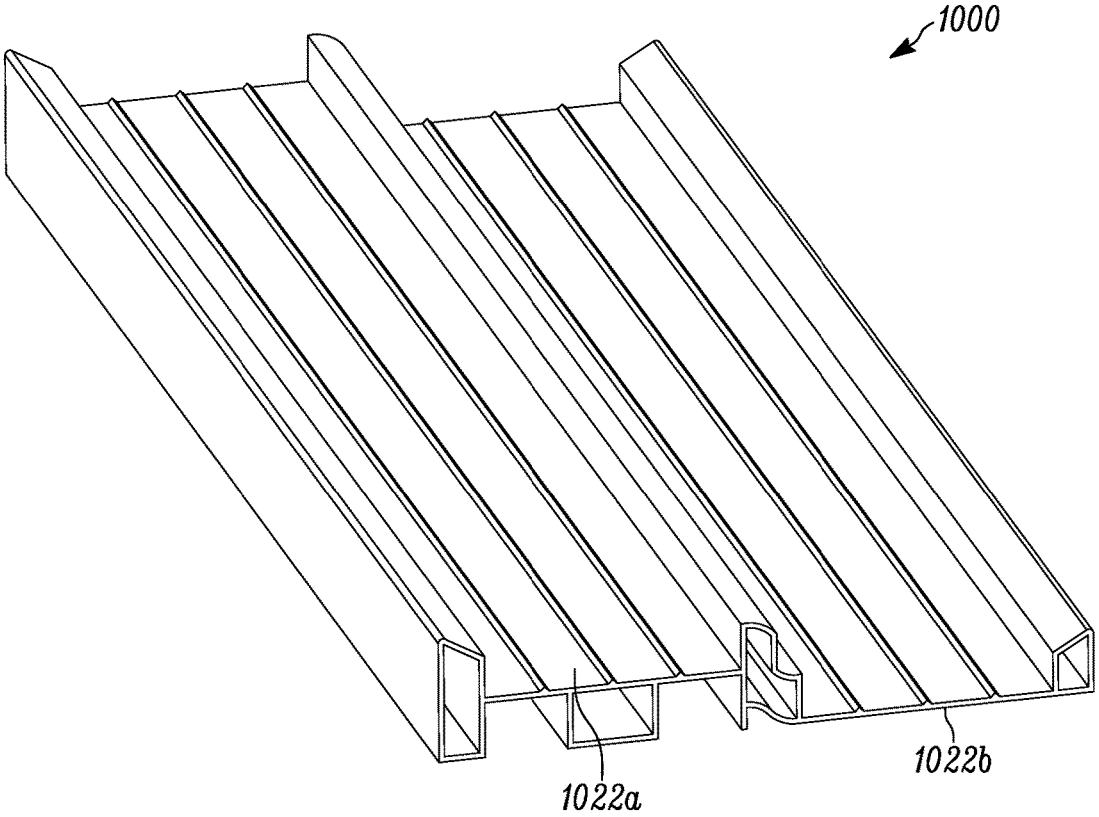
FIGS. 10A-10B are a perspective and front elevation view respectively of a tiered insert for use in a merchandiser in accordance with some embodiments of the present invention.
Figure 10B:
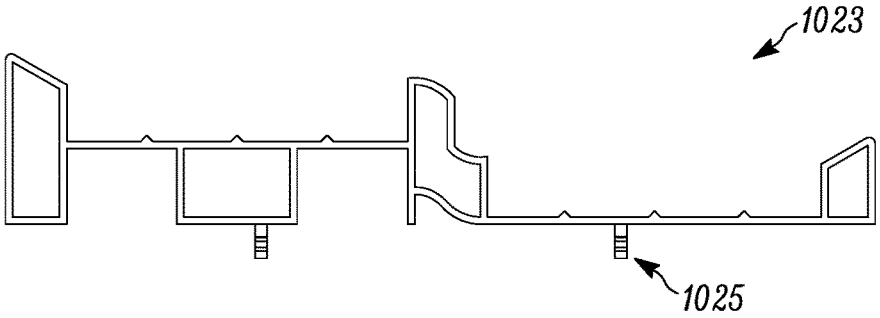

In still further alternatives, the product channels 922*a*/922*b* are offset vertically by an inert positioned on a non-tiered tray. The insert may comprise a plurality of product channels of varying height, or may comprise an insert for a single channel to offset it from adjacent product channels. An exemplary insert 1000 comprising two vertically offset channels 1022*a*/1022*b* is illustrated in FIGS. 10A-10B. In addition to offsetting height, the inserts may include rollers or beads 1023 to affect friction between the products 950 and the insert 1000 as described in previous embodiments. The insert 1000 also includes clips 1025. The clips 1025 are configured to couple the insert to the tray of a merchandisers. In one example, the clips 1025 comprise projections configured to be inserted into slots or recesses in the tray.

Figure 11A:
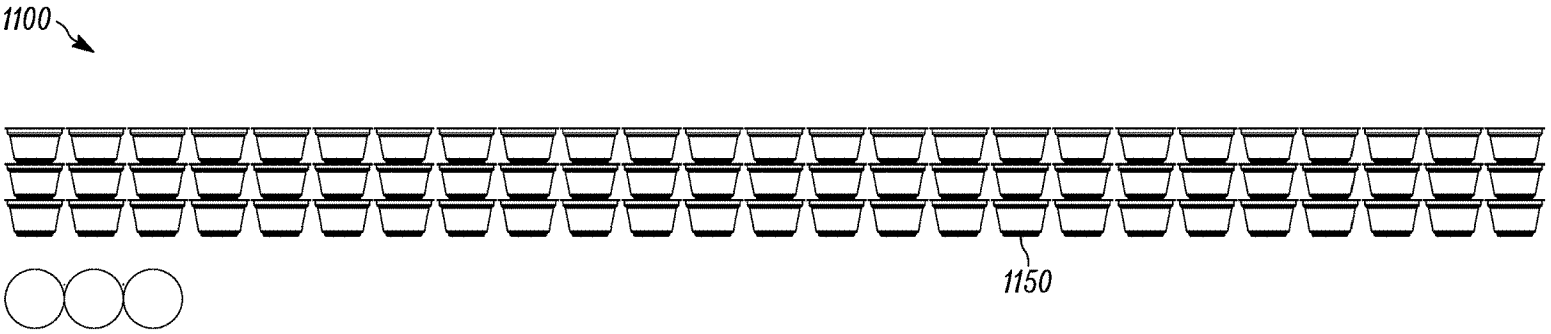
PRIOR ART FIG. 11A
FIG. 11A is a front plan view of a prior art yogurt display.
Figure 11B:
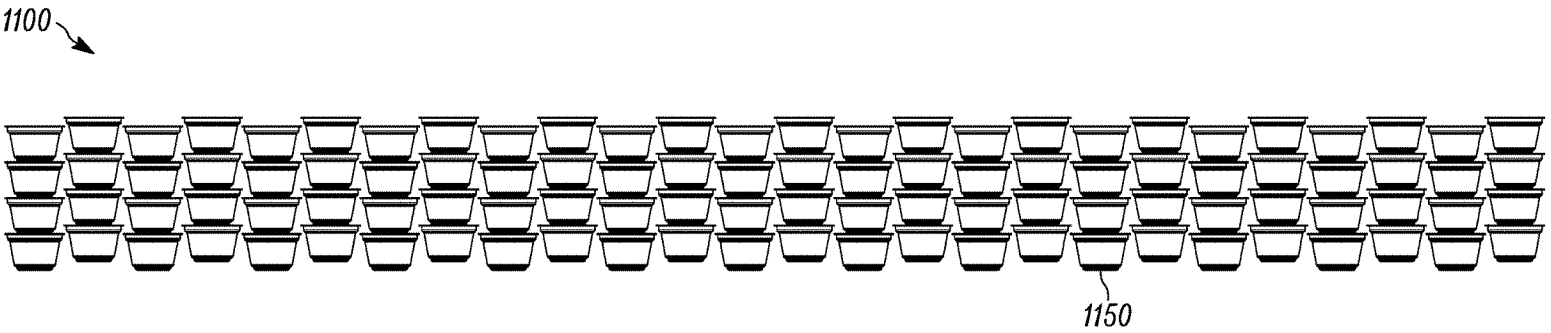
FIG. 11B is a front plan view of a yogurt display having tiered product channels in accordance with some embodiments of the present invention.

FIGS. 11A-11B illustrate a standard 8 foot wide yogurt display 1100. FIG. 11A is a prior art display in which the layers of yogurt comprise a plurality of rows of product 1150 on the same vertical plane. As can be seen, the rims of adjacent yogurt cups are at the same level and then the yogurt cups must be spaced apart rim to rim. A total of 25 rows of product fit within the standard 8 foot width. FIG. 11B illustrates a display in which adjacent rows of yogurt are vertically offset as in the merchandiser 900 above. The offset enables the rims of adjacent yogurt cups to overlap. As a result, one additional row, for a total of 26 rows, fit within the standard 8 foot width.

Figure 12:
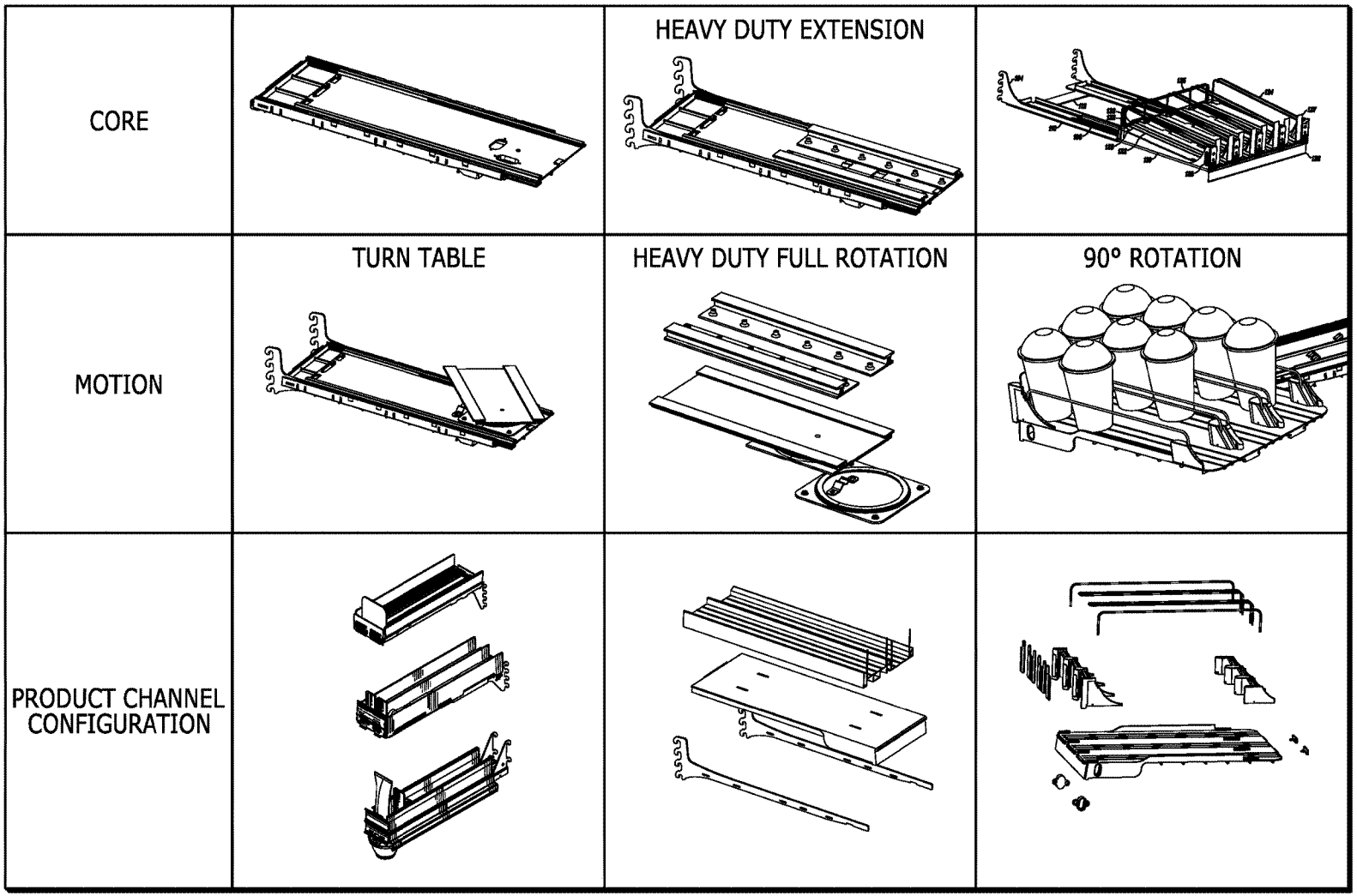
FIG. 12 is a table of exemplary options illustrating the modularity of the merchandiser shown in FIGS. 8A-8B.

FIG. 12 is a table of exemplary options for use in the modular merchandiser 800 described above. The modular merchandiser 800 can be divided into three main sections. The first section, or core, is the base of the merchandiser. It comprises the attachment means for mounting the merchandiser on the shelving unit. In several embodiments, the base also comprises a means of sliding outward from a first, retracted position to a second, extended position. The left most core is a standard option comprising a base with a slide out plate. The rest of the merchandiser mounts on the plate such that it slides out relative to the base. The middle core is a heavy duty alternative. The heavy duty core comprises thicker gauge metal. The slide out plate is shorter and the metal is folded over to form a stronger support. The heavy duty core may be better suited for displaying heavier products, such as canned goods. The right most core is a baseless tray design as described above. The baseless tray comprises one or more arms on which the tray is mounted instead of a solid base. As shown, the arms may be connected by one or more stabilizers, such as the rear stabilizer shown.

On top of the core, a motion means or extension support is attached to give the merchandiser the rotating action described in the previous embodiments. The left most motion means is the standard turntable described above. The standard turntable comprises a plate rotatably coupled to the core by means of a bearing. The turntable allows for full rotation of the tray, with an optional stop at 180 degrees to aid in stocking. The middle example show in a heavy duty version of the fully rotating turntable. The heavy duty version comprises a larger bearing and a plate made of a thicker gauge of metal. As with the heavy duty core, the heavy duty motion structure is well suited for heavier products, such as canned goods. The final example, on the right, if a rotating means configured to only rotate 90 degrees. The 90 degree rotation enable the rear of the tray to be loaded from the side of the merchandiser. This design is described above.

The third level of modularity is the product channel configuration. The product channel configuration is the portion of the merchandiser that actually displays the product. Any of the prior art styles of merchandisers incorporated by reference above are possible product channel configuration contemplated herein. A few of these prior art examples are shown on the left, including a single channel tray with a pusher, a tray having a plurality of channels separated horizontally by walls, and a tray having a top channel and a bottom channel. In addition to these prior art product channel configuration, the various product channel configurations described herein are considered. The center product channel configuration comprises two channels being vertically offset from each other as described above. The far right product channel configuration comprises several channels separated by wire dividers as described in the merchandiser 100 above. In addition to these, other examples include the product channels of the merchandiser 700 having the vertically spaced guides configured to support a plurality of layers of products.

In operation, a variety of options of cores, motions, and product channel configurations are provided. Individual options are selected based on the needs of the product to be displayed. For example, for displaying heavy cans of dog food the user may select the heavy duty extension core, the heavy duty rotating motion, and product channel configuration having a plurality of gravity fed rows. Whereas, for displaying a lighter product, such as cups of salad, the user may select a standard extending core, a 90 degree rotating motion, and a plurality of rows with biased pushers.

Figure 13:
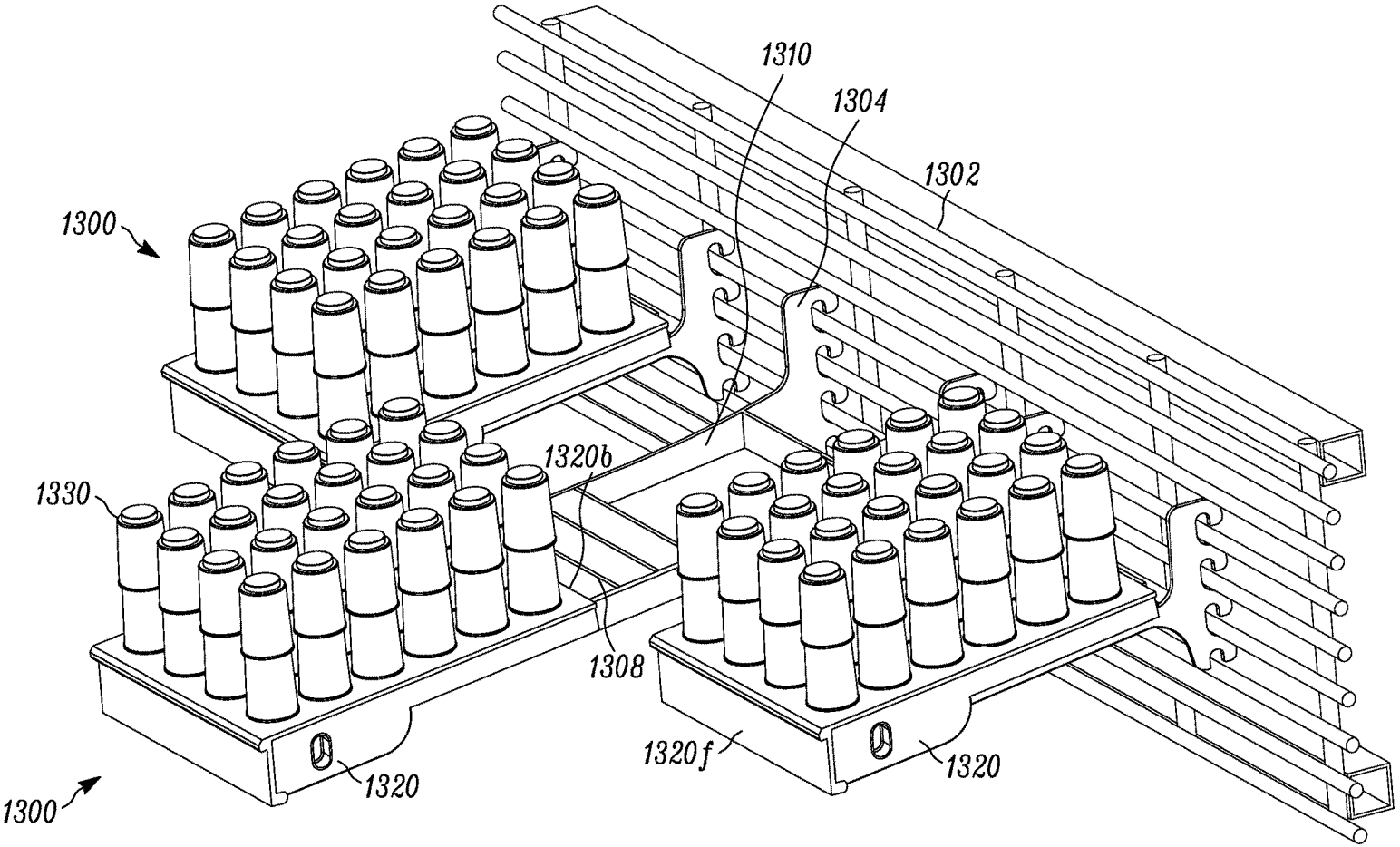
FIG. 13 is a perspective view of a plurality of product display merchandisers in accordance with some embodiments of the present invention, illustrating the product displays in both extended and retracted positions.

Turning to FIG. 13, a plurality of product displays 1300 are shown arranged on a grid 1302. The product displays 1300 include product supports 1320 slidably attached to a plate 1308, which in turn is slidably attached to the support members 1310. The support members 1310 are arms having attachment members 1304 configured to detachably couple to the grid 1302. The combination of two slidable connections enables the product support 1320 to be fully extendable such that the back 1320*b* of the extended product support 1320 is at least as far forward as the front 1320*f* of a retracted product support 1320. As shown, this provides access to the back of the extended product support 1320 from the sides without interference from the adjacent product displays 1300. In some embodiments, the grid 1302 supports vertical columns of product displays 1300, the full extension further avoids interference from the product display located above extended product support 1320.

The product supports 1320 support a plurality of perishable products 1330, specifically yogurt cups. The unobstructed access to the back 1320*b* of the product supports 1320 enable new products 1330 to be loaded in the back, such that the first in, first out order is maintained. The product support 1320 still overlaps a large section of the intermediate member 1308, and the intermediate member 1308 in turn overlaps a large section of the support members 1310 when in a fully extended position. These instances of overlap provide strength and stability against bending or breaking under the downward force of the heavy products 1330 located on the fully extended product support 1320.

Figure 14:
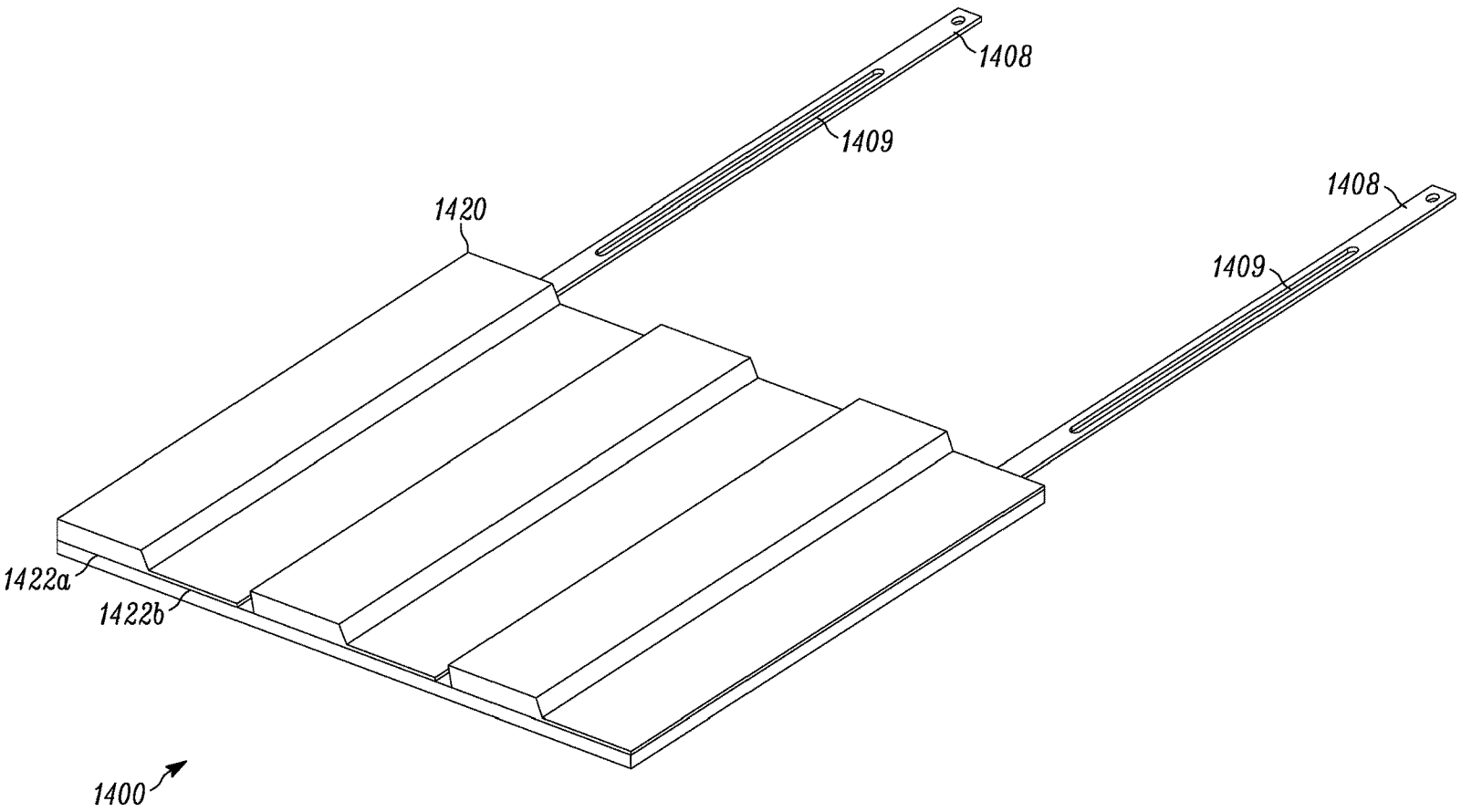
FIG. 14 is a perspective view of a product display merchandiser in accordance with some embodiments of the present invention.

FIG. 14 illustrates an extendable shelf 1400 comprising a product support 1420 and a pair of intermediate members 1408. The product support 1420 has a plurality of product channels 1422. The product channels 1422 include alternating high channels 1422*a* and low channels 1422*b* so as to vertically stagger adjacent rows of products. The staggering increases horizontal layout of products having inconsistent width, such as yogurt cups having a wide rim, by offsetting the rims such that they can overlap. The increased horizontal layout is illustrated in FIG. 11B. The intermediate members 1408 includes slots 1409. The slots 1409 are configured to fit over protrusions of support members, such as the shafts of bolts. The slots 1409 slidably couple the intermediate members 1408 to the support members. The product support 1420 is slidable relative to the intermediate members 1408. FIG. 14 illustrates the product support 1420 in an extended position or stocking position relative to the intermediate members 1408.

Figure 15A:
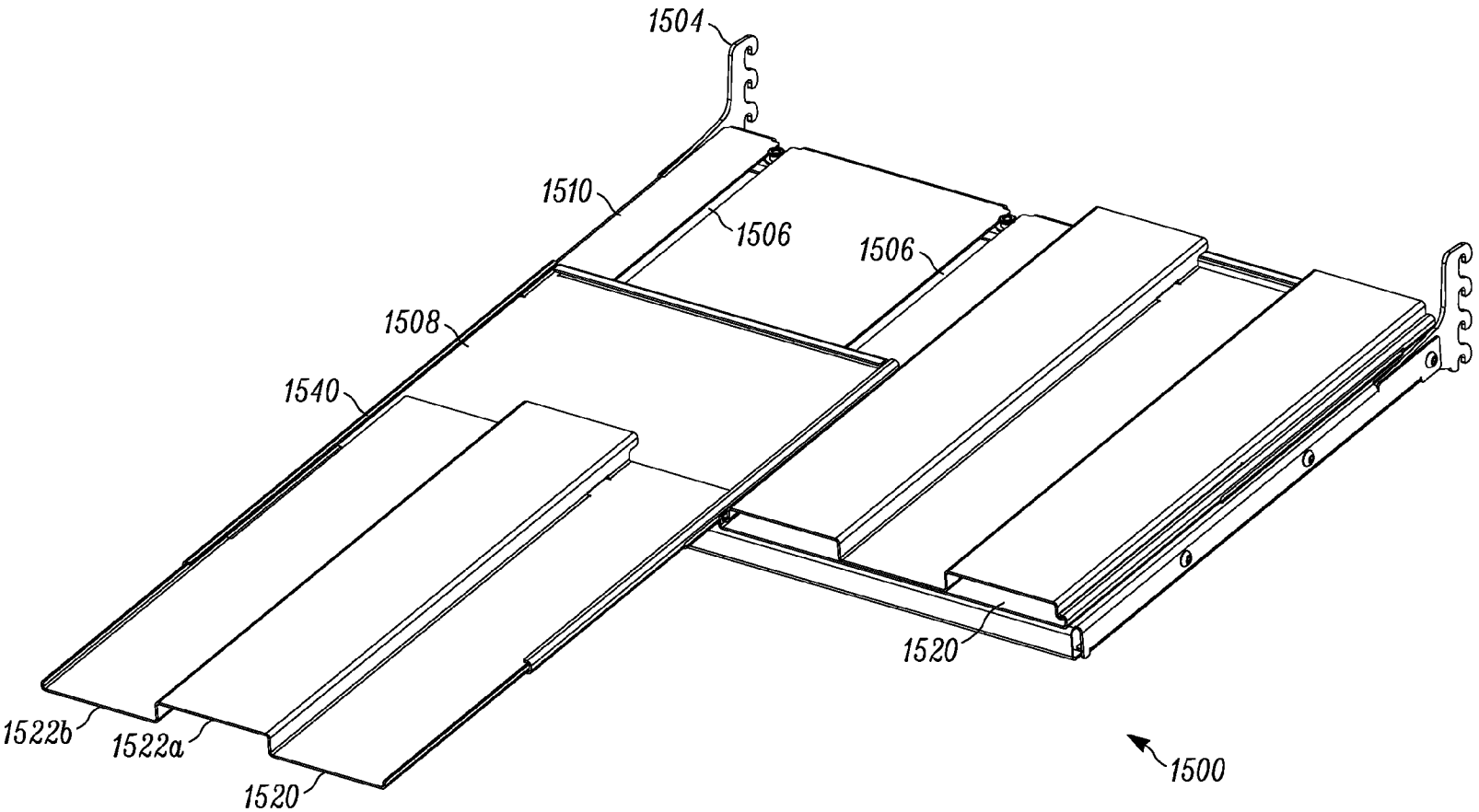
FIG. 15A is a perspective view of a product display merchandiser in accordance with some embodiments of the present invention.

The merchandiser 1500 in FIG. 15A includes a pair of independently slidable product supports 1520 each slidable relative to a corresponding intermediate member 1508 which are independently slidable relative to the support member 1510. The support member 1510 includes a plurality of slots or channels 1506 into which projections from the intermediate members 1508 extend. The length of the channels 1506 define the distance which the intermediate members 1508 slide relative to the support member 1510. The support members 1508 include channels 1540 in which a portion of the product supports 1520 are received.

Figure 15B:
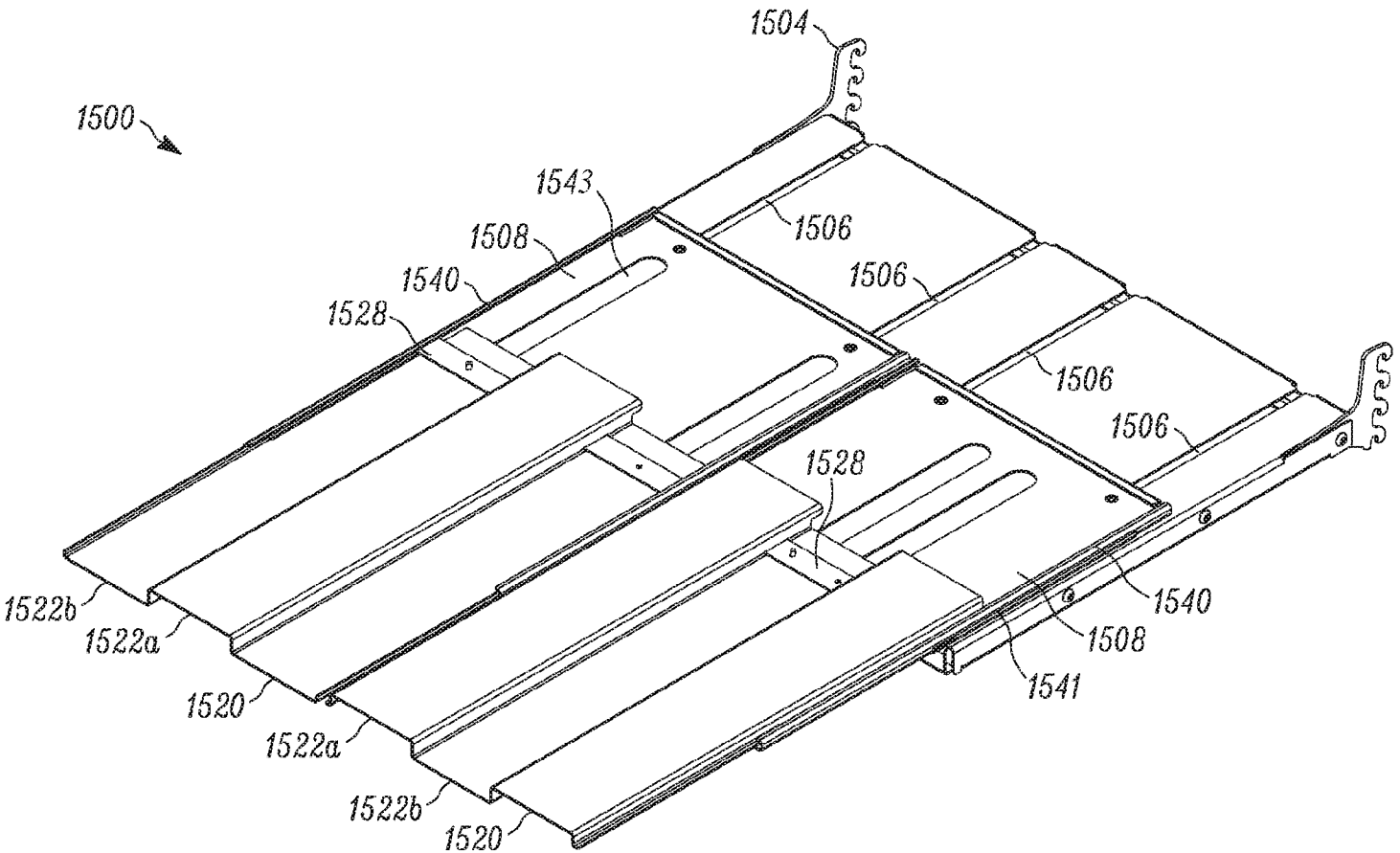
FIG. 15B is a perspective view of the product display merchandiser of FIG. 15A with an added stop bar.

FIG. 15B illustrates the merchandiser 1500 with an added stop bar 1528 coupled to each product support 1520. The stop bar is received within slots 1541 in the channels 1540. When the stop bar 1528 reaches the front of the slots 1541 it prevents further forward sliding of the product support 1520 relative to the intermediate member 1508. As shown, the stop bar 1528 is a separate component coupled to the product support 1520. The stop bar 1528 can be coupled to the product support by rivets, screws, bolts, adhesive, other attachment means or can be friction fit within apertures or cavities within the product support 1520. In some forms, the intermediate members 1508 include grooves or slots 1543 configured to receive the attachment means of the stop bar 1528 to prevent it from rubbing against the intermediate members. For example, the slots 1543 shown align with rivets in the stop bars 1528 to provide clearance therefore. In alternative embodiments, the stop bar 1528 is integral with the product support 1520, for example a protrusion or flange extending from an outer edge of the product support 1520 into the slot 1541. In some forms, one or more product channel inserts are coupled to the product support 1520 to form smooth channels along which rows of products can slide. In one form, the product channel inserts include silicon impregnated material to further reduce friction with the product. Additionally, or alternatively, the product channel inserts include sidewalls to restrict sideways movement of the products.

The two product supports 1520 can be moved from the retracted or display position into the extended or stocking position independently of each other. Splitting the tray into a plurality of independently slidable product supports 1520 enables more the of the product channels 1522 to be accessed from the side. Additionally, only having one of the product supports 1520 extended at a time reduces the amount of torque on the attachment members 1504 compared to if both product supports 1520 were extended.

FIGS. 16A-D illustrate a product display 1600 having a product support 1620 having two vertically staggered product channels 1622. The higher product channel 1622*a* is positioned above the support member 1610, while the lower product channel 1622*b* is located beside the support member 1610. Positioning the lower product channel 1622*b* beside the support member 1610 increases vertical loadout.

Figure 16A:
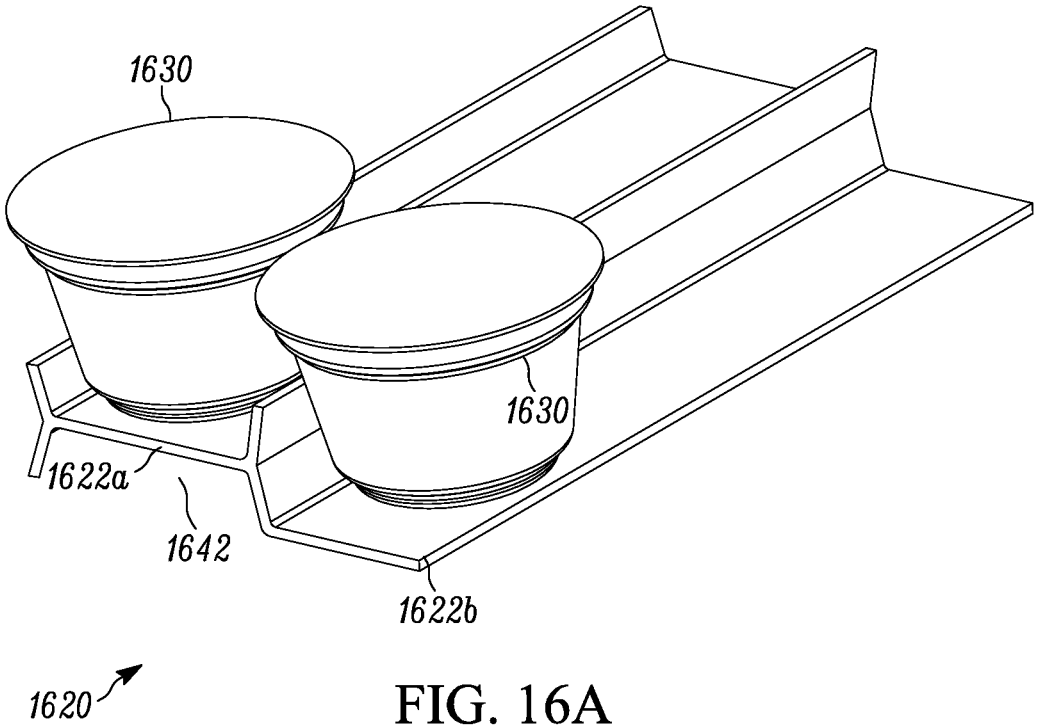
FIG. 16A is a perspective view of a product support in accordance with some embodiments of the present invention.
Figure 16B:
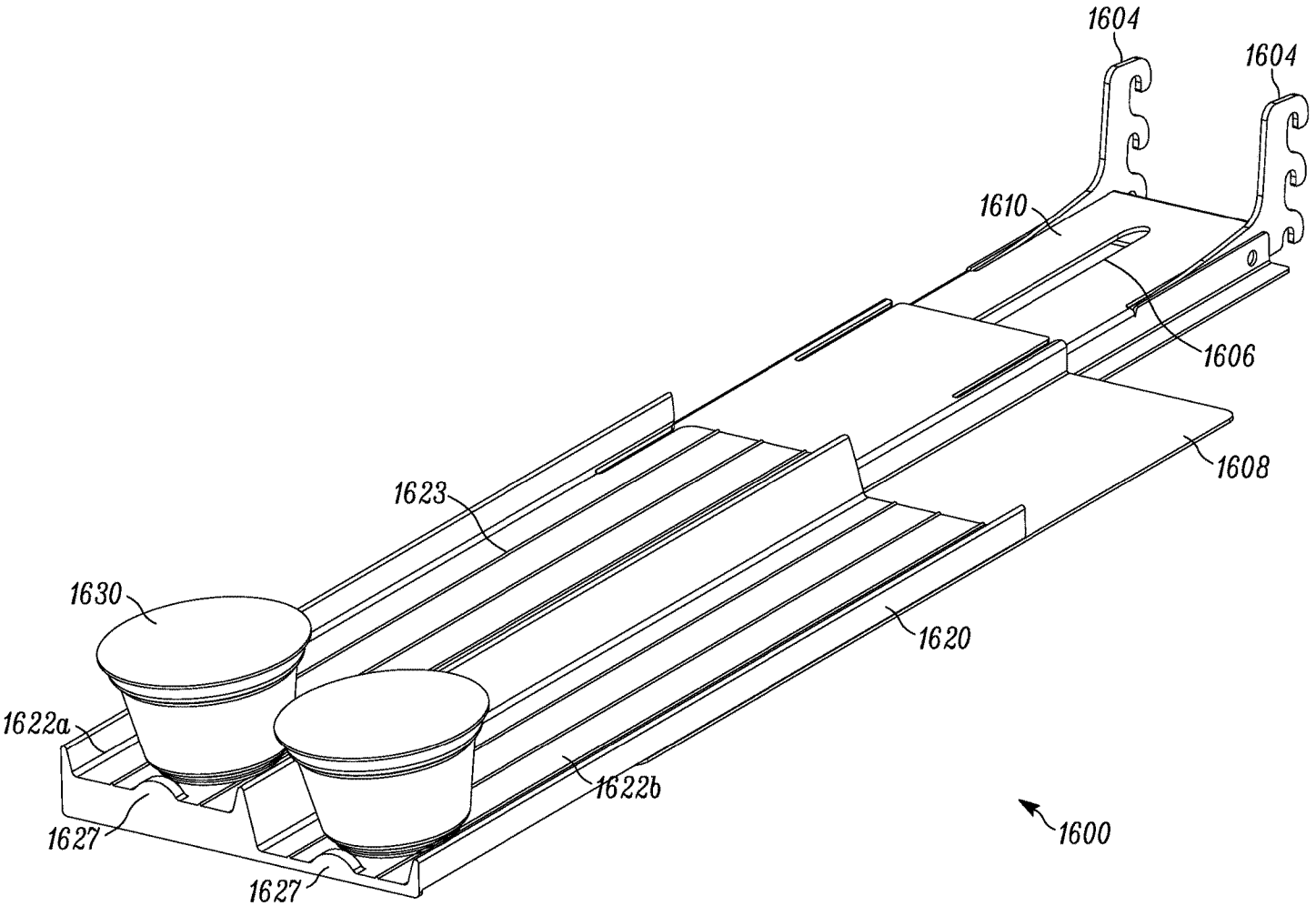
FIG. 16B is a perspective view of a product display merchandiser having the product support of FIG. 16A.
Figure 16C:
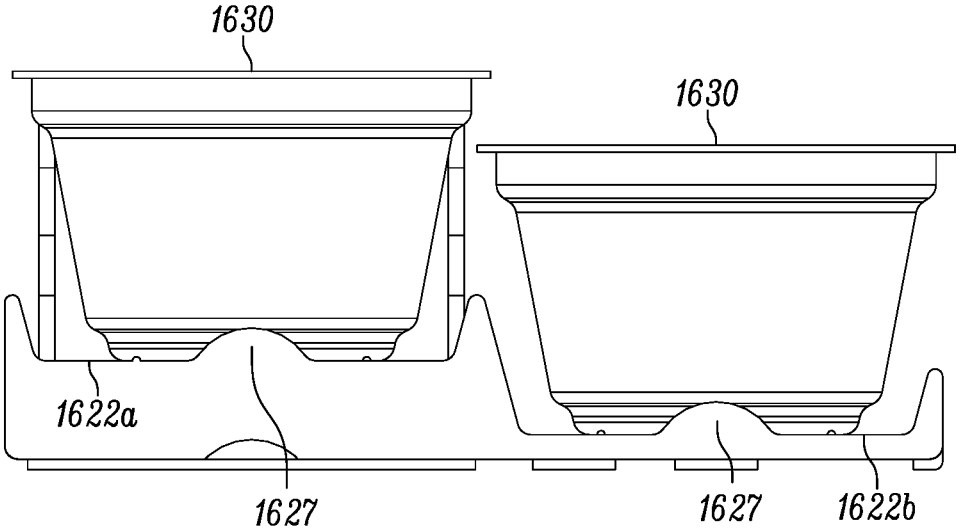
FIG. 16C is a front elevated view of the product display merchandiser of FIG. 16B.

FIG. 16A is a cross section of the product support 1620. The product support 1620 includes a gap or opening 1642 under the higher product channel 1622*a* and beside the lower product channel 1622*b* into which the support member 1610 is at least partially received. Turning to FIG. 16B, the product support 1620 is supported by and slidable relative to an intermediate member 1608. Similar to the product support 1620, the intermediate member 1608 includes two vertically staggered sections with the higher one being positioned over the support member 1610. The support member 1610 is narrower than the product support 1620, being sized to at least partially fit within the opening 1642. The support member 1610 includes a slot 1606 configured to receive a projection of the intermediate member 1608 so as to slidably couple thereto.

The product support 1620 includes a plurality of low friction beads 1623 for supporting the products 1630. The beads 1623 reduce the contact area with the products 1630 and thus the friction between the product supports 1620 and the products 1630. Each product channel 1622*a/b* further includes a product stop 1627 located at the front end. The product stops 1627 prevent the products from falling off of the front of the product display 1600.

Figure 16D:
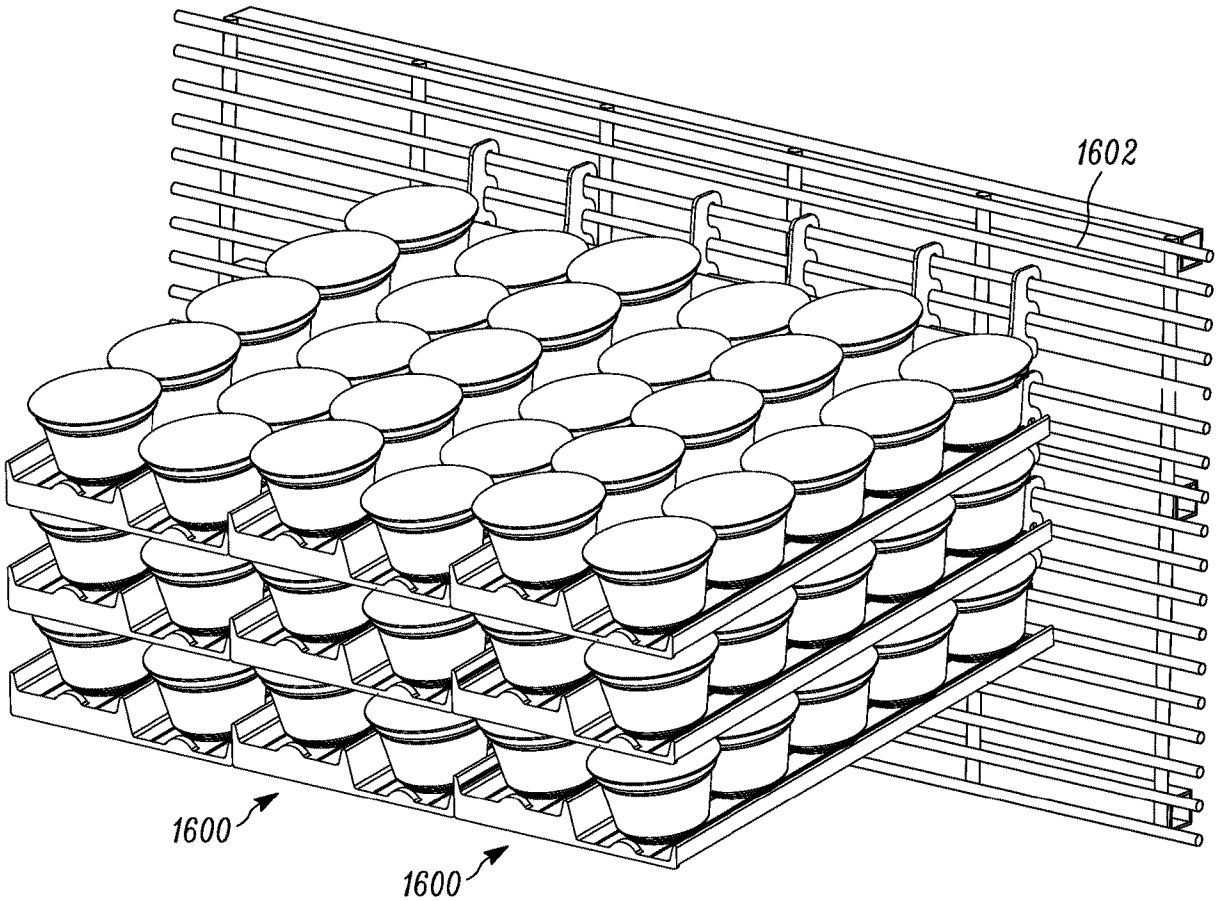
FIG. 16D is a plurality of the product display merchandisers of FIGS. 16B-16C arranged on a grid.

FIG. 16D illustrates a plurality of product displays 1600 arranged on a grid 1602. As shown, the positioning of the lower product channels 1622*b* beside the support members 1610 allow for a tighter vertical loadout, thus increasing the amount of product that can be displayed on the same sized grid 1602.

Figure 17A:
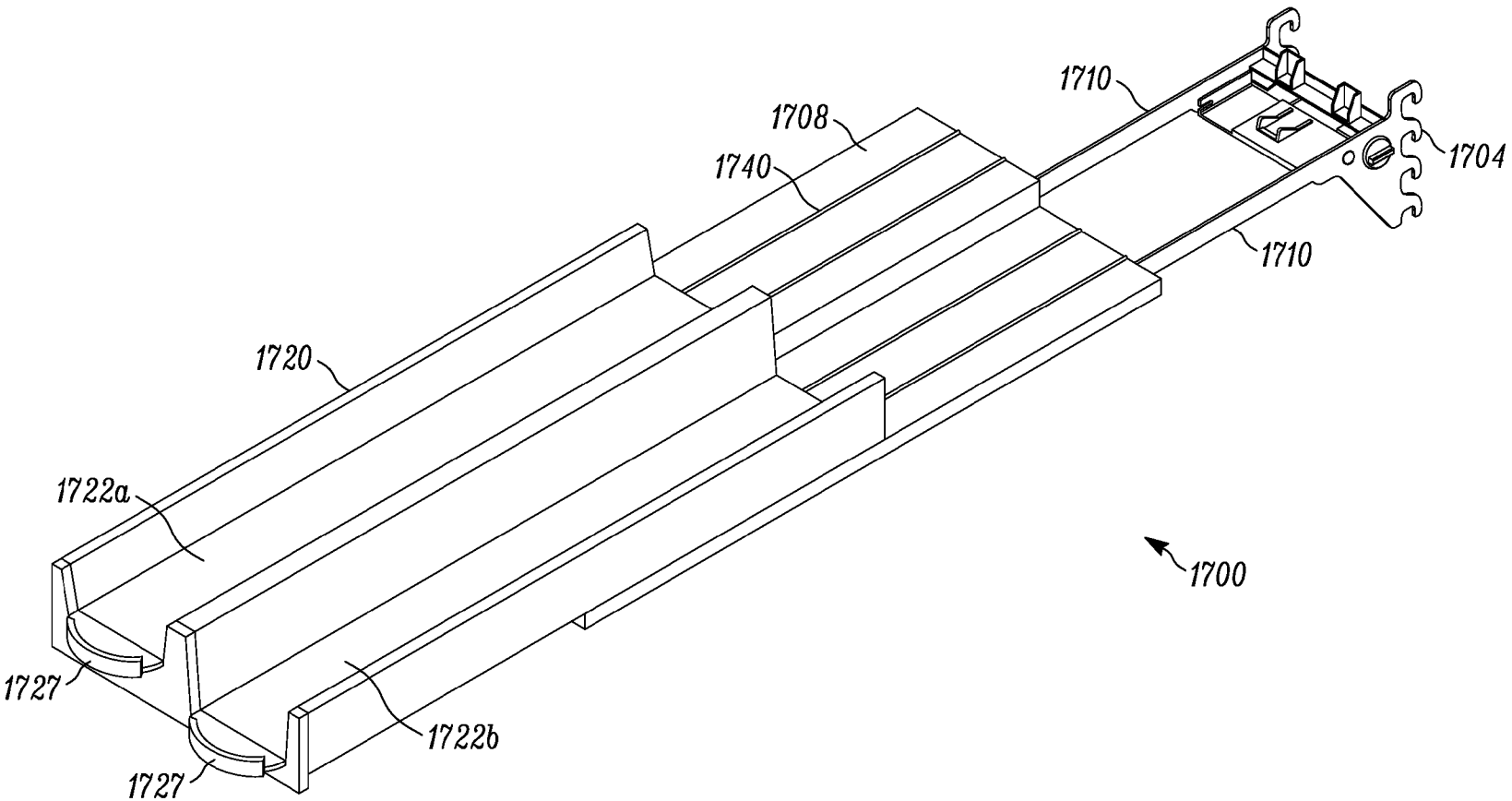
FIG. 17A is a perspective view of a product display merchandiser in accordance with some embodiments of the present invention.
Figure 17B:
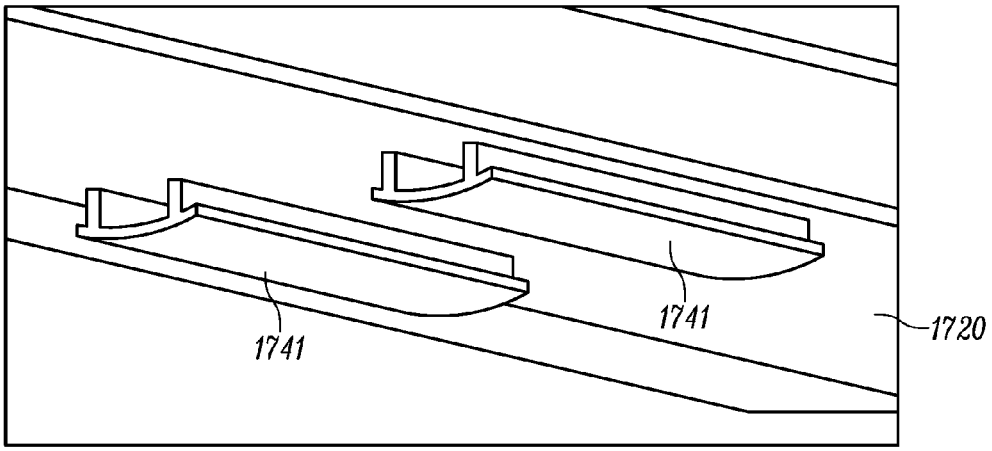
FIG. 17B is a bottom perspective view of a product support of the product display merchandiser of FIG. 17A.

FIGS. 17A-B illustrate a product display 1700 having a product support 1720 with two, vertically staggered product channels 1722*a/b*. The product support 1720 is slidably coupled to an intermediate member 1708 which is in turn slidably coupled to support members 1710. The support members 1710 comprise two arms 1710 with a gap there between such that the product display 1700 has a baseless configuration. The two arms 1710 are received within openings in the intermediate member 1708 such that the intermediate member 1708 can slide along the arms 1710.

The product support 1720 is slidably attached to the intermediate member 1708 at the, or proximate to, the bottom of the product support 1720. The intermediate member 1708 includes a plurality of slots or channels 1740 in the top surface. The channels 1740 are configured to receive protrusions 1741 located on the bottom surface of the product support 1720 (see FIG. 17B). The protrusions 1741 have a T shape or I such that the flange on the distal end prevents the protrusions 1741 from being lifted out of the channels 1740. The channels 1740 extend all the way to the back of the intermediate member 1708. In operation, the product support 1720 can be detached from the intermediate member 1708 by sliding the intermediate member 1708 out relative to the support members 1710, and then sliding the product support 1720 backwards relative to the intermediate member 1708 until the protrusions 1741 exit the back end of the channels 1740. This quick detachment enables the modular modification of the product display 1700 by quickly removing and replacing the product support 1720. Additionally, quickly disassembling the product display 1700 aids in its cleaning and/or maintenance.

In some forms, a similar combination of protrusions and slots can be used to slidably attach the intermediate member 1708 to the support member 1710 at, or proximate to, the bottom of the intermediate member.

Figure 18A:
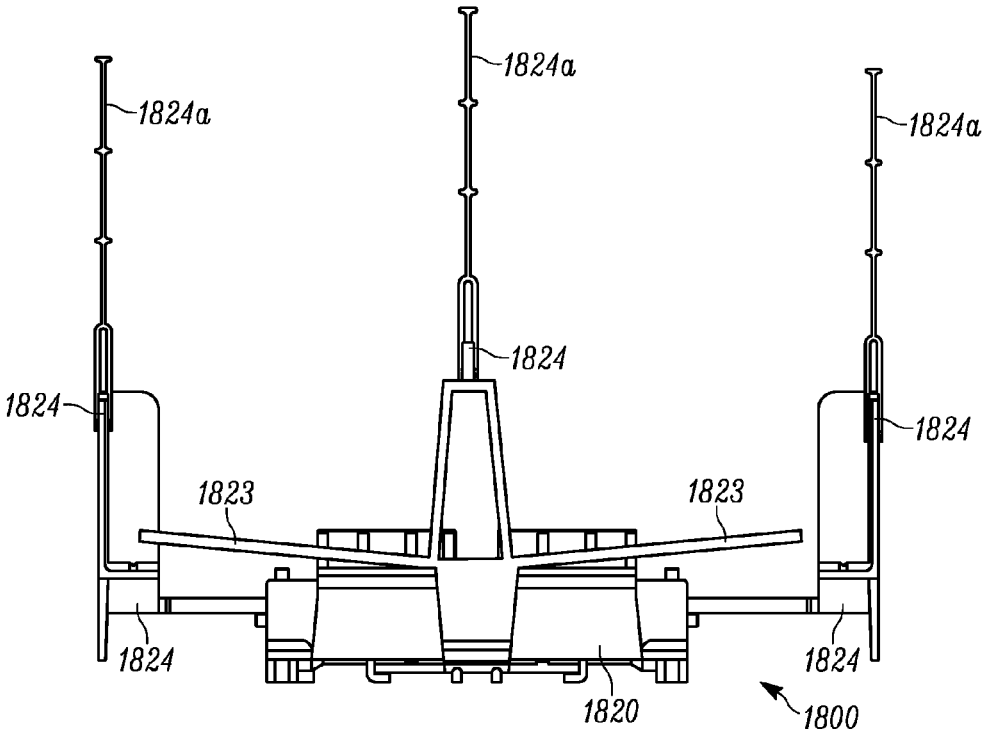
FIG. 18A is a front elevated view of a product display merchandiser in accordance with some embodiments of the present invention.
Figure 18B:
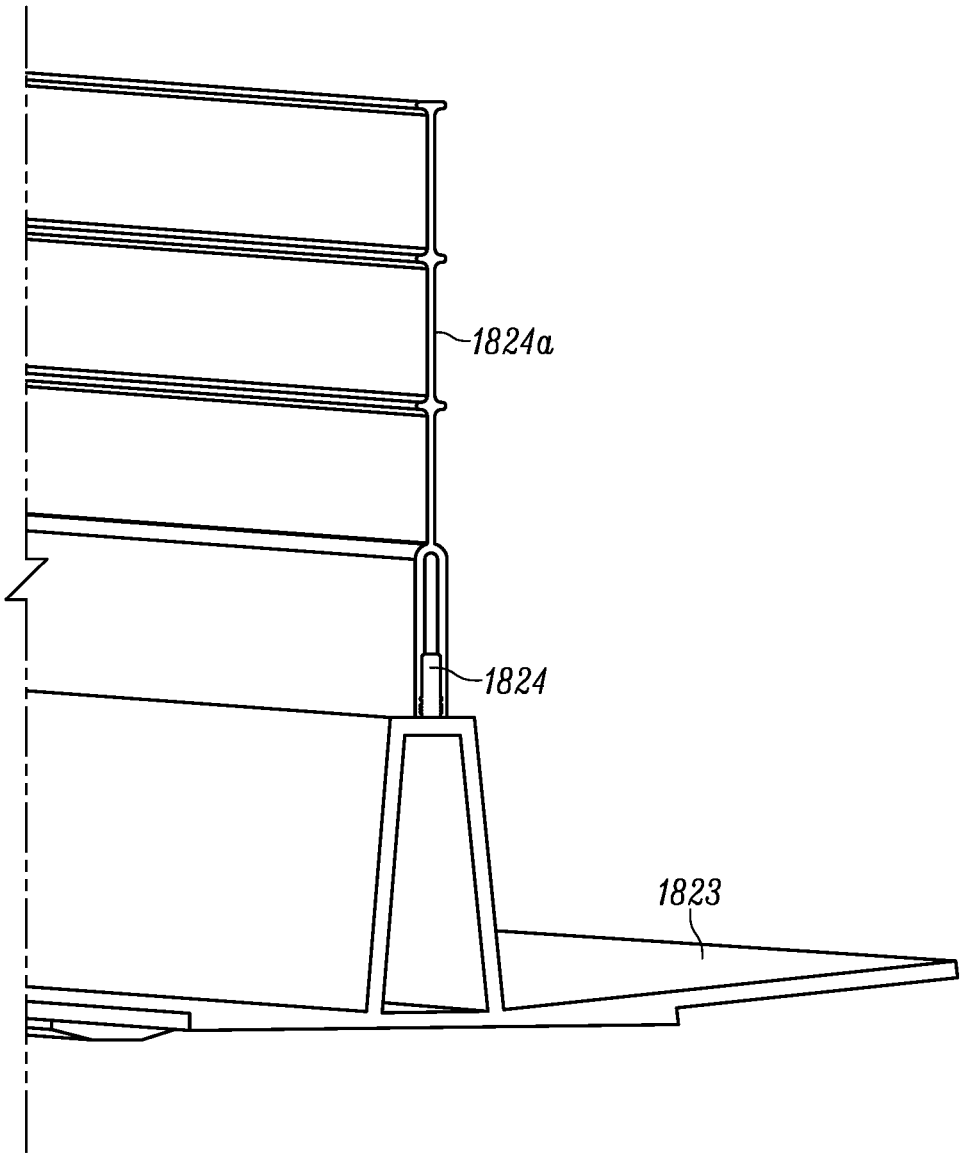
FIG. 18B is a rear perspective view of a portion of the product display merchandiser of FIG. 18A.

Turning to FIGS. 18A-B the product display 1800 includes movable and/or removable extensions 1824*a* located on the dividers 1824. The extensions 1824*a* adjust the height of the dividers 1824 enabling the product display 1800 to be usable with a variety of products. In operation, it is preferred that the top of the dividers 1824 be at least as high as the center of gravity of the products. This reduces the likelihood of the products tipping out of their product channel 1822. The top of the dividers 1824 should be no higher than the top of the products, so as to maximize vertical loadout. The extensions 1824*a* can be used to adjust the height of the dividers 1824 such that they fall within this range when the products are changed.

The product display 1800 includes two product channels 1822. Each product channel includes a bottom plate 1823 that is angled toward the center of the product display 1800. These angled bottom plates 1823 reduce the likelihood of the products contained thereon of tipping onto the outer dividers 1824 which could result in knocking off the extensions 1824*a* thereon. The outer dividers 1824 are mounted on sidewalls 1829 which are slidably attached to the tray 1820. The sidewalls 1829 slide to adjust the width of the product channels 1822 to fit the displayed products.

Figure 19A:
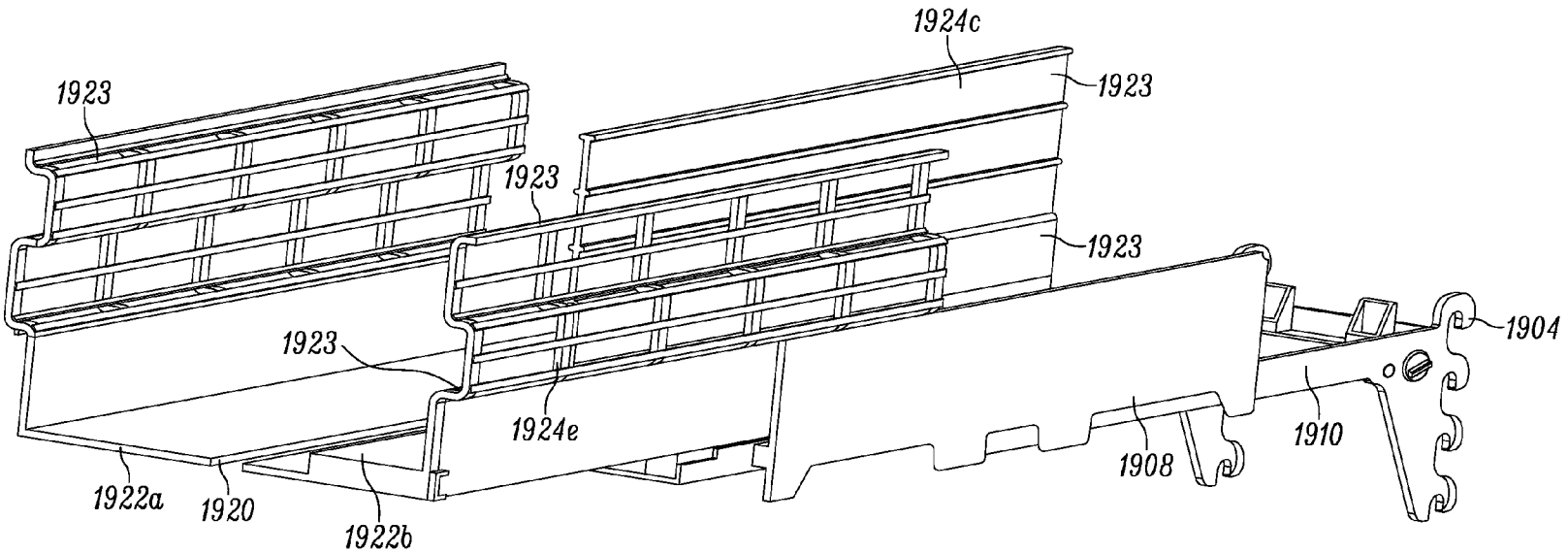
FIG. 19A is a perspective view of a product display merchandiser in accordance with some embodiments of the present invention.
Figure 19B:
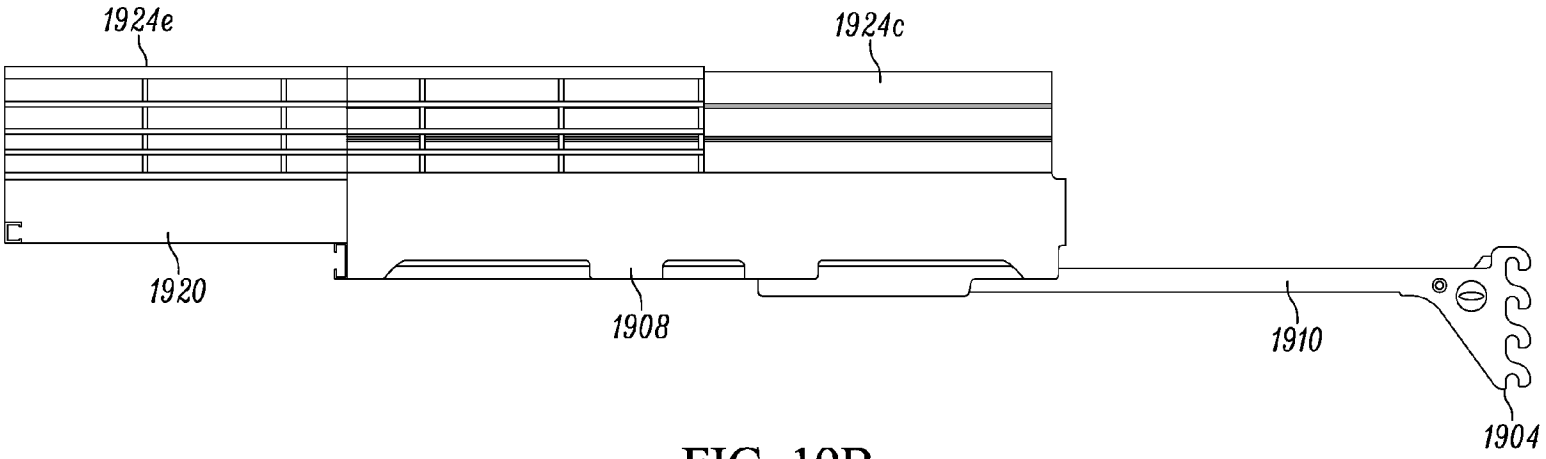
FIG. 19B is a side elevated view of the product display merchandiser of FIG. 19A.
Figure 19C:
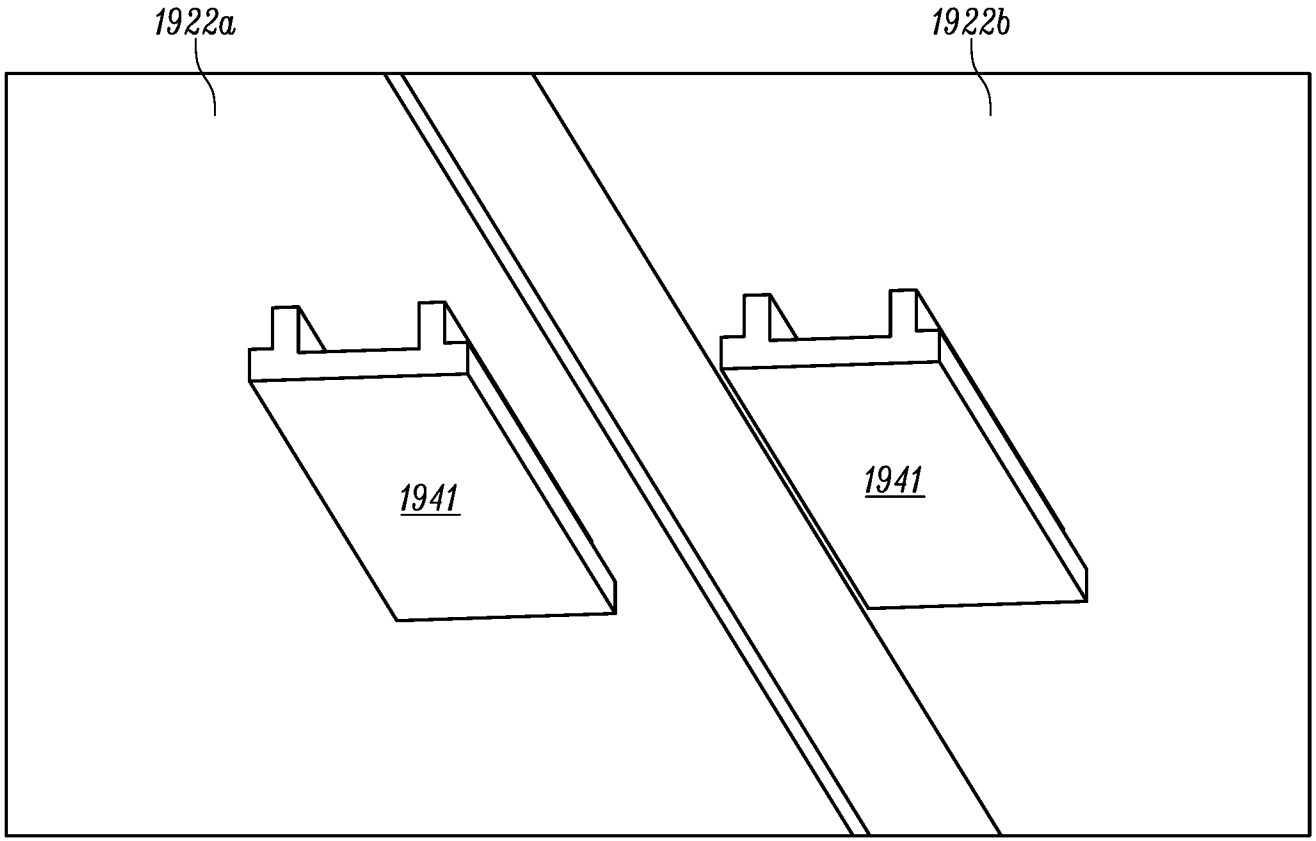
FIG. 19C is a bottom perspective view of a product support of the product display merchandiser of FIGS. 19A-B.

FIGS. 19A-C illustrate a product display 1900 having a product support 1920 formed of two independently slidable product channels 1922*a/b*. The product channels 1922*a/b* are slidable relative to the intermediate member 1908 which in turn is slidable relative to the support arms or support members 1910. As shown in FIG. 19A, the center divider 1924*c* is fixed to the intermediate member 1908 while the end dividers 1924*e* are fixed to their respective product channels 1922*a/b*. As such, when the product channels 1922*a/b* slide out relative to the intermediate member 1908, they also slide relative to the center divider 1924*c*. In operation, one of the product channels 1922*a/b* are extended into the loading position. Side of the product channel 1922*a/b* is unobstructed by additional product channels or the center divider 1924*c*, allowing easier access to the stocker.

FIG. 19C illustrate the bottom of the product support 1920. Each of the product channels 1922*a/b* has at least one protrusion 1941 configured to be received within a slot of the intermediate member 1908 as described in previous embodiments.

In some forms, the exterior dividers 1924*e* have a plurality of ledges 1923 configured to support multiple vertically spaced rows of products by their rims. The center divider 1924*c* has corresponding ledges 1923.

Figure 20A:
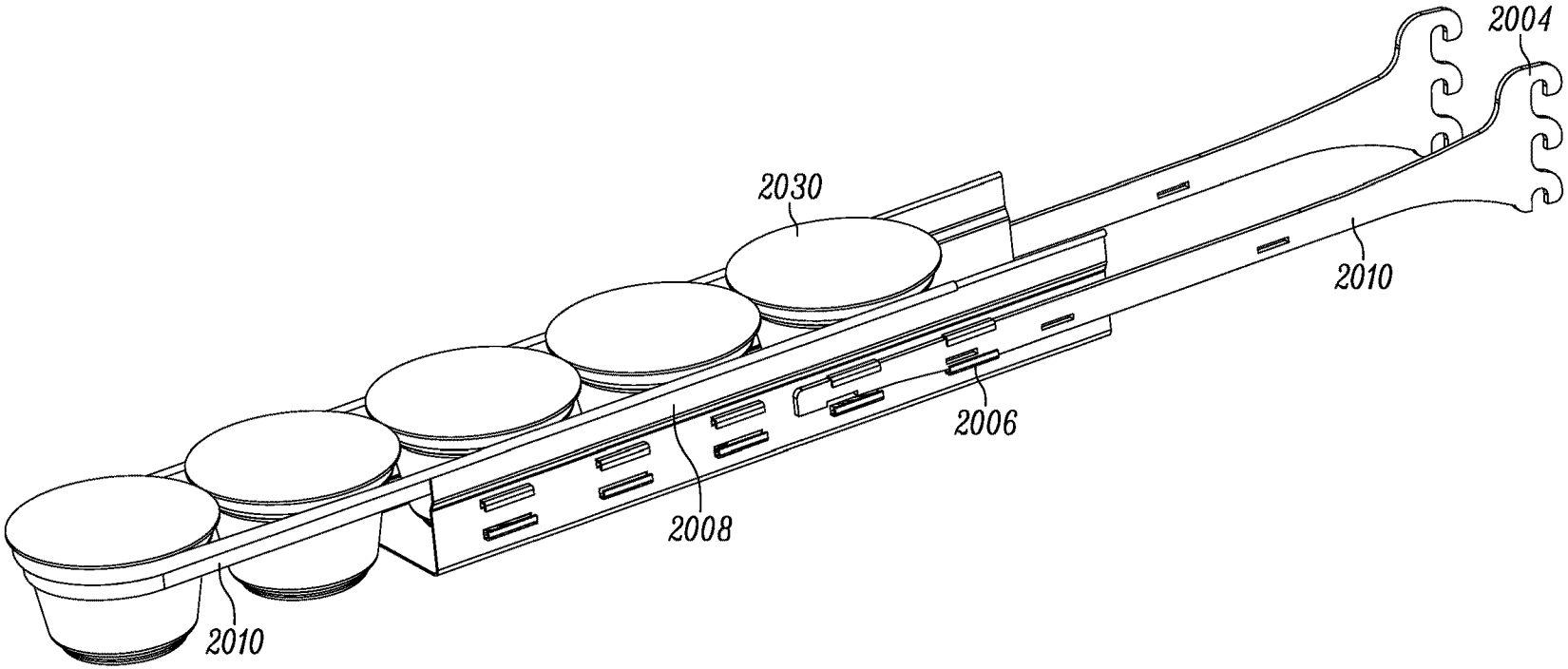
FIG. 20A is a front perspective view of a product display merchandiser in accordance with some embodiments of the present invention.
Figure 20B:
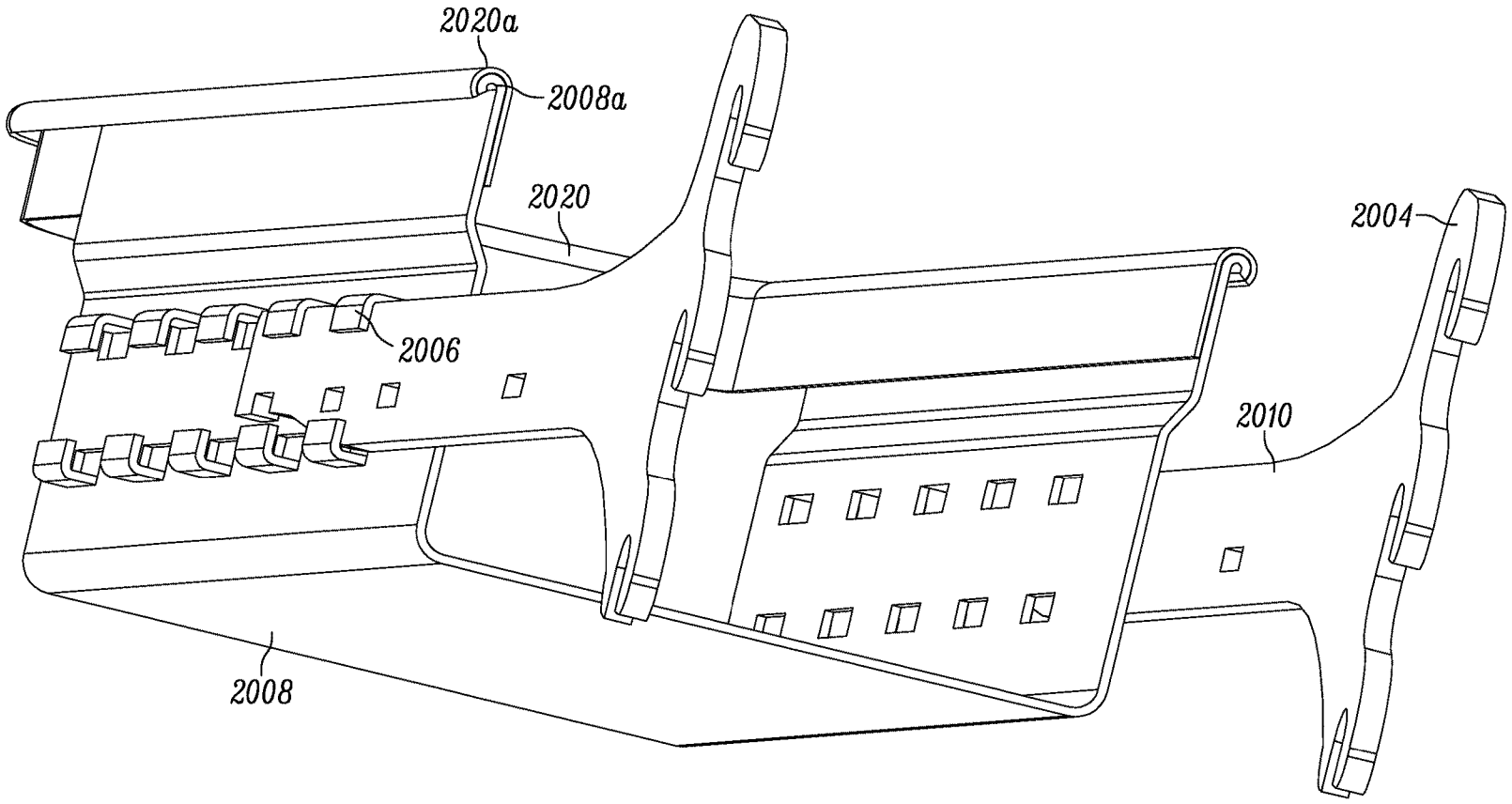
FIG. 20B is a rear perspective view of the product display merchandiser of FIG. 20A.

FIGS. 20A-B illustrates a product display 2000 having a baseless support member 2010 as well as a baseless product support 2020. The support member 2010 comprises a pair of arms with a space in between. The product support 1920 is an elongated member configured to support products 2030 by a rim or flange as shown. The intermediate member 2008 is a body having a generally U-shaped cross-section. The intermediate member includes projections 2006 forming a channel into which the support members 2010 are received. The projections 2006 are located on the, or proximate to, the sides of the intermediate member 2006. The arms of the support members 2010 are slightly tapered at the distal ends so as to more easily align with the channels defined by projections 2006 when assembling.

The intermediate member 2008 slides along the support members 2010 from a retracted or display position to an extended position. Unlike previous embodiments, wherein the support members 2010 were received in the bottom surface of the intermediate members, the protrusions 2006 are located on the sides of the intermediate member 2008, thus reducing the height of the product display 2000. The product support 2020 includes a mating structure 2020*a* and the intermediate member 2008 has a corresponding mating structure 2008*a*. In the shown form, the mating structures 2020*a*/2008*a* form a snap fit or friction fit in which the mating structure 2008*a* is received within the mating structure 2020*a*. The interacting mating structures 2008*a*/2020*a* are located proximate the sides of the product support 2020. In alternative embodiments, other mating structures can be used to slidably couple the product support 2020 to the intermediate member 2008, for example the product support 2020 can be received in channels on the inside surface of the sidewalls of the intermediate member 2008 similar to those formed by protrusions 2006.

When the product support 2010 is extended into a loading position, it defines a space there between. The lack of a base for either the support members 2010 or product support 2020 reduces the amount of material used to form the product display 2000. FIG. 20 illustrates the product support 2020 in a partially extended position, it is slidable relative to the intermediate member 2008 to a fully extended position in which the product support 2020 has moved forward by at least a distance equal to the length of the product support 2020 such that the entire product support 2020 is clear from obstruction by a similar product display 2000 located above the one being stocked.

In some forms, the product support 2020 partially extends in front of the intermediate member 2008 when both are in their fully retracted positions. This reveals at least a portion of the bottom of the front most product 2030 so that a user can lift the cup out of the product support 2020 more easily.

Figure 21:
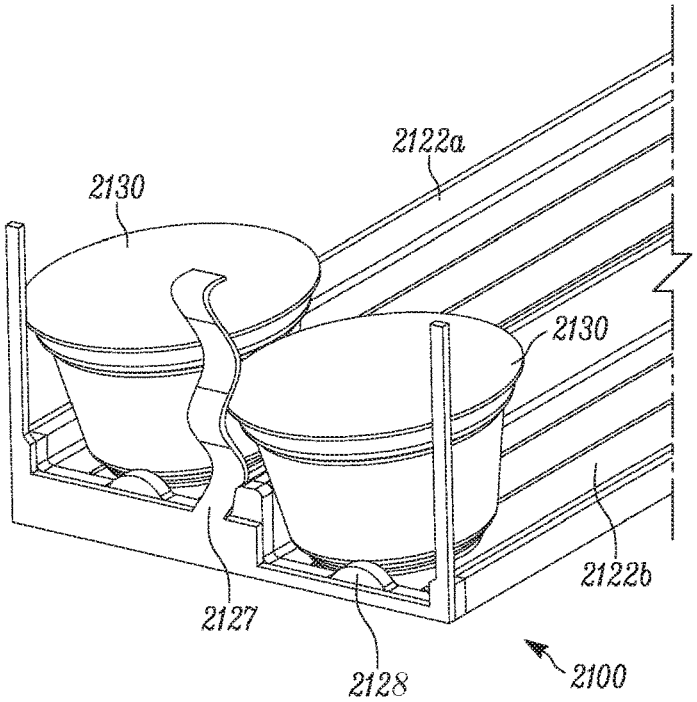
FIG. 21 is a front perspective view of a product display merchandiser in accordance with some embodiments of the present invention.
Figure 22:
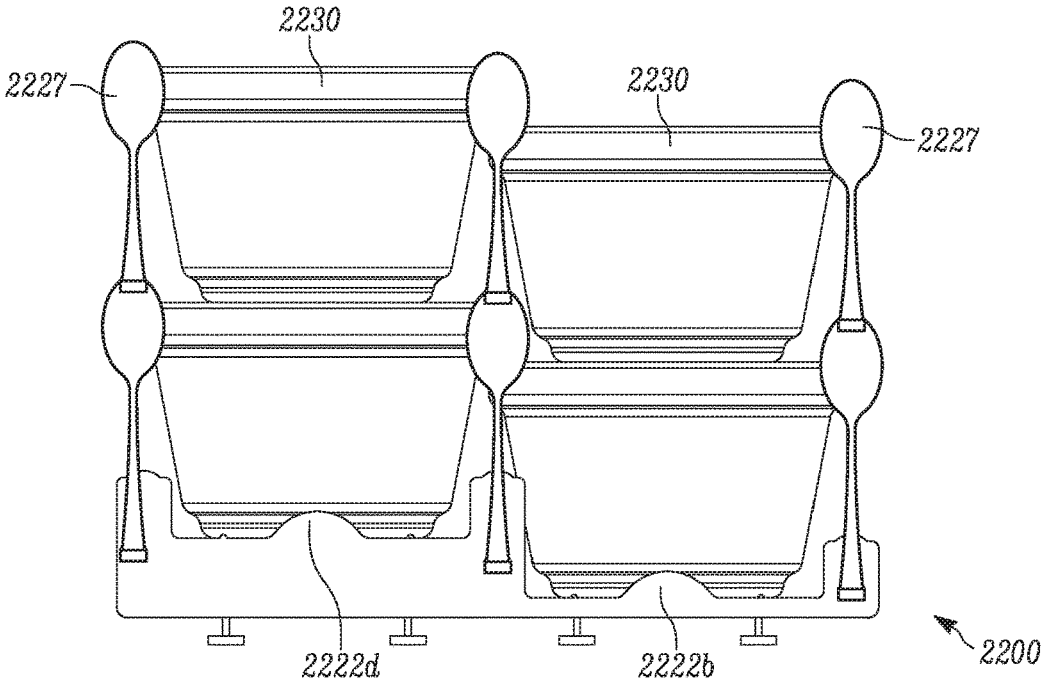
FIG. 22 is a front elevated view of a product display merchandiser in accordance with some embodiments of the present invention.

FIGS. 21 and 22 illustrate product stops 2127 and 2227 respectively usable with any of the multi-channel product displays described above. The stop 2127 comprises a wavy member. The wavy member is shaped such that the peaks of respective waves extend in towards their respective channels 2122*a/b* at a height equal to the widest part of the products 2130. As shown, the product channels 2122*a/b* are vertically staggered, such as the rim of one product 2130 is below the rim of an adjacent product 2130. The rims of each product 2130 are contacted by a top of a wave of the stop 2127. In operation, the products 2130 can be removed by lifting the product 2030 such that the rim aligns with a trough of the stop 2127. In some forms, the stop 2127 is resiliently deformable such that the products 2130 can be pulled straight forward and the stop 2127 twists or deforms out of position to allow the product 2130 to pass. The deformable stop 2127 is formed of a resiliently deformable material and or mounted in a deformable manner, for example mounted coaxially with a coil spring. The aesthetic of the wavy stop further serves to draw attention of browsing customers so as to increase impulse sales.

In some forms, the product channels 2122 are formed of an extruded plastic or composite or formed of sheet metal. The stops 2127 are formed of injection molded plastic or composite. The stops 2127 have a universal mating surface configured to mate with the front of a variety of trays 2120. In some embodiments, a second injection molded stop 2128 is positioned between the stop 2127 and the product tray 2120. In alternative embodiments, the stop 2127 does not cover the entire front surface of the tray 2120 as shown, and instead comprises a plurality of distinct stops configured to couple to and extend upward from a tray 2120.

The stop 2227 is shaped to correspond to the product being sold. For example, the display 2200 shown is configured to display yogurt cups 2230. The product stops 2237 are shaped like spoons, such as would be used to consume the yogurt 2230. In other examples, product stops shaped like forks are used to display salad or pasta, product stops shaped like screwdrivers are used to display boxes of screws, etc. In some forms, the product stops 2227 comprise a plurality of removable spoons, such that as a yogurt cup is removed, a spoon can be removed from the stop 2227 as well.

In addition to the above-mentioned embodiments, it should be understood that a variety of methods are also disclosed herein. For example, a method of stocking a merchandiser, a method of operating a merchandiser, a method of displaying products, or a method of tracking products. As are methods of manufacturing the devices described herein. These and other methods related to the subject matter set forth herein are intended to be covered by this disclosure. It should also be understood that while certain features have been described with certain embodiments, these features may be intermixed or interchanged with one another to form other embodiments as desired. All features disclosed herein are intended to be used in any of the embodiments disclosed herein either in lieu of similar features or in combination with other features. For example, the rotating mechanism of merchandisers 100 or 600 can be implemented in merchandisers 700 and/or 800. Alternatively, or additionally, the guides 724*a-c* and/or the guides 824*a-c* can be implemented in any of the other merchandisers. The beads 123 can be inserted into the product channels of any of the other merchandisers described herein. Similarly, any of the disclosed embodiments can be implemented into the modular merchandiser 1000.

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A product display merchandiser comprising:

a support member;

an intermediate member movably attached to the support member, the intermediate member being movable between at least a retracted position and an extended position; and a product support slidably attached to the intermediate member and movable between at least a retracted display position and an extended stocking position;

wherein the intermediate member has a front portion, a rear portion and a longitudinal axis extending between the front portion and the rear portion, and the product support is slidable along the longitudinal axis or an axis parallel to the longitudinal axis so that the product support extends out relative to the front portion of the intermediate member beyond a generally vertical plane containing the front portion of the intermediate member when the product support is in the extended stocking position.

2. A product display merchandiser comprising:

a support member;

an intermediate member movably attached to the support member, the intermediate member being movable between at least a retracted position and an extended position; and a product support attached to the intermediate member;

wherein the product support is rotatably attached to the intermediate member, the product support being rotatable between at least a display position with a front portion of the product support facing forward and a stocking position with the front portion facing a direction other than forward.

3. The product display merchandiser of claim 2 wherein the stocking position is about one of 90 degrees and 180 degrees from the display position.

4. A product display merchandiser comprising:

a support member;

an intermediate member movably attached to the support member, the intermediate member being movable between at least a retracted position and an extended position; and a product support attached to the intermediate member;

wherein the product display merchandiser comprises a first product channel and a second product channel, and the first product channel and the second product channel are configured to support products at different heights; and wherein the first product channel is positioned above the intermediate member when in a display position and the second product channel is positioned beside the intermediate member when in the display position.

5. A product display merchandiser comprising:

a support member;

an intermediate member movably attached to the support member, the intermediate member being movable between at least a retracted position and an extended position;

a product support attached to the intermediate member;

wherein the product display merchandiser comprises a first product channel and a second product channel;

wherein the first product channel and the second product channel are configured to support products at different heights; and wherein the first product channel is positioned above the support member when in a display position and the second product channel is positioned beside the support member when in the display position.

6. A product display merchandiser comprising:

a support member;

an intermediate member movably attached to the support member, the intermediate member being movable between at least a retracted position and an extended position;

a product support attached to the intermediate member; and inserts detachably coupled to the product support, the inserts configured to support a bottom surface of a product.

7. A product display merchandiser comprising:

a support member;

an intermediate member movably attached to the support member, the intermediate member being movable between at least a retracted position and an extended position;

a product support attached to the intermediate member having:

a first point of contact configured to contact a front product in a first row of products; and a second point of contact configured to contact a front product in a second row of products, the second row of products being positioned above the first row of products; and further comprising a product stop positioned proximate a front edge of the product support.

8. A product display merchandiser comprising:

a support member;

an intermediate member movably attached to the support member, the intermediate member being movable between at least a retracted position and an extended position; and a product support attached to the intermediate member;

wherein the intermediate member is attached to the support member proximate at least one of a side of the intermediate member and a bottom of the intermediate member.

* * * * *